US006326117B1

(12) United States Patent
Ishihara

(10) Patent No.: US 6,326,117 B1
(45) Date of Patent: Dec. 4, 2001

(54) HEAT PRESSURE-FIXABLE CAPSULATED TONER AND PROCESS FOR PRODUCING THE SAME

(75) Inventor: Toru Ishihara, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 09/606,525

(22) Filed: Jun. 30, 2000

Related U.S. Application Data

(63) Continuation of application No. 09/195,200, filed on Nov. 18, 1998, now abandoned.

(30) Foreign Application Priority Data

Dec. 10, 1997 (JP) ..... 9-361753

(51) Int. Cl.[7] ..... G03G 9/00

(52) U.S. Cl. ..... 430/110.2; 430/109.1; 430/111.1; 430/137

(58) Field of Search ..... 430/111, 109, 430/137, 110.2, 109.1, 111.1

(56) References Cited

U.S. PATENT DOCUMENTS 5,455,315 * 10/1995 Paine et al. ..... 430/109

* cited by examiner

*Primary Examiner*—Mark Chapman
(74) *Attorney, Agent, or Firm*—Rabin & Berdo, P.C.

(57) ABSTRACT

A capsulated toner comprising a core and an outer shell covering thereon having at least one layer of a shell material comprised of a thermoplastic resin, wherein the thermoplastic resin forming the core has a Tg ranging from 50° C. to 70° C. and wherein a Tg of the thermoplastic resin forming the shell is higher than that of the thermoplastic resin forming the core.

6 Claims, 5 Drawing Sheets

HEAT PRESSURE-FIXABLE CAPSULATED TONER AND PROCESS FOR PRODUCING THE SAME

This application is a continuation of Ser. No. 09/195,200 filed Nov. 18, 1998, now abandoned.

BACKGROUND OF THE INVENTION

The present invention relates to a heat pressure-fixable capsulated toner for use in the development of electrostatic latent images formed in electrophotography, electrostatic printing or electrostatic recording, and a process for the production thereof.

Conventional electrophotographies comprises a developing step which comprises of uniformly electrifying a photoconductive insulating layer, subjecting the layer to exposure, dissipating the charge on the exposed portion to form an electrical latent image, and then depositing a fine charged powder having a coloring agent (referred to as a toner hereinbelow) to form a visual image, a step of transferring the resultant visual image onto a transfer material such as transfer paper, and a step of permanently fixing the visual image by heating, pressure or other suitable fixation procedure.

In general, a toner is subjected to a variety of mechanical stresses caused by rolling action of a developing roller and a toner-supplying roller during operation in a developing apparatus, and mechanically deteriorates for a long time of the operation. It has been known that the use of resins having a large molecular weight can generally reduce the deterioration of the toner. However, since it is necessary to heat a heat-roller to a high temperature for the satisfactory fixation of the resins, the use thereof causes some problems, such as enlargement of fixation apparatus, curl of papers, large energy consumption and prompted deterioration of the fixation apparatus.

In order to solve the problems mentioned above, a proposal has been made on the use of a capsulated toner comprising a core material and an outer shell which covers the surface of the core.

This proposal intends to obtain a capsulated toner having both of good fixation and good blocking resistance by a combination of the core made of easily-fixable and thermally soft materials, or having a low melting point and the outer shell made of comparatively hard material having a good blocking resistance. The term "blocking" used herein means to form an agglomerate of toner particles adhering to each other.

Some proposals have been made on a variety of techniques using a wax having a low melting temperature such as a liquid wax and a rubber-like wax at a room temperature, as a core material. A shell material can be generally selected from hard materials. When the shell material is soft and has a low strength, although a fixation is improved, it would be difficult to obtain the intended property of toner since the shell material would separate from the core material and the toner itself would deform due to a stress caused by a developing apparatus.

When the shell material is hard and has a high strength, the fixation of the toner becomes bad since crushing the shell requires a large pressure and/or a high temperature. Consequently, a proposal has been made on a capsulated toner for heat roller fixation comprising a resin having a low glass-transition temperature, as a core material, which causes a blocking at a high temperature when it is used alone, but which improves the fixation of the toner for heat-pressure fixation, and a resin having a high glass-transition temperature as a shell material, which is useful for increasing a blocking resistance of the toner.

The conventional techniques mentioned above have the following problems to be solved. Although there has been a lot of the proposed toner having an outer shell and a core, which is produced with a variety of materials and by a variety of processes, the toner is not sufficient in fixation at a low temperature, offset resistance, blocking resistance and endurance. That is, an ideal process for the production of toner having a core-shell structure has not been established yet. The term "offset" used herein means that a toner melts at an elevated temperature to adhere to a fixation roller in a fixation step.

Among the above-listed properties of toner, it is very difficult to coincidentally satisfy the fixation at a low temperature and the blocking resistance in the toner. Taking a printing apparatus, in particular a contact-developing system, into consideration, these properties should be balanced in highly good condition. The reasons for the balance is as follows:

Since a development in the contact developing system is done by adding a high pressure between a developing roller and a photoreceptor drum, the toner thin layer formed on the developing roller is subjected to an intense stress.

The toner subjected to such a high pressure easily deteriorates at an elevated temperature to cause troubles, for example, fixing onto a surface of photoreceptor drum. It causes troubles in printing. Although such troubles can be prevented by employing a resin having a high glass-transition temperature or adding a large amount of shell material to produce the toner, the fixation at a low temperature will be lost to lower an ability of the toner.

In other words, a fixation at a low temperature is inconsistent with a blocking resistance in a toner, in particular the toner that for a contact developing system. In view of the inconsistency, it would be very important to produce a capsulated toner practically useful for a contact developing system.

As mentioned above, the toner conventionally proposed has not satisfied a balance of a fixation at a low temperature and a blocking resistance, and has not been practically useful for contact developing at a high pressure. This is because a heat characteristic of core resin of the toner was designed to enhance a fixation property by using a resin having a low glass-transition temperature.

Consequently, it has been desired to develop a pressure-fixable toner for a heat pressure-fixation system using a heat roller, which is excellent in an offset resistance, a fixation at a low temperature, a blocking resistance and an endurance in a long time operation, in particular, a capsulated toner practically useful practically useful in a contact development system.

SUMMARY OF THE INVENTION

The present invention has been accomplished in order to solve the problems mentioned above. That is, an object of the present invention is to provide a heat pressure-fixable toner having excellent properties such as high offset resistance, good fixation at a low temperature, high blocking resistance and high endurance in a long time operation. Another object of the present invention is to provide a heat pressure-fixable toner having a good balance of fixation at a low temperature and blocking resistance which prevent troubles in printing caused by development step, in particular by that of contact developing system. A further object of the present invention is to provide a process for the production of said toner.

According to the present invention, there are provided the following toners and processes for the production thereof.

(1) A process for the production of a heat pressure-fixable toner which comprises
  (i) preparing an intermediate particle of core material containing at least (a') thermoplastic resin and a coloring agent by polymerization of (a) polymerizable monomer;
  (ii) initiating a polymerization of (b) polymerizable monomer to form an outer shell covering the intermediate particle after starting and before finishing the polymerization of (a) polymerizable monomer; and
  (iii) forming the outer shell having at least one layer of (b') thermoplastic resin which is different from (a') thermoplastic resin in a glass-transition temperature (which will be referred to as Tg. hereinbelow).

(2) A process for the production of a heat pressure-fixable toner which comprises
  (i) preparing an intermediate particle of core material containing at least (a') thermoplastic resin and a coloring agent by polymerization of (a) polymerizable monomer;
  (ii) initiating a polymerization of (b) polymerizable monomer to form an outer shell covering the intermediate particle after starting the polymerization of (a) polymerizable monomer and finishing 90% of the polymerization of (a) polymerizable monomer or more at a surface of the intermediate particle, and before finishing the polymerization of (a) polymerizable monomer; and
  (iii) forming the outer shell having at least one layer of (b') thermoplastic resin which is different from (a') thermoplastic resin in a Tg.

(3) A process for the production of a heat pressure-fixable toner which comprises
  (i) preparing an intermediate particle of core material containing at least (a') thermoplastic resin and a coloring agent by polymerization of (a) polymerizable monomer;
  (ii) swelling (b) polymerizable polymer for forming an outer shell on a surface of the intermediate particle after finishing the polymerization of (a) polymerizable monomer of the core material;
  (iii) then initiating the polymerization of (b) polymerizable monomer for forming the outer shell; and
  (iv) forming the outer shell having at least one layer of (b') thermoplastic resin which is different from (a') thermoplastic resin of the core material in a Tg.

(4) A capsulated toner comprising an intermediate particle made of a core material comprising at least (a') thermoplastic resin and a coloring agent, and an outer shell covering the intermediate particle and having at least one layer of a shell material comprised of (b') thermoplastic resin which is different from (a') thermoplastic resin in a Tg, wherein an outermost layer is made of the shell material comprising a thermoplastic resin having a Tg of 70° C. or more.

(5) A capsulated toner comprising an intermediate particle made of a core material comprising at least (a') thermoplastic resin and a coloring agent, and an outer shell covering the intermediate particle and having at least one layer of a shell material comprised of (b') thermoplastic resin, wherein the core material comprises (a') thermoplastic resin having a Tg ranging from 50° C. to 70° C., and wherein an outermost layer is made of the shell material comprising the thermoplastic resin having a Tg of 70° C. or more.

(6) A capsulated toner comprising an intermediate particle made of a core material comprising at least (a') thermoplastic resin and a coloring agent, and an outer shell covering the intermediate particle and having at least one layer of a shell material comprised of (b') thermoplastic resin which is different from (a') thermoplastic resin in a Tg., wherein a total amount of the shell material forming an outermost shell ranges from 0.1 to 4 part by weight based on a total amount of the core material and the shell material.

(7) A process for the production of a heat pressure-fixable toner which comprises
  (i) preparing an intermediate particle of a core material comprising at least (a') thermoplastic resin and a coloring agent by polymerization of (a) polymerizable monomer;
  (ii) initiating the polymerization of (b) polymerizable monomer for forming an outer shell covering the intermediate particle after starting the polymerization of (a) polymerizable monomer of the core material in the presence of 4 to 15 part by weight of a polymerization initiator based on an amount of (b) polymerizable polymer; and
  (iii) forming the outer shell having at least one layer of (b') thermoplastic resin which is different from (a') thermoplastic resin of the core material in a Tg.

(8) A process for the production of a heat pressure-fixable toner which comprises
  (i) preparing (b') thermoplastic resin by partial polymerization of (b) polymerizable monomer for forming an outer shell;
  (ii) then mixing (b') thermal plastic for forming the outer shell, (a) polymerizable monomer for forming an intermediate particle, a polymerization initiator and a coloring agent, and dispersing the resultant mixture in dispersion medium;
  (iii) polymerizing (a) polymerizable monomer of the core material in the dispersion to form the mediate particles, and coincidentally further polymerizing (b') thermoplastic resin of the shell material, whose Tg is higher than that of (a') thermoplastic resin, to form the outer shell covering the intermediate particle and having at least one layer of the shell material.

(9) A process for the production of a heat pressure-fixable toner which comprises
  (i) preparing (b') thermoplastic resin by partial polymerization of (b) polymerizable monomer for forming an outer shell;
  (ii) then mixing (b') thermal plastic for forming the outer shell, (a) polymerizable monomer for forming an intermediate particle, an polymerization initiator and a coloring agent, and dispersing the resultant mixture in dispersion medium;
  (iii) polymerizing (a) polymerizable monomer of the core material for forming the intermediate particle in the dispersion to form the core, and coincidentally further polymerizing (b') thermoplastic resin of the shell material, whose Tg is higher than that of (a') thermoplastic resin, to form the outer shell covering the core and having at least one layer of the shell material.

(10) A capsulated toner comprising an intermediate particle made of a core material comprising at least (a')

thermoplastic resin and a coloring agent, and an outer shell covering the intermediate particle and having two or more layers of a shell material comprised of (b') thermoplastic resin whose Tg is higher than that of (a') thermoplastic resin of the core material, wherein the inter mediate layer(s) located between an outermost layer of the outer shell and the intermediate particle is made of (b') thermoplastic resin prepared by partial polymerization of (b) polymerizable monomer before starting the polymerization of (a) polymerizable monomer of the core material and then further polymerizing the resultant (b') thermoplastic resin together with (a) polymerizable monomer of the core material.

(11) A capsulated toner comprising an intermediate particle made of a core material containing at least (a') thermoplastic resin and a coloring agent, and an outer shell which comprises at least one intermediate layer covering the core comprised of a shell material containing (b'2) thermoplastic resin whose Tg is higher than that of (a') thermoplastic resin of the core material, and an outermost layer which is formed on the intermediate layer and made of the shell material containing (b'3) thermoplastic resin whose Tg is higher than that of (a') thermoplastic resin of the core material, wherein the Tg of (b'2) thermoplastic resin of the shell material forming the intermediate layer is 5° C. higher or more than that of (a') thermoplastic resin of the core material, and wherein the Tg of (b'3) thermoplastic resin of the shell material forming an outermost layer is 5 ° C. higher or more than that of (b'2) thermoplastic resin of the shell material forming the intermediate layer.

(12) A process for the production of a heat pressure-fixable toner which comprises (i) preparing an intermediate particle of core material containing at least (a') thermoplastic resin and a coloring agent by polymerization of (a) polymerizable monomer;

(ii) initiating a polymerization of (b2) polymerizable monomer to form an intermediate layer of an outer shell covering the intermediate particle after starting and before finishing the polymerization of (a) polymerizable monomer; then (iii) initiating a polymerization of (b3) polymerizable monomer to form an outer layer of the outer shell on the intermediate layer after starting and before finishing the polymerization of (b2) polymerizable monomer; and (iv) forming the toner having the core and the outer shell consisting of the intermediate layer made of (b'2) thermoplastic resin and the outer layer made of (b'3) thermoplastic resin wherein (b2') and (b3') resins are different from the core material in a Tg. The temperature difference is 5° C. or more.

(13) A capsulated toner comprising an intermediate particle made of a core material containing at least (a') thermoplastic resin and a coloring agent, and an outer shell which comprises at least one intermediate layer comprised of a shell material containing (b'2) thermoplastic resin whose Tg is higher than that of (a') thermoplastic resin of the core material, and an outermost layer which is formed on the intermediate layer and made of a shell material containing (b'3) thermoplastic resin whose Tg is lower than that of (b2') thermoplastic resin of the intermediate layer.

(14) A process for the production of a heat pressure-fixable toner which comprises (i) preparing the (b'2) thermoplastic resin by partial polymerization of (b2) polymerizable monomer for forming an intermediate layer of an outer shell;

(ii) then mixing (b'2) thermoplastic resin for forming the intermediate layer of the outer shell, (a) polymerizable monomer for forming an intermediate particle, an polymerization initiator and a coloring agent, and dispersing the resultant mixture in dispersion medium;

(iii) polymerizing (a) polymerizable monomer of the core material in the dispersion to form the mediate particles, and coincidentally further polymerizing (b'2) thermoplastic resin of the shell material, whose Tg is higher than that of (a') thermoplastic resin, to form the intermediate layer of the outer shell covering the intermediate particle; then (iv) initiating a polymerization of (b3) polymerizable monomer to form the outer layer of the outer shell on the intermediate layer before finishing the polymerization of (b'2) thermoplastic resin of the intermediate layer of the shell material; and (v) forming the core and the outer shell which comprises the intermediate layer, which covers the core, comprised of the shell material containing (b'2) thermoplastic resin whose Tg is higher than that of (a') thermoplastic resin of the core material, and the outer layer which is formed on the intermediate layer and made of a shell material containing (b'3) thermoplastic resin whose Tg is lower than that of (b2') thermoplastic resin of the intermediate layer.

According to the present invention, there is provided the toner cartridge wherein the toner described above is stored.

According to the present invention, there is provided the developing unit wherein the toner cartridge described above is supplied.

DETAILED DESCRIPTION OF THE INVENTION

Figure 1:
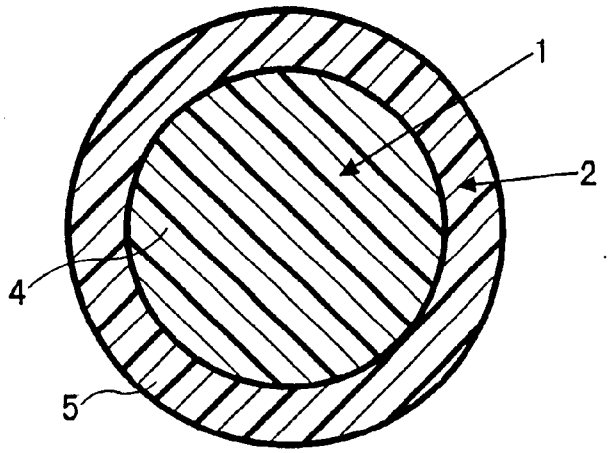
FIG. 1 illustrates a cross-sectional magnification of the capsulated toner of embodiment 1. Core 1 (intermediate particle) was made of core material 4. Shell 2 was made of shell material 5.
Figure 2:
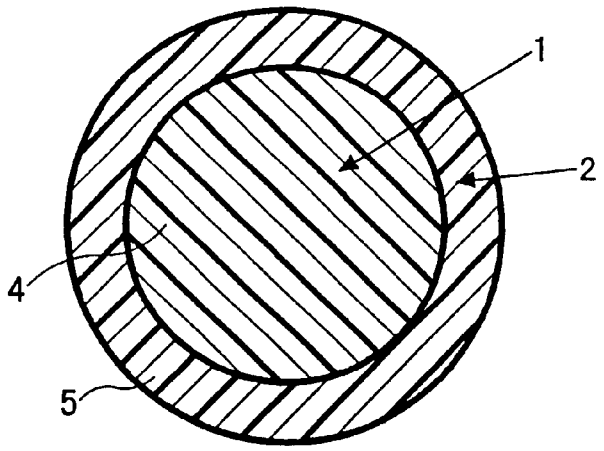
FIG. 2 illustrates a cross-sectional magnification of the capsulated toner of embodiment 2. Shell 2 has a Tg of 70° C. or more.
Figure 3:
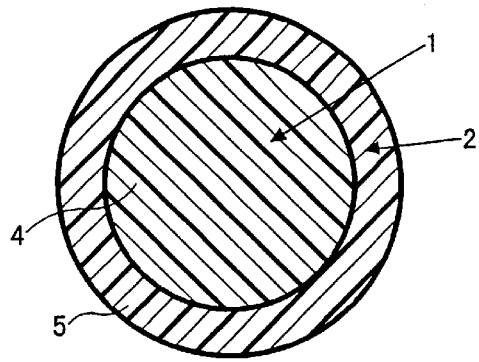
FIG. 3 illustrates a cross-sectional magnification of the capsulated toner of embodiment 3. The toner includes 0.1 to 4 parts by weight of a shell resin.
Figure 4:
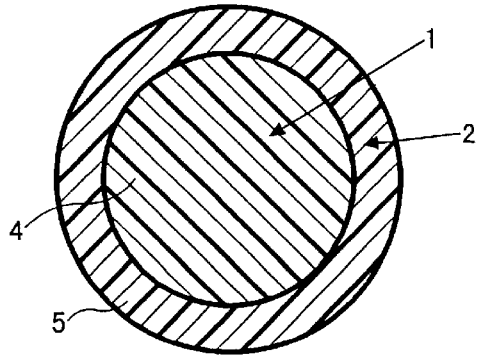
FIG. 4 illustrates a cross-sectional magnification of the capsulated toner of embodiment 4. An outer layer of the toner includes 4 to 15 parts by weight of a polymerization initiator.
Figure 5:
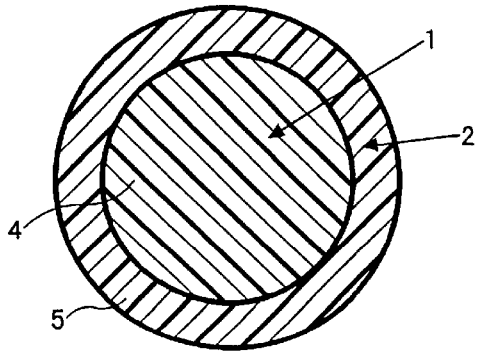
FIG. 5 illustrates a cross-sectional magnification of the capsulated toner of embodiment 5. Shell 2 was prepolymerized.
Figure 6:
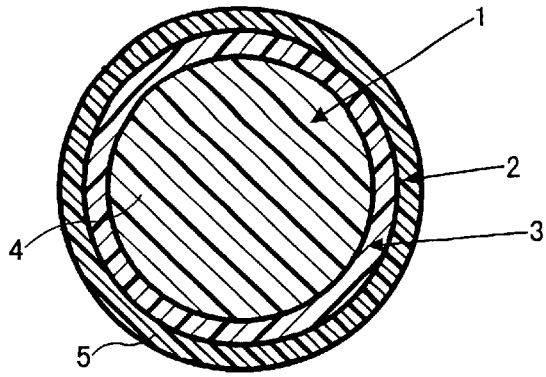
FIG. 6 illustrates a cross-sectional magnification of the capsulated toner of embodiment 6. Shell 2 is an outermost shell and shell 3 is an intermediate layer which was prepolymerized.
Figure 7:
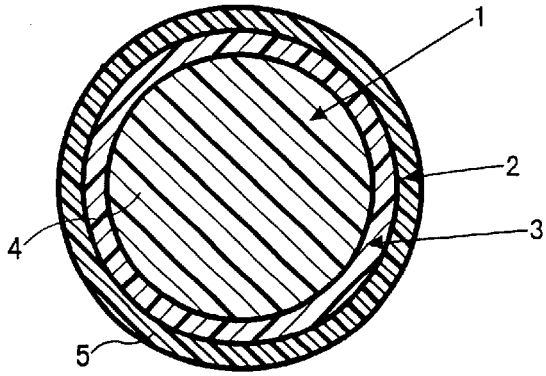
FIG. 7 illustrates a cross-sectional magnification of the capsulated toner of embodiment 7. Shell 2 is an outermost shell and shell 3 is an intermediate layer. There is a Tg. difference of 5° C. or more between shells 2 and 3.
Figure 8:
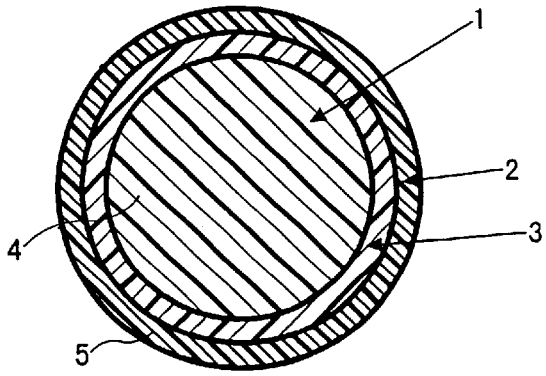
FIG. 8 illustrates a cross-sectional magnification of the capsulated toner of embodiment 8. Shell 2 is an outermost shell and shell 3 is an intermediate layer of which Tg. is high.

The present invention will be illustrated hereinbelow by embodiments thereof.

<Embodiment 1>

In order to solve the problems of the conventional toners as mentioned above, the present invention provides a heat pressure-fixable toner comprised of at least thermoplastic resins and a coloring agent wherein an outer shell is made of at least two kinds of thermoplastic resins having different Tgs formed by seeding polymerization, and wherein a thermoplastic resin of the core has a Tg ranging from 50 to 70° C. The toner of the present invention has a good fixation at a low temperature, a high blocking resistance and a high endurance enough to prevent a change of the toner caused by mechanical stress in an developing apparatus, and can stably provides a clear image without a fog in background for a long time.

The toner in accordance with the present invention comprises of a core material and an outer shell material covering a surface of the core. The toner has the following characteristics.

1. The core is made of at least a coloring agent and a thermoplastic resin prepared with a polymerizable monomer.
2. The thermoplastic resin of the shell material is different from that of the core material in a Tg. The shell may have one or more layers.
3. The shell material may be started to polymerize after starting and before finishing the polymerization of the polymerizable monomer in the core material, or after finishing it.
4. It is preferable to start the polymerization of the polymerizable monomer in the shell material after completing 90% of the polymerization of the polymerizable monomer in the core material.

Further scope of the applicability of the present invention will become apparent from the detailed description given hereinafter. However, it should be understood that the detailed description and specific examples, while indicating preferred embodiments of the invention, are given by way of illustration only, since various changes and modifications within the sprit and scope of the invention will become apparent to those skilled in the art from this detailed description.

Suitable resins useful for forming the core and shell materials in the present invention include thermoplastic resins such as vinyl resins, polyamide resins and polyester resins. Polymerizable monomers useful for preparing the thermoplastic resins include, for example, styrene or styrene derivatives such as 2,4-dimethylstyrene, α-methylstyrene, p-ethylstyrene, o-methylstyrene, m-methylstyrene, p-methylstyrene, p-chlorostyrene and vinylnaphthalene; ethylenically monocarboxylic acids and their esters such as 2-ethylhexyl acrylate, methyl methacrylate, acrylic acid, methyl acrylate, ethyl acrylate, n-propyl acrylate, isobutyl acrylate, t-butyl acrylate, amyl acrylate, cyclohexyl acrylate, n-octyl acrylate, isooctyl acrylate, decyl acrylate, lauryl acrylate, stearyl acrylate, methoxyethyl acrylate, 2-hydroxyethyl acrylate, glycidyl acrylate, phenyl acrylate, methyl α-chloroacrylate, methacrylic acid, ethyl methacrylate, n-propyl methacrylate, isopropyl methacrylate, n-butyl methacrylate, isobutyl methacrylate, t-butyl methacrylate, amyl methacrylate, cyclohexyl methacrylate, n-octyl methacrylate, isooctyl methacrylate, decyl methacrylate, lauryl methacrylate, 2-ethylhexyl methacrylate, stearyl methacrylate, methoxyethyl methacrylate, 2-hydroxyethyl methacrylate, glycidyl methacrylate, phenyl methacrylate, dimethylaminoethyl methacrylate; ethylenically unsaturated monoolefins such as ethylene, propylene, butylene and isobutylene; vinyl esters such as vinyl chloride, vinyl bromoacetate, vinyl propionate, vinyl formate, and vinyl caproate; substituted ethylenically monocarboxylic acids such as acrylonitrile, methacrylonitrile and acrylamide; ethylenically dicarboxylic acids or substituted ethylenically dicarboxylic acids such as maleates; vinyl ketones such as vinyl methyl ketone, and vinyl ethers such as vinyl methyl ether.

One of the thermoplastic resins or a mixture thereof may be used to prepare the core material and shell material of the present invention. As mentioned above, polymerizable monomers used to form the core should be selected so as to obtain the thermoplastic resin having a Tg of 50 to 70° C. after the polymerization thereof.

Where a Tg of the thermoplastic resin of the core is less than 50° C., even if a capsulated toner has an ideal shell and is a blocking resistant under an ambient pressure at a high temperature, the capsulated toner is changed in its shape under a high pressure and at a high temperature and therefore looses the blocking resistance. That is, as mentioned in relation to the conventional technologies, where the Tg is less than 50° C., it is difficult to use the capsulated toner in an electrophotography apparatus using a contact developing system. Where the Tg is more than 70° C., the fixation of the capsulated toner becomes poor.

A monomer composition for forming the thermoplastic resin of the core material of the present invention may include a crosslingking agent. Examples of the agent include the conventional ones such as divinyl benzene, divinyl naphthalene, polyethyleneglycol dimethacrylate, 2,2'-bis(4-methacryloxy diethoxyphenyl)propane, 2,2'-bis(4-acryloxy diethoxydiphenyl)propane, diethyleneglycol diacrylate, triethyleneglycol diacrylate,1,3-butyleneglycol dimethacrylate, 1,6-hexyleneglycol dimethacrylate, neopentylglycol dimethacrylate, dipropyleneglycol dimethacrylate, polypropyleneglycol dimethacrylate, trimethylolpropane trimethacrylate, trimethylolpropane triacrylate, and tetrametylolmethane tetraacrylate. One of the crosslingking agents or a mixture thereof may be used.

Polymerization initiators used in preparing the thermoplastic resins of the core include azo- or diazo-polymerization initiators such as 2,2'-azobis(2,4-dimethylvaleronitrile), 2,2'-azobis (isobutyronitrile), 1,1'-azobis(cyclohexane-1-carbonitrile), and 2,2'-azobis(4-methoxy-2,4-dimethylvaleronitrile); and peroxide polymerization initiators such as benzoyl peroxide, methyl ethyl ketone peroxide, isopropyl peroxycarbonate, cumene hydroperoxide, 2,4-dichlorobenzoyl peroxide, lauroyl peroxide and dicumyl peroxide.

The core material of the capsulated toner in the present invention contains a coloring agent, which may be selected from all of dyes and pigments used as coloring agents for conventional toners. Examples of the coloring agent includes many kinds of carbon blacks prepared by a method selected from the group consisting of acetylene black method, thermal black method, channel black method and lamp black method; a grafted carbon black whose surface is covered with a resin; Brilliant First Scarlet, Phtalocyanin Blue, nigrosine dyes, Pigment Green B, Rhodamine B Base, Permanent Brown FG, Solvent Red 49 and a mixture thereof.

An electrostatic preventing agent may be incorporated into the core material of the present invention. Examples of the negatively charging-electrostatic preventing agent, which do not intend to make any limitation, include AIZEN-SPIRON BLACK TRH available from Hodogaya Chemical Ltd., metal alloy azo dyes such as BONTORON S-31, BONTRON S-32, BONTRON S-34, BARIFIRST BLACK 3804 which are available from Orient Chemical Ltd., quaternary ammonium salts such as COPY CHARGE NX P434 available from Hoechst Ltd., copper phthalocyanine dyes of nitroimidazole derivative, metal complexes of alkyl salicylate derivative such as BONTRON E-81, BONTRON E-82 and BONTRON E-85 which are available from Orient chemical Ltd.

Examples of a positively charging-electrostatic preventing agent, which do not intend to make any limitation as mentioned above on the negatively charging electrostatic preventing agent, include Nigrosine dyes such as OIL BLACK BS, BONTRON N-01, BONTRON N-07, BONTRON N-11, NIGROSINE BASE E and OIL BLACK SO which are available from Orient Chemical Ltd., triphenylmethane dyes containing tertiary amine as a side chain, quaternary ammonium salt compounds such as BONTRON P-51 available from Orient Chemical Ltd., cetyltrimethyl ammonium bromide, COPY CHARGE PX VP435 available from Hoechst Ltd., polyamine resin such as AFP-B available from Orient chemical Ltd. and imidazole derivatives.

If necessary, one or more offset preventing agents may be incorporated into the core material of the present invention for the purpose of improving an offset resistance. Examples of the offset preventing agents include, for example, polyolefins, metal salts of fatty acid, higher fatty acids, fatty acid esters, partially saponified fatty acid esters, higher alcohols, araffin waxes, silicon oils, amide waxes, silicone varnishes, polyhydric alcohols and aliphatic fluorocarbons.

Examples of the polyolefins include, resins such as polypropylene, plyethylene and polybutene. Examples of the metal salt of fatty acid include zinc, magnesium or calcium metal salt of maleic acid; zinc, cadmium, barium, lead, iron, nickel, cobalt, copper or aluminum metal salt of stearic acid; dibasic lead stearate; zinc, magnesium, iron, cobalt, copper, lead or calcium metal salt of oleic acid; aluminum or calcium metal salt of palmitic acid; a salt of caprylic acid; lead caproate; zinc or cobalt metal salt of linolic acid; calcium ricinoleate; zinc or cadmium metal salt of ricinolic acid and a mixture thereof.

Examples of the fatty acid esters include ethyl maleate, butyl maleate, methyl stearate, butyl stearate, cetyl palmitate and ethylene glycol ester of montanic acid. Examples of the partially saponified montanic acid include a montanic acid ester partially saponified with calcium. Examples of the higher fatty acids include dodecanoic acid, lauric acid, myristic acid, palmitic acid, stearic acid, oleic acid, linolic acid, ricinolic acid, arachic acid, behenic acid, lignoceric acid, selacholeic acid, and mixtres thereof. Examples of the higher alcohols include dodecyl alchohole, lauryl alcohol, myristyl alcohol, palmityl alcohol and stearyl alcohol. Examples of the paraffin waxes include natural parafins, microwax, synthetic parafin and chlorinated hydrocarbon. Examples of the amide waxes include stearic acid amide, oleic acid amide, palmitic acid amide, lauric acid amide, behenic acid amide, methylenebis stearamide, ethylenebisstearamide, N,N'-m-xylylenebis(stearic acid amide), N,N'-m-xylylenebis(12-hydroxystearic acid amide), N,N'-isophthalic acid bisstearylamide and N,N'-isophthalic acid-bis(12-hydroxystearylamide). Examples of the polyhydric alcohol esters include glycerin stearate, glycerin ricinoleate, glycerin monobehenate, sorbitan monostearate, propylene glycol monostearate and sorbitan trioleate. Examples of the silicone varinishes include methyl silicone varnish and phenyl silicone varnish. Examples of the aliphatic fluorocarbons include low molecular weight compounds of ethylene tetrafluoride or propylene hexafluoride.

In the production of the toner of the present invention, at least the polymerizable monomer for producing the core resin, the polymerization initiator and the coloring agent, which are listed above, are blended to form a mixture. If necessary, a crosslinking agent, a wax and an electrostatic preventing agent may be added to the mixture. The mixture is dispersed into a dispersion medium and then the polymerizable monomer is polymerized to form a particle of the core.

Examples of dispersion medium include water, methanol, ethanol, propanol, butanol, ethyleneglycol, glycerol, acetonitrile, acetone, isopropylene ether, tetrahydrofuran and dioxane. These dispersion media may be used alone or in combiantion. A dispersion stabilizer may be used for the purpose of obtaining stabilization of dissolved substance in a dispersion medium. In the present invention, all of the known dispersion stabilizers may be used. Examples of the dispersion stabilizers include polyvinyl alcohol, polystyrene sulfonate, hydroxymethyl cellulose, hydroxyethyl cellulose, hydroxypropyl cellulose, sodium carboxymethyl cellulose, sodium polyacrylate, sodium dodecylbenzen sulfonate, sodium tetradecyl sulfate, sodium pentadecyl sulfate, sodium octyl sulfate, sodium allyl-alkyl-polyether sulfonate, sodium oleate, sodium caprylate, sodium caproate, potassium stearate, calcium oleate, sodium 3,3-disulfonediphenyl urea-4,4-diazo-bis-amino-β-nawatol-6-sulfonate, orthocarboxybenzen-azo-dimethyl aniline, sodium 2,2,5,5-tetramethyl-triphenylmethane-4,4-diazo-bis-β-naphthol-disulfonate, tricalcium phosphate, ferric hydroxide, titanium hydroxide and aluminum hydroxide. These dispersion stabilizers may be used alone or in combination.

The suspension thus obtained is kept at a temperature of 50 to 70° C. with stirring to continue or complete the polymerization of polymerizable monomer therein.

During or after completing the polymerization, the second polymerizable monomer is added to the suspension of the first polymer to conduct the seed polymerization. That is, by the first polymerization, the suspension comprising particles of thermoplastic resin containing a coloring agent (referred to as "intermediate particle" herein), which is partially or completely polymerized, is prepared. At least vinyl polymerizable monomer and vinyl polymerization initiator is added to the suspension, and after the vinyl polymerizable monomer is absorbed by the intermediate particles, it is polymerized therein. The vinyl polymerizable monomer which can be absorbed by the intermediate particles may be directly added or may be added in the form of suspension to the suspension. The added suspension of the vinyl polymerizable monomer is the suspension in which a vinyl polymerizable monomer and a vinyl polymerization initiator are emulsified and dispersed together with an emulsion stabilizer in water. If necessary, a crosslinking agent, an offset preventing agent and an electrostatic preventing agent may be added thereto.

The shell material of the present invention may be prepared by using the same vinyl polymerization initiator, crosslingking agent and dispersion stabilizer as those used in the production of the intermediate particle. If necessary, polymerization conditions of the resin for forming the shell can be optimized by using a water-soluble polymerization initiator.

By adding the vinyl polymerizable monomer or the aqueous emulsion thereof, the monomer covers the intermediate particle and then somewhat enlarges it. The polymerization of polymerizable monomer for forming the shell resin starts and continues in the enlarged state. Namely, the capsulated toner was produced by seed polymerization using the intermediate particle as a core particle.

A toner according to this embodiment includes a core that includes a core material as the main component; a shell that includes a shell material as the main component; and a component changing portion that is formed between the core and shell and that includes both the core material and the shell material, wherein the core material in the component changing portion gradually reduces in the direction from the core to the shell, and the shell material in the component changing portion gradually reduces in the direction from the shell to the core.

In particular, the component changing portion is characterized in that the portion is produced by the seed polymerization, as described above, which commences the polymerization of the shell material prior to completion of the polymerization of the core material. In the component changing portion, the concentration of the core material gradually decreases in the direction from the core to the shell, while the shell material gradually decreases in the direction from the shell to the core. In other words, a part of the component changing portion closest to the core includes the core material at its maximum concentration and the shell material at its minimum concentration. In contrast, another part thereof closest to the shell includes the shell material at its maximum concentration and the core material at its minimum concentration.

According to the process of the present invention explained above, there is provided a capsulated toner having a sufficient fixation with a low energy and an excellent blocking resistance under a high pressure at a high temperature. That is, the present invention provides a capsulated toner having a high balance of the fixation at a low temperature and an offset resistance.

In the present invention, although there is not any particular limitation regarding a particle diameter of the capsulated toner, it is preferable that the average particle diameter usually ranges from 3 to 30 m $\mu$.

The capsulated toner of the present invention may include a flow improver and a cleaning improver, if necessary. Examples of the flow improver include silica, alumina, titanium oxide, barium titanate, magnesium titanate, calcium titanate, strontium titanate, zinc oxide, quartz sand, clay, mica, wollastonite, diatomaceous earth, chromium oxide, cerium oxide, iron oxide red, antimony trioxide, magnesium oxide, zirconium oxide, barium sulfate, barium carbonate, calcium carbonate, silicon carbide and silicon nitride.

The fine powder of silica is a fine powder of a compound having a Si—O—Si bond and may be produced by any of dry and wet processes. The fine powder of silica may comprise anhydrous silicon dioxide or any other silica such as aluminum silicate, sodium silicate, potassium silicate, magnesium silicate and zinc silicate. In addition, the fine powder of silica may have a surface treated with a silane coupling agent, a titanium coupling agent, a silicone oil, a silicone oil having an amino group on its side chain.

Examples of the cleaning improver include fine powders of a metal salt of a higher fatty acid represented by zinc stearate, and a flulropolymer. In addition, the capsulated toner may include an additive for regulating developability, such as fine powders of a polymer such as methyl methacrylate and butyl methacrylate.

Where the heat pressure-fixable capsulated toner of the present invention includes a fine powder of a magnetic substance, it can be used by itself as a developing agent. Where the capsulate toner does not include the fine powder of the magnetic substance, it may be used as a nonmagnetic-element developing agent or it may be used by mixing with a carrier to prepare a binary developing agent. Although there is not any particular limitation regarding a carrier, examples of the carrier include an iron powder, ferrite and glass beads, the same materials coated with a resin, and a resin carrier produced by mixing a fine powder of magnetite or ferrite with a resin. A mixing ratio of the toner to the carrier is from 0.5 to 20 parts by weight. A particle diameter of the carrier may be 15 to 500 $\mu$m.

As previously mentioned, where a polymerizable monomer of the shell material starts after starting and before completing the polymerization of a polymerizable monomer of the core material, there is obtained a good effect that the shell is strongly fixed to the core at their boundary and therefore the shell which is thin and mechanically fragile is strengthened. In addition, the present invention further provides an extra effect that a process time from starting the polymerization of polymerizable monomer in a core material to finishing the polymerization of polymerizable monomer in a shell material is shortened. Where the polymerization of polymerizable monomer in the shell material is started after completing the polymerization of polymerizable monomer in the core material, it is preferable to start the polymerization of polymerizable monomer in the shell material after a surface of the core absorbs the polymerizable monomer in the shell material to enlarge. If the polymerization of polymerizable monomer in the shell material is started before the polymerization of polymerizable monomer in the core material is not conducted sufficiently, a boundary of the core and the shell becomes unclear and the blocking resistance requested in the shell would become insufficient. In this case, it is preferable to start the polymerization of the polymerizable monomer in the shell material (referred to as "the polymerization in the shell material" hereinbelow) after completing 90% of the polymerization of the polymerizable monomer on a surface of the core. In the present specification, a completing ratio of the polymerization is calculated by weight of the resin after the complete polymerization of polymerizable monomer and the polymerized resin at the time of measuring. The present invention is applicable to the control of polymerization in layers adjacent to each other where two or more shell layers are composed around the core. Since the core surrounded by outer layer of the shell can be regarded as an intermediate particle, the shell-forming process mentioned above can be applicable to this case.

<Embodiment 2>

In order to solve the problems in the conventional technology, the present invention provides a heat pressure-fixable toner comprising at least thermoplastic resin and a coloring agent as an integrant, wherein two or more resins having different Tgs, which are formed with polymerizable monomers, are used in a shell of the toner and a Tg of the resin of outermost layer of the shell is 70° C. or more. That is, there is provided a heat pressure-fixable toner having good fixation at a low temperature, high blocking resistance and high endurance enough to prevent a change of shape of the toner caused by mechanical stress in a developing apparatus, and can stably provide a clear image without a fog in background for a long time.

The toner in accordance with the present invention comprises of a core material containing at least thermoplastic resin and a coloring agent, and a shell material covering a surface of the core. The toner has the following characteristics.

1. The toner is made of at least a coloring agent and a thermoplastic resin, and is produced by process using two or more polymerizable monomers capable of forming a thermoplastic resin.
2. A Tg of the resin forming an outermost layer of the shell of the toner ranges from 70 to 100° C.
3. In this case, it is preferable that a Tg of the resin of the core ranges from 50 to 70° C.

A method for the production of the capsulated toner of the present invention will be explained hereinbelow.

In embodiment 2, the resins for forming the core material and the shell material are the same as those used in embodiment 1.

At first, at least a polymerizable monomer for producing a core resin, a polymerization initiator and a coloring agent are mixed, and if necessary, a crosslinking agent, a wax and an electrostatic preventing agent may be added thereto and mixed.

The mixture thus obtained is dispersed into a dispersion medium and then the polymerizable monomer is polymerized to form a particle of the core. The dispersion media herein is the same as those used in embodiment 1.

The suspension thus obtained is kept at a temperature of 50° C. to 70° C. with stirring to continue or complete the polymerizable monomer in the core material.

During the polymerization or after completing the one, the second polymerizable monomer is added to the suspension of the first polymer to conduct a seed polymerization. That is, by the first polymerization, the suspension comprising particles of thermoplastic resin containing a coloring agent (referred to as "intermediate particle" herein), which is partially or completely polymerized, are prepared. At least a vinyl polymerizable monomer and a vinyl polymerization initiator are added to the suspension, and after the vinyl polymerizable monomer is absorbed by the intermediate particle, the monomer is polymerized therein. The vinyl polymerizable monomer which is absorbed by the intermediate particle may be directly added or may be added in the form of aqueous suspension to the suspension. The added aqueous suspension of the vinyl polymerizable monomer is the suspension in which a vinyl polymerizable monomer and a vinyl polymerization initiator are emulsified and dispersed together with an emulsion stabilizer in water. If necessary, a crosslinking agent, an offset preventing agent and an electrostatic preventing agent may be added thereto.

It is preferable that the polymerizable monomer used in embodiment 2 is selected so as to make a Tg of the resin 70° C. or more. That is, it is preferable that the resin of outermost layer of the shell has a Tg of 70° C. or more. Taking a fixation at a low temperature into consideration, it is desired that a Tg of the resin in the core material ranges from 50 to 70° C. Where the outermost layer of the shell surrounding an intermediate particle comprises a resin having a Tg of 70° C. or more, the toner effectively attains a blocking resistance.

A vinyl polymerization initiator, a crosslinking agent and a dispersion stabilizer used in a seeding polymerization may be the same as those used in the production of intermediate particle. If necessary, polymerization conditions of the resin for forming the shell can be optimized by using a water-soluble polymerization initiator.

By adding a vinyl polymerizable monomer or an aqueous emulsion thereof, the monomer covers the intermediate particle and then somewhat enlarges it. The polymerization of the polymerizable monomer for forming the shell resin starts and continues in the enlarged state. Namely, the capsulated toner was produced by seed polymerization using the intermediate particle as a core particle.

According to the process of embodiment 2, there is provided a capsulated toner having a sufficient fixation with a low energy and an excellent blocking resistance under a high pressure at a high temperature. That is, there is provided a capsulated toner having a high balance of the fixation at a low temperature and an offset resistance.

In this embodiment, a particle diameter of the capsulated toner, use of a flow improver and a cleaning improver, and addition of a magnetic fine particle are optional. Examples thereof are the same as those employed in embodiment 1.

<Embodiment 3>

In this embodiment, there is provided a heat pressure-fixable toner comprising at least a thermoplastic resin and a coloring agent as an integrant, wherein the toner is produced by using two or more polymerizable monomers which can form the resins having different Tgs and wherein an outermost layer of the shell contains 0.1 to 4 part by weight of the resin. According to this embodiment, there is provided a heat pressure-fixable toner having a good fixation at a low temperature, a high blocking resistance and a high endurance enough to prevent a change of shape of the toner caused by mechanical stress in a developing apparatus, and can stably provide a clear image without a fog in background for a long time.

The toner according to this embodiment comprises of a core material containing at least a thermoplastic resin and a coloring agent, and a shell material covering a surface of the core. The toner has the following characteristics.

1. The toner is made of at least a coloring agent and thermoplastic resins, and is produced by using two or more polymerizable monomers capable of forming a thermoplastic resin.
2. A total amount of the shell material forming an outermost layer of the shell ranges from 0.1 to 0.4 part by weight based on a total weight of said core material and shell material.

A method for the production of the capsulated toner in embodiment 3 will be explained hereinbelow.

In embodiment 3, the resins for forming the core material and the shell material are the same as those used in embodiment 1.

At first, at least a polymerizable monomer for producing a core resin, a polymerization initiator and a coloring agent are mixed, and if necessary, a crosslinking agent, a wax and an electrostatic preventing agent may be added thereto and mixed.

The mixture thus obtained is dispersed into a dispersion medium and then the monomer in the mixture is polymerized to form a particle of the core. The dispersion media used herein are the same as those used in embodiment 1.

The suspension thus obtained is kept at a temperature of 50° C. to 100° C. with stirring to continue or complete the polymerization of the polymerizable monomer of the core material.

During the polymerization or after completing it, the second polymerizable monomer is added to the suspension of the first polymer to conduct a seed polymerization. That is, by the first polymerization, the suspension comprising particles of thermoplastic resin containing a coloring agent (referred to as "intermediate particle" herein), which is partially or completely polymerized, is prepared. At least a vinyl polymerizable monomer and a vinyl polymerization initiator are added to the suspension, and after the vinyl polymerizable monomer is absorbed by the intermediate particle, the monomer is polymerized therein. The vinyl polymerizable monomer which is absorbed by the intermediate particle may be directly added or may be added in the form of aqueous suspension to the suspension. The added aqueous suspension of the vinyl polymerizable monomer is a suspension in which a vinyl polymerizable monomer and a vinyl polymerization initiator are emulsified and dispersed together with an emulsion stabilizer in water. If necessary, a crosslinking agent, an offset preventing agent and an electrostatic preventing agent may be added thereto.

A vinyl polymerization initiator, a crosslinking agent and a dispersion stabilizer used in a seeding polymerization may be the same as those used in the production of intermediate particle. If necessary, polymerization conditions of resin for forming the shell can be optimized by using a water-soluble polymerization initiator.

By adding a vinyl polymerizable monomer or an aqueous emulsion thereof, the monomer covers the intermediate particle and then somewhat enlarges it. The polymerization of the polymerizable monomer for forming the shell resin starts and continues in the enlarged state. Namely, the capsulated toner was produced by seed polymerization using the intermediate particle as a core particle.

An amount of the polymerizable monomer for forming the shell resin ranges from 0.1 to 4 part by weight based on a weight of the polymerizable monomer for forming the core resin.

Where the amount of the polymerizable monomer is less than 0.1 part by weight and the core includes the resin having a comparatively low Tg to attain a good fixation, it become difficult to attain a good blocking resistance, because the surface of the core particle cannot be fully covered with the shell.

Where an amount of the resin in the shell material is more than 4 parts by weight, the fixation of the toner becomes poor. In addition, a thick layer of the shell is formed to make a large space between the surface of the core particle including an electrostatic preventing agent and the outer layer of the shell. The thick layer makes it difficult to transfer an electrical charge generated by frictional electrification, and causes an insufficient electrical charge.

As a result, the image formed by the toner tends to have a fog in background and quality of the printing formed by the toner tends to lower.

In the embodiment, although there is not any particular limitation regarding the particle diameter of the capsulated toner, it is preferable that the average particle diameter of the capsulated toner usually ranges from 3 to 30 mμ.

In this embodiment, the particle diameter of the capsulated toner, use of a flow improver and a cleaning improver, and addition of a magnetic fine particle are optional. Examples thereof are the same as those employed in embodiment 1.

According to the process of embodiment 3, there is provided a capsulated toner having a sufficient fixation with a low energy and an excellent blocking resistance under a high pressure at a high temperature. That is, there is provided a capsulated toner having a high balance of the fixation at a low temperature and an offset resistance.

In the formation of the shell of the capsulated toner, since a polymerization initiator is used in the amount larger than that usual in a conventional technique to conduct a shell forming reaction quickly, the core material and the shell material cannot be compatible to melt each other. Accordingly, since the core and the shell are ideally separated to have their functions respectively, there is provided a toner having a high balance of a fixation at a low temperature and a blocking resistance.

<Embodiment 4>

In the process according to embodiment 3, the core material is kept in the form of suspension in dispersion medium during or after completing the polymerization of the polymerizable monomer for forming the core material, and then a polymerizable monomer for forming the shell and a polymerization initiator are added thereto. And then, the shell is formed by having the polymerizable monomer including a polymerization initiator absorbed on the surface of the core.

In this embodiment, the capsulated toner produced by the process mentioned above is further improved in a fixation at a low temperature, a blocking resistance and an endurance.

Since it takes a comparatively long time to complete the polymerization for forming the shell by seeding polymerization, the core resin and the shell resin tend to compatibly melt to make a boundary between them unclear. In this situation, although the shell of the present invention is formed to increase a blocking resistance, the shell becomes similar to the core in property. As a result, it is difficult to increase a blocking resistance. Coincidentally, since the shell resin which is difficult to heat-melt transfers to the core, the fixation of the toner tends to decrease.

In this embodiment, there is provided a heat pressure-fixable toner comprising at least a thermoplastic resin and a coloring agent as an integrant, wherein the toner is produced by using two or more polymerizable monomers which can form the resins having different Tgs and wherein an amount of the polymerization initiator used in the polymerization of the resin for forming an outermost layer of the shell ranges from 4 to 15 parts by weight based on a total weight of the resin for forming the outer layer of the shell. It has been found that the features mentioned above enable to provide a heat pressure-fixable toner having a good fixation at a low temperature, a high blocking resistance and a high endurance enough to prevent a change of shape of the toner caused by mechanical stress in a developing apparatus, and the toner can stably provide a clear image without a fog in background for a long time. As a result, this embodiment is accomplished.

The toner according to this embodiment comprises of a core material containing at least a thermoplastic resin and a coloring agent, and a shell material covering a surface of the core. The toner has the following characteristics.

1. The toner is made of at least a coloring agent and a thermoplastic resin, and is produced by using two or more polymerizable monomers capable of forming a thermoplastic resin.
2. An amount of the polymerization initiator used in the polymerization of the resin for forming an outermost layer of the shell ranges from 4 to 15 parts by weight based on a total weight of the resin for forming an outermost layer of the shell.

A method for the production of the capsulated toner in embodiment 4 will be explained hereinbelow.

In embodiment 4, the resins for forming the core material and the shell material in the toner are the same as those used in embodiment 1.

At first, at least a polymerizable monomer for producing a core resin, a polymerization initiator and a coloring agent are mixed, and if necessary, a crosslinking agent, a wax and an electrostatic preventing agent may be added thereto and mixed.

The mixture thus obtained is dispersed into a dispersion medium and then the monomer in the mixture is polymerized to form a particle of the core. The dispersion media used herein are the same as those used in embodiment 1.

The suspension thus obtained is kept at a temperature of 50° C. to 100° C. with stirring to continue or complete the polymerization of the polymerizable monomer in the suspension.

During the polymerization or after completing it, the second polymerizable monomer is added to the suspension to conduct a seed polymerization. That is, by the first polymerization, the suspension comprising particles of thermoplastic resin containing a coloring agent (referred to as "intermediate particle" herein), which is partially or completely polymerized, is prepared. At least a vinyl polymerizable monomer and a vinyl polymerization initiator are added to the suspension, and after the vinyl polymerizable monomer is absorbed by the intermediate particle, the monomer is polymerized therein. The vinyl polymerizable monomer which is absorbed by the intermediate particle may be directly added or may be added in the form of aqueous suspension to the suspension. The added aqueous suspension of the vinyl polymerizable monomer is the suspension in which a vinyl polymerizable monomer and a vinyl polymerization initiator are emulsified and dispersed together with an emulsion stabilizer in water. If necessary, a crosslinking agent, an offset preventing agent and an electrostatic preventing agent may be added thereto.

A vinyl polymerization initiator, a crosslinking agent and a dispersion stabilizer used in the seeding polymerization may be the same as those used in the production of intermediate particle. If necessary, the polymerization conditions of the resin for forming the shell can be optimized by using a water-soluble polymerization initiator. It is preferable that an amount of the polymerization initiator in the seeding polymerization ranges from 4 to 15 parts by weight based on a weight of the vinyl polymerizable monomer as mentioned herein. Where an amount of the polymerization initiator is more than 15 parts by weight, a lot of decomposition products of the polymerization initiator remain on a surface of the resultant toner and therefore the decomposition products decrease an electric charge property of the toner.

On the contrary, where an amount of the polymerization initiator is less than 4 parts by weight, the shell of the capsulated toner is formed slowly. As a result, the core material and the shell material tend to be compatible at their boundary, and the core and the shell cannot be separated enough to have their function individually. Where a vinyl polymerizable monomer or an aqueous emulsion thereof is added, the monomer covers a surface of the intermediate particle, which is somewhat enlarged by the monomer. As a result, where the polymerization of the shell proceeds slowly, the boundary of the core and the shell becomes unclear, and the core and the shell cannot be separated enough to have their function individually. In this case, it is difficult to obtain a sufficient effect of the capsulated toner.

It is desired that an amount of the aqueous emulsion is determined depending on a Tg of the core resin. Where the Tg of the core resin is high, the blocking resistance to be requested can be accomplished using a small amount of the aqueous emulsion. To the contrary, where the Tg of the core resin is low, it is necessary to add the aqueous emulsion in a large amount.

As mentioned in this embodiment, where an amount of the polymerization initiator used in a seeding polymerization ranges from 4 to 15 parts by weight based on a vinyl polymerizable monomer, there is provided a new capsulated toner more excellent than the toners conventionally proposed in a fixation at a low temperature and a stability in preservation.

In this embodiment, although there is not any particular limitation regarding a particle diameter of the capsulated toner, it is preferable that the average particle diameter usually ranges from 3 to 30 mμ.

In this embodiment, a particle diameter of the capsulated toner, use of a flow improver and a cleaning improver, and addition of a magnetic fine particle are optional. Examples thereof are the same as those employed in embodiment 1.

<Embodiment 5>

In the case that a resin for forming the core and a resin for forming the shell are somewhat compatible and therefore a boundary between them becomes unclear, advantageous properties of both resins decrease, because the core resin having a disadvantage in a blocking resistance is mixed with the shell resin having a disadvantage in a fixation at a low temperature at the boundary.

According to the present embodiment, there is provided a toner which can be practically used under a high pressure in a contact developing system.

Further there is provided a pressure-fixable toner useful for a heat pressure fixation system using, for example, a heat roller, which is excellent in an offset resistance, a fixation at a low temperature, a blocking resistance and an endurance in long time operation.

In this embodiment, there is provided a heat pressure-fixable toner comprising at least a thermoplastic resin and a coloring agent as an integrant. At first, at least one polymerizable monomer is completely polymerized, then the resultant polymer is mixed with another polymerizable monomer containing a coloring agent and the resultant mixture is dispersed in a dispersion medium to polymerize the monomers. According to this process, there is provided a heat pressure-fixable toner having a good fixation at a low temperature, a high blocking resistance and a high endurance enough to prevent a change of shape of the toner caused by mechanical stress in a developing apparatus, and the toner can stably provide a clear image without a fog in background for a long time.

The toner of this embodiment is produced by mixing at least one polymerizable monomer, which is pre-polymerized, with another polymerizable monomer containing a coloring agent, dispersing the resultant mixture in a dispersion medium and polymerizing the monomer therein. The heat pressure-fixable toner has the following characteristics.

1. At least one polymerizable monomer is pre-polymerized alone.
2. The pre-polymerized polymerizable monomer (thermoplastic resin) is mixed with another polymerizable monomer containing a coloring agent, the resultant mixture is dispersed in a dispersion medium and then the monomers are polymerized.

A process for the production of the capsulated toner in this embodiment will be explained below.

The resins for producing the core and the shell in the capsulated toner of this embodiment are the same as those used in embodiment 1.

At first, at least a polymerizable monomer for producing a core resin, a polymerization initiator and a coloring agent are mixed, and if necessary, a crosslinking agent, a wax and an electrostatic preventing agent may be added thereto and mixed.

The mixture thus obtained is mixed with the resin for forming the shell which is pre-polymerized, dispersed into a dispersion medium and then the polymerizable monomer in the mixture is polymerized. Consequently, a capsulated toner sought to be obtained is formed.

By dispersing these materials in a dispersion medium, the polymerizable monomer is polymerized to form the resin of the core material in the form of a sphere, and the resin for forming the shell gathers on a surface of the core material and then solidify. Where the dispersion medium is a water and the resin for forming the shell has a hydrophilic group, a lipophilic core material is formed in the form of particle and then the resin for forming the shell surrounds a surface of the core material to proceed the polymerization.

The toner thus obtained can maintain the original property of the shell material since the resin of the shell material is pre-polymerized to decrease a compatibility of the core material.

Where the toner having the shell with more than one layer is repared, the polymerizable monomer for forming a layer of the shell directly surrounding the core may be pre-polymerized as mentioned above.

The dispersion medium used in embodiment 1 is employed in this embodiment.

In addition, by using the polymerizable monomers disclosed in embodiment 1 alone or in combination, the resins of the core and the shell can be produced.

It is preferable to design the shell material so as to have a Tg higher than that of the core material. For example, a mixing ratio of a styrene or a styrene derivative in the resin forming the shell material is larger than that in the resin forming the core material. In other words, it is effective to decrease a ratio of an ethylenically monocarbonic acid or an ester thereof. Further it is also effective to use an ethylenically monocarbonic acid or an ester thereof alone or in combination.

The suspension thus obtained is kept at a temperature of 50° C. to 100° C. with stirring to continue or complete the polymerization of the polymerizable monomer therein.

In this embodiment, although there is not any particular limitation regarding the particle diameter of the capsulated toner, it is preferable that an average particle diameter of the capsulated toner usually ranges from 3 to 30 mμ.

In this embodiment, the particle diameter of the capsulated toner, use of a flow improver and a cleaning improver, and addition of a magnetic fine particle are optional. Examples thereof are the same as those employed in embodiment 1.

<Embodiment 6>

In this embodiment, there is provided a heat pressure-fixable toner comprising at least a thermoplastic resin and a coloring agent as an integrant, wherein the toner is produced by using three or more polymerizable monomers which can form resins having different Tgs and wherein the resin used in at least one inner layer other than an innermost layer and an outermost layer is a resin which is formed by additionally polymerizing a resin formed by pre-polymerizing a polymerizable monomer. By taking this step, there is provided a heat pressure-fixable toner having a good fixation at a low temperature, a high blocking resistance and a high endurance enough to prevent a change of shape of the toner caused by mechanical stress in a developing apparatus, and the toner can stably provide a clear image without a fog in background for a long time.

In this embodiment, the toner comprises a core material containing at least a thermoplastic resin and a coloring agent, the first shell material covering a surface of the core material and the second shell material covering a surface of the first shell material. The heat pressure-fixable toner according to this embodiment has the following features.

1. The toner is made of at least a coloring agent and a thermoplastic resin and is produced by process using three or more polymerizable monomers capable of forming a thermoplastic resin.
2. The resin used in at least one inner layer other than an innermost layer and an outermost layer is a resin which is formed by additionally polymerizing a resin formed by pre-polymerizing a polymerizable monomer.

A process for the production of the capsulated toner of this embodiment will be explained below.

The toner comprises the same resins used in a core material and a shell material as those of embodiment 1.

At first, at least a polymerizable monomer for producing a core resin, a polymerization initiator and a coloring agent are mixed, and if necessary, a crosslinking agent, a wax and an electrostatic preventing agent may be added thereto and mixed.

The mixture thus obtained is dispersed in a dispersion medium and then the polymerizable monomer is polymerized to form a particle of the core.

The dispersion medium herein is the same as those used in embodiment 1.

The suspension thus obtained is kept at a temperature of 50° C. to 100° C. with stirring to continue or complete the polymerizable monomer in the core material.

Thus, a toner according to this embodiment has in addition to the components of the first embodiment an outer shell that covers the shell and that includes an outer shell material as the main component, and a shell component changing portion between the shell and the outer shell, wherein the shell component changing portion includes the shell material and an outer shell material, and wherein the shell material in the shell component changing portion gradually decreases in the direction from the shell to the outer shell and the outer shell material in the shell component changing portion gradually decreases in the direction from the outer shell to the shell. The outer shell of the toner is produced through third polymerization of the outer shell material, and the shell component changing portion is produced through commencement of the third polymerization prior to the completion of the second (seed) polymerization.

During or after completing the polymerization, the second polymerizable monomer is added to the suspension of the first monomer to conduct a seeding polymerization. That is, by the first polymerization, the suspension comprising particles of thermoplastic resin containing a coloring agent (referred to as "intermediate particle" herein), which is partially or completely polymerized, is prepared. At least a vinyl polymerizable monomer and a vinyl polymerization initiator are added to the suspension, and after the vinyl polymerizable monomer is absorbed by the intermediate particles, the polymerizable monomer in the intermediate particle is polymerized. The vinyl polymerizable monomer which can be absorbed by the intermediate particles may be directly added or may be added in the form of suspension to the suspension. The added suspension of the vinyl polymerizable monomer is a suspension in which a vinyl polymerizable monomer and a vinyl polymerization initiator are emulsified and dispersed together with an emulsion stabilizer in water. If necessary, a crosslinking agent, an offset preventing agent and an electrostatic preventing agent may be added thereto.

A vinyl polymerization initiator, a crosslinking agent and a dispersion stabilizer used in a seeding polymerization may be the same as those used in the production of the intermediate particle. If necessary, polymerization conditions of the resin for forming the shell can be optimized by using a water-soluble polymerization initiator. By adding a vinyl polymerizable monomer or an aqueous emulsion thereof, the monomer covers the intermediate particle and then somewhat enlarges it. The polymerization of polymerizable monomer for forming the shell resin starts and continues in the enlarged state. Namely, the capsulated toner was produced by seed polymerization using the intermediate particle as a core particle.

As mentioned above, this embodiment provides a capsulated toner having a two-layered shell formed by a combination of an in situ polymerization and a seeding polymerization, as mentioned above, wherein the resin used in at least one inner layer located between the core and an outermost layer of the shell is a resin which is formed by additionally polymerizing a resin formed by pre-polymerizing a polymerizable monomer. By taking this step, there is provided a capsulated toner having a low compatible inner layer between the core and the outermost layer of the shell, which is superior to conventional toners having a single layered shell in a good fixation at a low temperature and a stability in preservation.

Since the process for the production of the toner in this embodiment provides a two-layered shell and an inter mediate layer between the core and the outermost layer of the shell can act as a partition, the core is effectively separated from the shell to keep their function individually. As a result, the toner has a good fixation at a low temperature and an offset resistance.

A pre-polymerized resin for covering a surface of the core may be mixed with at least a polymerizable monomer for forming the core, an polymerization initiator and a coloring agent at the step of an in situ polymerization. There will be further explained this step in working examples.

That is, examples of the materials to be added and mixed may include all of monomers for forming the core material and the shell material as disclosed above and polymers thereof.

The mixture is dispersed in a dispersion medium and then the polymerizable monomer is polymerized to form a particle of the core.

As previously disclosed, where a shell material of the inner layer located between an outermost layer of the shell and an intermediate particle comprises a thermoplastic resin which is prepared by additionally polymerizing a resin prepared by pre-polymerizing a polymerizable monomer before the polymerization of a polymerizable monomer for forming the core material, since the intermediate particle is separated from the outermost layer of the shell, the compatibility between the resins of the outermost layer of the shell and the core material is decreased and properties of the outermost layer of the shell is enhanced.

In this embodiment, although there is not any particular limitation regarding the particle diameter of the capsulated toner, it is preferable that an average particle diameter of the capsulated toner usually ranges from 3 to 30 m$\mu$.

In this embodiment, the particle diameter of the capsulated toner, use of a flow improver and a cleaning improver, and addition of a magnetic fine particle are optional. Examples thereof are the same as those employed in embodiment 1.

<Embodiment 7>

As previously explained, there is applied to a process using an in situ polymerization the characteristic that a shell forming material gathers on a surface of droplet in high concentration, where a mixture of a core forming material and the shell forming material is dispersed in a dispersion medium. That is, since the core forming material is separated from the shell forming material in the droplet of the mixture due to the difference of solubility parameters between them, a capsulated structure of toner can be formed in the separated form by the polymerization thereof.

However it is difficult to form a thick shell by this process because there is a little difference of the solubility parameters between both the material. That is, a thickness of the shell of the capsulated toner is limited because, where a lot of the shell forming resin is mixed with a polymerizable monomer of the core material, they cause a complete phase separation. Consequently, it is difficult to form the shell having a large thickness on the core which is fixable at a low temperature and easily melt.

In the other process for the production of a capsulated toner, which has been explained in the other embodiment, a completely polymerized resin of the core is kept in a dispersion medium in the form of the suspension, and then a polymerizable monomer for forming a shell and a polymerization initiator are added thereto. Alternatively, a polymerizable monomer including a polymerization initiator is absorbed on a surface of the core to form the shell.

However the process takes a comparatively long time to conduct the polymerization so as to form a shell having a sufficient thickness.

In this embodiment, there is provided a heat pressure-fixable toner comprising at least a thermoplastic resin and a coloring agent as an integrant, wherein the toner is produced by using three or more polymerizable monomers which can form resins having different Tgs and wherein the Tg of polymer having the highest Tg is 5° C. higher or more than that of polymer having the second highest Tg. By taking this step, there is provided a heat pressure-fixable toner having a good fixation at a low temperature, a high blocking resistance and a high endurance enough to prevent a change of shape of the toner caused by mechanical stress in a developing apparatus, and the toner can stably provide a clear image without a fog in background for a long time.

The toner of this embodiment comprises a core material containing at least a thermoplastic resin and a coloring agent, the first shell material covering a surface of the core material and the second shell material covering a surface of the first shell material. The heat pressure-fixable toner according to this embodiment has the following features.

1. The toner is made of at least a coloring agent and a thermoplastic resin and is produced by process using three or more polymerizable monomers capable of forming a thermoplastic resin.
2. The temperature difference between the Tgs of polymer having the highest Tg and that of polymer having the second highest Tg is 5° C. or more.
3. At least one of the polymerizable monomers described above is started to polymerize after starting and in process of the polymerization of other polymerizable monomers, or after completing the polymerization of other polymerizable monomers.

A process for the production of the capsulated toner of this embodiment will be explained below.

R resins used in the core material and the shell material are the same as those used in embodiment 1.

At first, at least a polymerizable monomer for preparing a core resin, a polymerization initiator and a coloring agent are mixed, and if necessary, a crosslinking agent, a wax and an electrostatic preventing agent may be added thereto and mixed.

The mixture thus obtained is dispersed in a dispersion medium and then the polymerizable monomer is polymerized to form a particle of the core.

The dispersion medium used herein is the same as those used in embodiment 1.

The suspension thus obtained is kept at a temperature of 50° C. to 100° C. with stirring to continue or complete the in situ polymerization of the polymerizable monomer in the core material.

It is preferable to design the shell material so as to have a Tg higher than that of the core material. For example, a mixing ratio of a styrene or a styrene derivative in the resin forming the shell material is larger than that in the resin forming the core material. In other words, it is effective to decrease a ratio of an ethylenically monocarbonic acid or an ester thereof. Alternatively it is also effective to use an ethylenically monocarbonic acid or an ester thereof alone or in combination.

In process of, or after completing the in situ polymerization, a resin capable of covering a surface of the core resin particle is added thereto and mixed.

Although examples of the material added and mixed may include all of the monomers previously described and the polymers thereof useful in preparing the core material and the shell material, it is preferable to select the resin used in the embodiment in the manner that a Tg of a single resin distributed onto a surface of the particle is higher than that of the resin obtained by polymerization of a polymerizable monomer for forming a core material. It is preferable that the Tg of the shell resin is 5° C. higher or more than that of the core resin. This is because a blocking resistance of the toner is improved by using the resin distributed onto a surface of the particle having a Tg higher than that of the resin obtained by the polymerization of a polymerizable monomer for forming a core material. Further, where the temperature difference between the Tg of the shell resin and that of the core resin is 5° C. or more, the core material becomes incompatible with the shell material to ensure that a capsulated structure of the core is formed. To the contrary, where the temperature difference is less than 5° C., the core material becomes compatible with the shell material and therefore it tends to lower an effect of mixing the shell resin.

The term "glass-transition temperature of single resin" in this embodiment means a glass-transition temperature of the resin which is obtained by sufficiently polymerizing a single polymerizable monomer, that is, a Tg of single resin is the temperature at which the polymerization of the resin is sufficiently advanced so that the Tg will not be dependent on a degree of polymerization.

A particle of the core is formed by dispersing the mixture in a dispersion medium to polymerize.

During the in situ polymerization or after completing it, the third polymerizable monomer is added to the suspension to conduct a seeding polymerization.

That is, at least a vinyl polymerizable monomer and a vinyl polymerization initiator are added to an aqueous suspension of a thermoplastic resin particle (referred to as intermediate particle hereinbelow) including a coloring agent, during the in situ polymerization or after completing it. After the intermediate particle sufficiently absorbs the vinyl polymerizable monomer, the monomer in the intermediate particle is polymerized. The vinyl polymerizable monomer and the initiator may be added directly or as an aqueous emulsion. The added aqueous emulsion is a suspension in which a vinyl polymerizable monomer and a vinyl polymerization initiator are emulsified and dispersed together with an emulsion stabilizer in water. If necessary, a crosslinking agent, an offset preventing agent and an electrostatic preventing agent may be added thereto.

It is preferable that there is a temperature difference of 5° C. or more between a Tg of the vinyl polymerizable monomer used in a seeding polymerization and that of the Tg of polymerizable monomer of the shell material which is used in producing the intermediate particle. In this case, a Tg of the vinyl polymerizable monomer used in a seeding polymerization may be higher or lower than that of another polymerizable monomer.

The reason why it is preferable that the temperature difference between the monomers after the polymerization is 5° C. or more is that the shell can be formed stably. Where the temperature difference between the resins is less than 5° C. and therefore the resins are compatible to each other, it is difficult to form an ideal shell by a seeding polymerization. That is, after the intermediate particle absorbs a polymerizable monomer for forming a shell in the aqueous emulsion and enlarges, the polymerizable monomer compatibly melts a surface of the intermediate toner and an ingredient of the intermediate particle is mixed with the shell. The toner therefore tends to have a low blocking resistance.

A vinyl polymerization initiator, a crosslinking agent and a dispersion stabilizer used in a seeding polymerization may be the same as those used in the production of the intermediate particle. If necessary, polymerization conditions of the resin for forming the shell can be optimized by using a water-soluble polymerization initiator.

By adding the aqueous emulsion, the intermediate particle absorbs the vinyl polymerizable monomer and enlarges. In this condition, the monomer of the intermediate particle is polymerized. That is, a seeding polymerization is conducted using the intermediate particle as a core particle.

By conducting the seeding polymerization followed by the in situ polymerization, there is provided a capsulated toner which is superior to a conventional capsulated toner prepared by in situ polymerization alone in a fixation at a low temperature and a stability in preservation.

Since the process of this embodiment substantially forms two or more layers on a core, the resultant toner can be improved in a fixation at a low temperature and an offset resistance.

As mentioned in this embodiment, the most important thing is that the temperature difference between a Tg of an inner shell prepared by in situ polymerization and a Tg of an outer shell prepared by seeding polymerization is 5° C. or more. Because of such a temperature difference, two or more layered shell is not compatible. In other words, the toner includes two or more layered shell which has a clear and stable boundary between the core and the shell.

As mentioned in comparative examples of this specification, where the temperature difference is less than 5° C., it is not found that a toner having a two or more layered shell is superior to a toner having a single layered shell. That is, the toner having a two or more layered shell is not more advantageous than that having a single layered shell.

Accordingly, it is very advantageous to form a capsulated toner structure having a two or more layered shell and a Tg difference of 5° C. or more between layers of the shell.

A Fshell of the toner is composed of an inner layer and an outer layer which are made of a thermoplastic resin having a Tg which is 5° C. higher or more than that of a core material. There is a Tg difference of 5° C. or more between shell materials of the inner layer and the outer layer. The Tg of the shell material forming the inner layer may be higher or lower than that for forming the outer layer. Where the shell having a high Tg is too thick, a fixation of the toner is decreased. To the contrary, where the shell is too thin, it becomes fragile. Consequently, it is preferable to use a shell material having a comparatively low Tg in order to improve the fixation. As the Tg of the shell material lowers to that of the core material, both the materials become compatible. In order to avoid such a disadvantage of the compatibility, a thin intermediate layer having a high Tg may be formed between them.

In this embodiment, although there is not any particular limitation regarding a particle diameter of the capsulated toner, it is preferable that the average particle diameter usually ranges from 3 to 30 mμ.

In this embodiment, a particle diameter of the capsulated toner, use of a flow improver and a cleaning improver, and addition of a magnetic fine particle are optional. Examples thereof are the same as those employed in embodiment 1.

<Embodiment 8>

In this embodiment, there is provided a heat pressure-fixable toner comprising at least thermoplastic resin and a coloring agent as an integrant, wherein the toner is produced by using three or more polymerizable monomers which can form resins having different Tgs respectively, wherein the polymerization of at least one polymerizable monomer is conducted in process of the polymerization of other polymerizable monomers, or after completing the polymerization of other polymerizable monomers, and wherein a layer having the highest Tg is located between a core resin and an outermost layer of the shell resin.

By taking the above-mentioned process, there is provided a heat pressure-fixable toner having a good fixation at a low temperature, a high blocking resistance and a high endurance enough to prevent a change of shape of the toner caused by mechanical stress in a developing apparatus, and the toner can stably provide a clear image without a fog in background for a long time.

The toner of this embodiment comprises a core material containing at least a thermoplastic resin and a coloring agent, the first shell material covering a surface of the core material and the second shell material covering a surface of the first shell material. The heat pressure-fixable toner according to this embodiment has the following features.

1. The toner is made of at least a coloring agent and a thermoplastic resin and is produced by process using three or more polymerizable monomers capable of forming a thermoplastic resin.
2. The polymerization of at least one polymerizable monomer is conducted after starting and in process of the polymerization of other polymerizable monomers, or after completing the polymerization of other polymerizable monomers.
3. A layer having the highest Tg is located between the core resin and an outermost layer of the shell.

A process for the production of the capsulated toner of this embodiment will be explained below.

The toner comprises the same resins used in the core material and the shell material as those of embodiment 1.

At first, at least a polymerizable monomer for producing a core resin, a polymerization initiator and a coloring agent are mixed, and if necessary, a crosslinking agent, a wax and an electrostatic preventing agent may be added thereto and mixed.

The mixture thus obtained is dispersed in a dispersion medium and then the polymerizable monomer is polymerized to form a particle of the core.

The dispersion media herein are the same as those used in embodiment 1.

It is preferable to design a shell material so as to have a Tg higher than that of a core material. For example, a mixing ratio of a styrene or a styrene derivative in the resin forming the shell material is larger than that in the resin forming the core material. In other words, it is effective to decrease a ratio of an ethylenically monocarbonic acid or an ester thereof. Alternatively it is also effective to use ethylenically monocarbonic acids or esters thereof alone or in combination.

The suspension thus obtained is kept at a temperature of 50° C. to 100° C. with stirring to continue or complete the polymerization of the polymerizable monomer of the core material.

As mentioned in the embodiment, a polymerizable monomer forming a resin for covering a surface of a core resin or a pre-polymerized resin thereof may be mixed with at least a polymerizable monomer for forming a core resin, a polymerization initiator and a coloring agent at the step of in situ polymerization.

A resin for covering a surface of core resin particle is added to the mixture and mixed in process of or at the end of the in situ polymerization.

Examples of the materials added thereto may include all of monomers and polymers useful for forming the core and shell materials described above.

As previously explained, it is preferable that the monomers used in forming the shell have the Tg which is higher than that of the core resin and is lower than that of a resin covering a surface of the resin formed by in situ polymerization. This is because it is preferable that a Tg of the shell layer formed by seeding polymerization is high in order to improve a preservation of the toner, but it is not preferable that the Tg is high in order to improve a fixation of the toner.

As mentioned in this embodiment, it is preferable to design that the shell layers formed by seeding polymerization has a Tg lower than that of the resin formed by in situ polymerization to cover a surface of the core.

The reason for designing in such a manner is that the resin formed by in situ polymerization to cover a surface of the core provides a considerable blocking resistance and the shell formed by seeding polymerization serves in a complimentary role thereof.

If a blocking resistance requested in the present invention is fulfilled by using only one of the resins formed by in situ polymerization and seeding polymerization to cover a surface of the core, a thick shell layer having a high Tg should be used and such a layer makes it difficult to fulfil a fixation of the toner.

To the contrary, if a resin having a low Tg is used to form the shell layer, the layer should be thickened to decrease a blocking resistance.

According to this embodiment, where a shell having two or more layers which covers a core resin is formed by using more than one resins having different Tgs, it is easy to fulfil a blocking resistance and a fixation of the toner. In addition, according to the present invention, by locating a layer of the resin having the highest Tg between the core and an outermost layer of the shell, two kinds of resins which are the most incompatible are adjacent to each other. Since such a layer prevents to compatibly melt the core resin and the shell resin of the outer layer at their boundary, the core and the shell are ideally separated to have their functions respectively.

The term "glass-transition temperature of single resin" in this embodiment means a glass-transition temperature of the resin which is obtained by sufficiently polymerizing a single polymerizable monomer, that is, a Tg of single resin is the temperature at which the polymerization of the resin is sufficiently advanced so that the Tg will be independent on a degree of polymerization.

During the in situ polymerization or after completing it, the third polymerizable monomer is added to the suspension to conduct a seeding polymerization.

That is, at least a vinyl polymerizable monomer and a vinyl polymerization initiator are added to an aqueous suspension of thermoplastic resin particle (referred to as intermediate particle hereinbelow) including a coloring agent, during the in situ polymerization or after completing it. After the intermediate particle sufficiently absorbs the vinyl polymerizable monomer, the monomer in the intermediate particle is polymerized. The vinyl polymerizable monomer and the like may be added directly or as an aqueous emulsion. The added aqueous emulsion is a suspension in which a vinyl polymerizable monomer and a vinyl polymerization initiator are emulsified and dispersed together with an emulsion stabilizer in water. If necessary, a crosslinking agent, an offset preventing agent and an electrostatic preventing agent may be added thereto.

As previously explained, it is preferable that a Tg of vinyl polymerizable monomer used in a seeding polymerization is lower than that of the shell obtained by in situ polymerization.

This is because the resin formed by in situ polymerization to cover a surface of the core provides a considerable blocking resistance and the shell formed by seeding polymerization serves in a complimentary role thereof. By taking this structure, a sufficient blocking resistance can be attained without any disadvantage in a fixation.

As explained in the embodiment, by locating a layer of the resin having the highest Tg between a core and an outermost layer of shell, two kinds of resins which are the most incompatible are adjacent to each other. Since such a layer prevents to compatibly melt the core resin and the shell resin of the outer layer at their boundary, the core and the shell are ideally separated to have their functions respectively. Accordingly, a thickness of the shell layer for attaining a blocking resistance can be minimized in comparison with that produced by conventional process.

A vinyl polymerization initiator, a crosslinking agent and dispersion stabilizer may be the same as those used in the production of the intermediate particle. If necessary, polymerization conditions of the resin for forming the shell can be optimized by using a water-soluble polymerization initiator.

By adding the aqueous emulsion, the vinyl polymerizable monomer is absorbed by the intermediate particle and then somewhat enlarges it. The polymerizable monomer on the intermediate particle is polymerized in the enlarged state. Namely, a seed polymerization happens using the intermediate particle as a core particle.

By conducting a seeding polymerization following after an in situ polymerization in such a manner, there is provided an capsulated toner excellent in a fixation at a low temperature and a stability in preservation in comparison with a toner produced by in situ polymerization alone.

That is, according to this embodiment, since a shell having more than two layers is formed, a blocking resistance and a fixation of the toner can be improved. As described repeatedly due to its importance, by locating a layer of the resin having the highest Tg between a core and an outermost layer of a shell, two kinds of resins which are the most incompatible are located adjacently to each other. Since such a layer prevent to compatibly melt the core resin and the shell resin of the outer layer at their boundary, the core and the shell are ideally separated to have their functions respectively. Accordingly, a thickness of the shell can be minimized in comparison with that produced by conventional process.

As explained in comparative examples, where a shell of toner is formed with more than two kinds of resins but a core and layers of the shell are arranged in order of a Tg, a good blocking resistance cannot be ensured if a sufficient fixation at a low temperature is attained.

Although there is not any particular limitation regarding a particle diameter of the capsulated toner, it is preferable that the average particle diameter usually ranges from 3 to 30 m$\mu$.

In this embodiment, a particle diameter of the capsulated toner, use of a flow improver and a cleaning improver, and addition of a magnetic fine particle are optional. Examples thereof are the same as those employed in embodiment 1.

<Embodiment 9>

Figure 9:
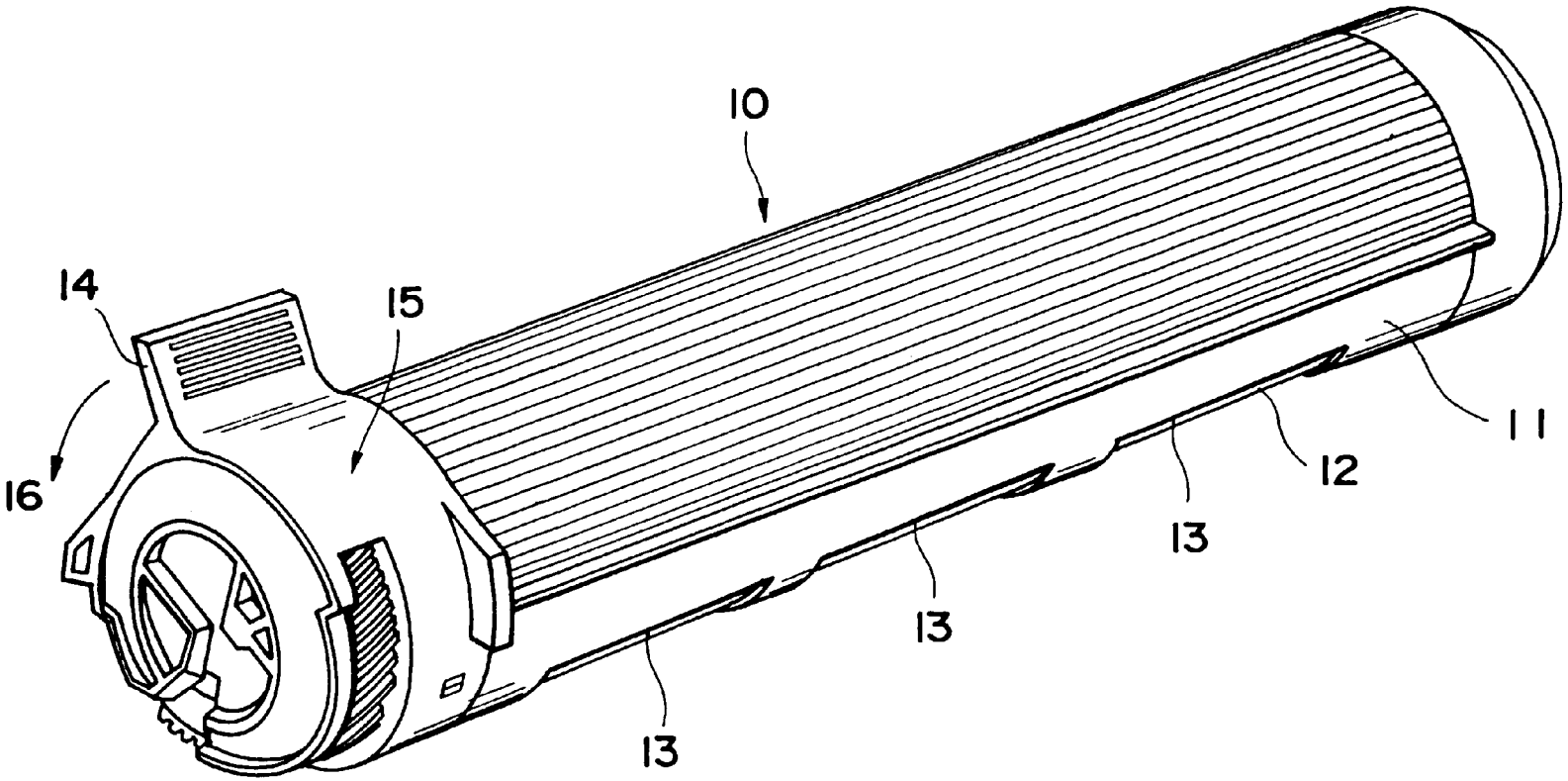
FIG. 9 is a bird view of a toner cartridge in which the toner of this invention is stored.

FIG. 9 is bird view of a toner cartridge in which the toner of this invention explained heretofore is stored.

The body of this toner cartridge 10 is composed of a outer barrel 11 and a inner barrel 12. Three ejection gates 13 are opened on the side wall of the outer barrel 11. The same layout ejection gates which are not illustrated in the figure, are opened on the side wall of the inner barrel 12. The ejection gates are positioned at the corresponding position of the outer barrel 11.

The toner is stored in the inner barrel 12. At the left side of the inner barrel 12, a cap 15 with tab 14 is fixed. The right side of the inner barrel 12 and the right side of the outer barrel 11 are covered with wall, which are not illustrated in the figure.

Holding the outer barrel 11 so as not to rotate, when the tab 14 of the cap 15 is pushed to the direction of the arrow 16, the inner barrel 12 rotates inside the outer barrel 11. Rotating the inner barrel 12 to a certain angle, the ejection gates of the inner barrel 12 and the ejection gates 13 of the outer barrel 11 are directly rapped over. Then the toner is available to eject through the gates from the inner barrel 12 to outside.

When the toner cartridge is transported or deposited, the wall of the inner barrel 12 shuts the ejection gate 13 of the outer barrel 11 as illustrated in the figure. The toner of this invention is available to preserve for a long time by storing in such a toner cartridge.

Figure 10:
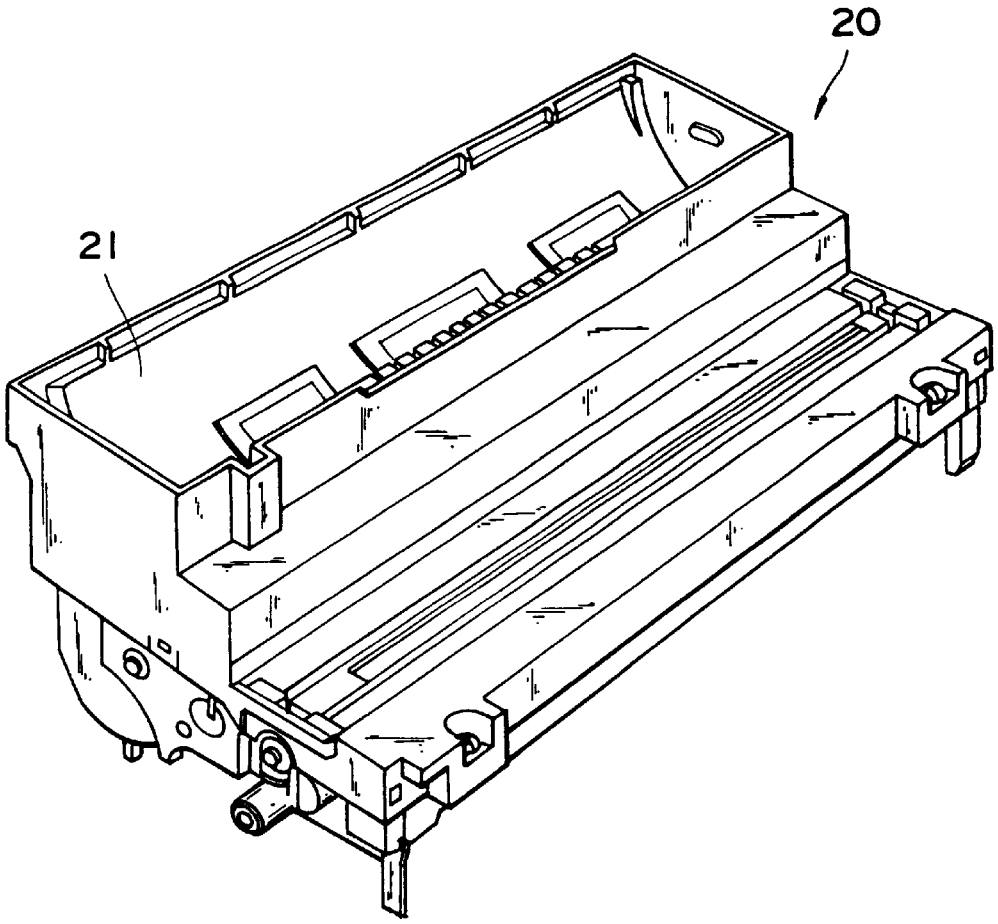
FIG. 10 is a bird view of a print engine for mounting the toner cartridge.

FIG. 10 is a bird view of a print engine for mounting the toner cartridge.

The print engine 20 has a developing unit 21. Facing the eject gate 12 down, the toner cartridge 10 is fixed on the developing unit 21.

On the developing unit 21, the uter barrel 11 of the toner cartridge 10 is fixed so as not to rotate. Adding rotation to the tab 14 in this status, the toner is available to supply to the developing unit from the inner barrel 12. In such print engine, the toner of this invention is supplied for high speed printing.

EXAMPLES

The present invention will be illustrated hereinbelow based on comparative examples and working examples, it being noted that these Examples are not intended to limit the scope of the present invention. The present is explained based on the following working example.

Working Example 1-1

Working examples 1-1 to 1-4 and comparative examples 1-1 to 1-3 mainly illustrate embodiment 1 of the present invention in detail.

The following mixture was put into an attritor ("MA-01SC" manufactured by Mitsui Miike Engineering Corp.) and dispersed at 10° C. for 10 hrs. to prepare a polymerizable composition.

| Component of mixture: | |
|---|---|
| Styrene: | 75 parts by weight |
| n-butyl acrylate: | 25 parts by weight |
| Low molecular weight polyethylene: (used as an offset preventing agent) | 1.5 part by weight |
| Electrostatic preventing agent: ("Aizensupiro black TRH" manufactured by Hodogaya Chemical Corp.) | 1 part by weight |
| Carbon black ("Printexl" manufactured by Degusa Co. Ltd.) | 7 parts by weight |
| 2,2'-Azo bis-isobutyronitrile | 1 part by weight |

8 Parts by weight of polyacrylate and 0.35 part by weight of divinylbenzen were solved in 180 parts by weight of ethanol. 600 Parts by weight of distilled water was added to the mixture to prepare a dispersion medium. The polymerizable composition was added to the medium and dispersed at 15° C. for 10 minutes at a rate of 8,000 r.p.m in a TK homomixer ("M Type" manufactured by Tokusyu Kika Kogyo Co., Ltd.). The resultant dispersion was put into a separable-one litter flask and reacted at 85° C. for 12 hours under a nitrogen flow with stirring at a rate of 100 r.p.m. The dispersoid obtained by polymerization of the polymerizable composition in these steps is referred to as "intermediate particle" hereinbelow.

9.5 Parts by weight of methyl methacrylate, 0.5 part by weight of n-butyl acrylate, 0.5 part by weight of 2,2'-azo bis-isobutyronitrile (used as a polymerization initiator), 0.1 part by weight of sodium laurylsulfate, and 80 parts by weight of water were mixed and the mixture was treated by ultrasonic generator ("US-150", Nippon Seiki Industry Co., Ltd.) to prepare aqueous emulsion A. 9 Parts by weight of aqueous emulsion A was dripped to the aqueous suspension of the intermediate particles to enlarge the particles. Just after dripping, the aqueous suspension was observed by optical microscope to see no droplet of the emulsion. It was therefore confirmed that the enlargement had done for a very short time.

The suspension was further reacted as the second polymerization at 85° C. for 10 hrs. under a nitrogen atmosphere with stirring. After cooling the reaction mixture, the dispersion medium was dissolved with a 0.5 N aqueous hydrochloride acid solution and the mixture was filtrated. The residue thus obtained was washed with water, air-dried, dried at 40° C. for 10 hrs. under a reduced pressure of 10 mmHg and classified by air classifier to obtain a capsulated toner having an average particle diameter of 7 $\mu$m.

A Tg of the resin particle obtained before the seeding polymerization was 50° C. It means that a core of the capsulated toner obtained in this working example has a Tg of 50° C.

The thermoplastic resin obtained by polymerization of aqueous emulsion A alone has a Tg of 95° C. It means that a shell of the capsulated toner obtained in this working example has a Tg of 95° C.

0.35 Parts by weight of a fine powder of a hydrophobic silica "Aerosil R-972" (manufactured by Japan Aerosil Co., Lid.) was mixed with 50 parts by weight of the resultant capsulated toner to obtain the capsulated toner of the present invention.

The toner was charged in LED Printer OKI MIKROLINE16n, which is a trade name of an electrophotographic printer manufactured by OKI Electric Industry Co., Ltd., and used in printing. A fixation percentage thereof was measured. A temperature of a fixation device (a heat-roller) was set at 130° C. The result is shown in Table 1.

The fixation percentage is defined by the following equation.

Fixation percentage (%)=(image density after rubbing/image density before rubbing)×100

The term "image density before rubbing" means an image density of a solid color of print which is measured by Macbeth densitometer. The term "image density after rubbing" means an image density which is retained on a print after Scotch-tape is overlaid on a solid color of the print, applied a load of 50 g/cm$^2$ to a given area by reciprocation and removed from the print at a rate of 3 cm/sec.

The fixation percentage thus measured is classified in the following manner and summarized in Table 1.

Fixation Percentage 90 to 100% ⊚: 50 to 90% ○: 0 to 50% X

The capsulated toner of this working example indicates a good fixation.

A blocking resistance of the toner was determined by the following method. A cylindrical container having a bottom of 20 cm$^2$ was charged with 20 grams of the toner sample, capped and given a pressure of 500 g/cm$^2$ by weight. The toner was kept at 50° C. in this condition for a month. All of the sample toner (20 g) was transferred onto a sieve of 45 $\mu$m mesh, vibrated at a rate of 1 KHz for 30 seconds and then the toner retained on the sieve was weighed. A blocking percentage (%) is defined by the following equation.

Blocking percentage (%)=Weight of toner retained on sieve (g)/Weight of sample toner (g)×100

The capsulated toner of this working example caused no blocking and indicated a very good stability in preservation.

As a result of the test mentioned above, it is confirmed that the capsulated toner of this working example has a good fixation and a very good stability in preservation, can be clearly applicable to a non-contacting development, which does not tend to apply a mechanical pressure thereto, and further sufficiently applicable to a contacting development which tends to apply a comparatively high pressure thereto.

Working Example 1-2

The following mixture was put into an attritor ("MA-01SC" manufactured by Mitsui Miike Engineering Corp.) and dispersed at 15° C. for 10 hrs. to prepare a polymerizable composition.

| Component of mixture: | |
|---|---|
| Styrene: | 82.5 parts by weight |
| n-butyl acrylate: | 17.5 parts by weight |
| Low molecular weight polyethylene: (used as an offset preventing agent) | 1.5 part by weight |
| Electrostatic preventing agent: ("Aizensupiro black TRH" manufactured by Hodogaya Chemical Corp.) | 1 part by weight |
| Carbon black ("Printexl" manufactured by Degusa Co. Ltd.) | 7 parts by weight |
| 2,2'-Azo bis-isobutyronitrile | 1 part by weight |

8 Parts by weight of polyacrylate and 0.35 part by weight of divinylbenzen were dissolved in 180 parts by weight of ethanol. 600 Parts by weight of distilled water was added to the mixture to prepare a dispersion medium. The polymerizable composition was added to the dispersion medium and dispersed at 15° C. for 10 minutes at a rate of 8,000 r.p.m in a TK homomixer ("M type" manufactured by Tokusyu Kika Kogyo Co., Ltd.). The resultant dispersion was put into a separable-one litter flask and reacted at 85° C. for 12 hrs. under a nitrogen flow with stirring at a rate of 100 r.p.m. The dispersoid obtained by polymerization of the polymerizable composition in these steps is referred to as "intermediate particle" hereinbelow.

Taking the same procedure as those used in working example 1-1, 9 parts by weight of aqueous emulsion A was dripped to the aqueous suspension of the intermediate particles to conduct a seed polymerization obtaining a capsulated toner having an average particle diameter of 7 $\mu$m.

A Tg of the resin particle obtained before the seeding polymerization was 65° C. It means that a core of the capsulated toner obtained in this working example has a Tg of 65° C. This toner was treated by the same procedure as that used in working example 1-1 to prepare the toner of the present invention.

The toner was charged in LED Printer OKI MIKROLINE16n, which is a trade name of an electrophotographic printer manufactured by OKI Electric Industry Co., Ltd., and used in printing. A fixation percentage thereof was measured. A temperature of a fixation device (a heat-roller) was set at 130° C. which is the same as that of working example 1-1. The result is shown in Table 1. The capsulated toner of this working example indicates a good fixation.

A blocking resistance of the toner was determined by the same method as that of working example 1-1. As shown in working example 1-1, the capsulated toner of this working example caused no blocking and indicated a very good blocking resistance.

As a result of the test mentioned above, it is confirmed that the capsulated toner of this working example has a good fixation and a very good stability in preservation, can be clearly applicable to a non-contacting development, which does not tend to apply a mechanical pressure thereto, and further sufficiently applicable to a contacting development which tends to apply a high pressure thereto.

Working Example 1-3

The following mixture was put into an attritor ("MA-01SC" manufactured by Mitsui Miike Engineering Corp.) and dispersed at 15° C. for 10 hrs. to prepare a polymerizable composition.

| Component of mixture: | |
|---|---|
| Styrene: | 75 parts by weight |
| n-butyl acrylate: | 25 parts by weight |
| Low molecular weight polyethylene: (used as an offset preventing agent) | 1.5 part by weight |
| Electrostatic preventing agent: ("Aizensupiro black TRH" manufactured by Hodogaya Chemical Corp.) | 1 part by weight |
| Carbon black ("Printexl" manufactured by Degusa Co. Ltd.) | 7 parts by weight |
| 2,2'-Azo bis-isobutyronitrile | 1 part by weight |

8 Parts by weight of polyacrylate and 0.35 part by weight of divinylbenzen were dissolved in 180 parts by weight of ethanol. 600 Parts by weight of a distilled water was added to the mixture to prepare a dispersion medium. The polymerizable composition was added to the dispersion medium and dispersed at 15° C. for 10 minutes at a rate of 8,000 r.p.m in a TK homomixer ("M type" manufactured by Tokusyu Kika Kogyo Co., Ltd.). The resultant dispersion was put into a separable-one litter flask and reacted at 85° C. for 12 hrs. under a nitrogen flow with stirring at a rate of 100 r.p.m. The dispersoid obtained by polymerization of the polymerizable composition in these steps is referred to as "intermediate particle" hereinbelow.

7 Parts by weight of methyl methacrylate, 3 part by weight of n-butyl acrylate, 0.5 part by weight of 2,2'-azo bis-isobutyronitrile (used as a polymerization initiator), 0.1 part by weight of sodium laurylsulfate, and 80 parts by weight of water were mixed and the mixture was treated by ultrasonic generator ("US-150", Nippon Seiki Industry Co., Ltd.) to prepare aqueous emulsion B. 9 Parts by weight of aqueous emulsion B was dripped to the aqueous suspension of the intermediate particles to enlarge the particles. Just after dripping, the aqueous suspension was observed by optical microscope to see no droplet of the emulsion. It was therefore confirmed that the enlargement had done for a very short time.

The suspension was further reacted as the second polymerization at 85° C. for 10 hrs. under a nitrogen atmosphere with stirring. After cooling the reaction mixture, the dispersion medium was dissolved with a 0.5 N aqueous hydrochloride acid solution and the mixture was filtrated. The residue thus obtained was washed with water, air-dried, dried at 40° C. for 10 hrs. under a reduced pressure of 10 mmHg and classified by air classifier to obtain a capsulated toner having an average particle diameter of 7 $\mu$m.

A Tg of the resin particle obtained before the seeding polymerization was 50° C. It means that a core of the capsulated toner obtained in this working example has a Tg of 50° C.

The thermoplastic resin obtained by the polymerization of aqueous emulsion B alone has a Tg of 70° C. It means that the shell resin of the capsulated toner obtained in this working example has a Tg of 70° C.

This capsulated toner was treated by the same procedure as that used in working example 1-1 to prepare the toner of the present invention.

The toner was charged in LED Printer OKI MIKROLINE16n, which is a trade name of an electrophotographic printer manufactured by OKI Electric Industry Co., Ltd., and used in printing. A fixation percentage thereof was measured. A temperature of a fixation device (a heat-roller) was set at 130° C. which is the same as that of working example 1-1. The result is shown in Table 1. The capsulated toner of this working example indicated a good fixation.

A blocking resistance of the toner was determined by the same method as that of working example 1-1. As shown in working example 1-1, the capsulated toner of this working example caused no blocking and indicated a very good blocking resistance.

As a result of the test mentioned above, it is confirmed that the capsulated toner of this working example has a good fixation and a very good stability in preservation, can be clearly applicable to a non-contacting development system, which does not tend to apply a mechanical pressure thereto, and further sufficiently applicable to a contacting development system which tends to apply a high pressure thereto.

Working Example 1-4

The following mixture was put into an attritor ("MA-01SC" manufactured by Mitsui Miike Engineering Corp.)

and dispersed at 15° C. for 10 hrs. to prepare a polymerizable composition.

| Component of mixture: | |
|---|---|
| Styrene: | 82.5 parts by weight |
| n-butyl acrylate: | 17.5 parts by weight |
| Low molecular weight polyethylene: (used as an offset preventing agent) | 1.5 part by weight |
| Electrostatic preventing agent: ("Aizensupiro black TRH" manufactured by Hodogaya Chemical Corp.) | 1 part by weight |
| Carbon black ("Printexl" manufactured by Degusa Co. Ltd.) | 7 parts by weight |
| 2,2'-Azo bis-isobutyronitrile | 1 part by weight |

8 Parts by weight of polyacrylate and 0.35 part by weight of divinylbenzen were dissolved in 180 parts by weight of ethanol. 600 Parts by weight of a distilled water was added to the mixture to prepare a dispersion medium. The polymerizable composition was added to the dispersion medium and dispersed at 15° C. for 10 minutes at a rate of 8,000 r.p.m in a TK homomixer ("M type" manufactured by Tokusyu Kika Kogyo Co., Ltd.). The resultant dispersion was put into a separable-one litter flask and reacted at 85° C. for 12 hrs. under a nitrogen flow with stirring at a rate of 100 r.p.m. The dispersoid obtained by polymerization of the polymerizable composition in these steps is referred to as "intermediate particle" hereinbelow.

Taking the same procedure as those used in working example 1-3, 9 parts by weight of aqueous emulsion B was dripped to the aqueous suspension of the intermediate particles to conduct a seed polymerization obtaining a capsulated toner having an average particle diameter of 7 $\mu$m.

A Tg of the resin particle obtained before the seeding polymerization was 65° C. It means that a core of the capsulated toner obtained in this working example has a Tg of 65° C.

This toner was treated by the same procedure as that used in working example 1-1 to prepare the toner of this working example.

The toner was charged in LED Printer OKI MIKROLINE16n and used in printing. A fixation percentage thereof was measured. A temperature of a fixation device (a heat-roller) was set at 130° C. which is the same as that of working example 1-1. The result is shown in Table 1. The capsulated toner of this working example indicated a good fixation.

A blocking resistance of the toner was determined by the same method as that of working example 1-1. As shown in working example 1-1, the capsulated toner of this working example caused no blocking and indicated a very good blocking resistance.

As a result of the test mentioned above, it is confirmed that the capsulated toner of this working example has a good fixation and a very good stability in preservation, can be clearly applicable to a non-contacting development system, which does not tend to apply a mechanical pressure thereto, and further sufficiently applicable to a contacting development system which tends to apply a high pressure thereto.

Comparative Example 1-1

The following mixture was put into an attritor ("MA-01SC" manufactured by Mitsui Miike Engineering Corp.) and dispersed at 15° C. for 10 hrs. to prepare a polymerizable composition.

| Component of mixture: | |
|---|---|
| Styrene: | 82.5 parts by weight |
| n-butyl acrylate: | 17.5 parts by weight |
| Low molecular weight polyethylene: (used as an offset preventing agent) | 1.5 part byweight |
| Electrostatic preventing agent: ("Aizensupiro black TRH" manufactured by Hodogaya Chemical Corp.) | 1 part by weight |
| Carbon black ("Printexl" manufactured by Degusa Co. Ltd.) | 7 parts by weight |
| 2,2'-Azo bis-isobutyronitrile | 1 part by weight |

8 Parts by weight of polyacrylate and 0.35 part by weight of divinylbenzen were solved in 180 parts by weight of ethanol. 600 Parts by weight of distilled water was added to the mixture to prepare a dispersion medium. The polymerizable composition was added to the mixture and dipersed at 15° C. for 10 minutes at a rate of 8,000 r.p.m in a TK homomixer ("M Type" manufactured by Tokusyu Kika Kogyo Co., Ltd.). The resultant dispersion was put into a separable-one litter flask and reacted at 85° C. for 12 hours under a nitrogen flow with stirring at a rate of 100 r.p.m.

At the time of completing the polymerization, the thermoplastic resin thus obtained has a Tg of 65° C.

This capsulated toner was treated by the same procedure as that used in working example 1-1 to prepare the toner of this comparative example.

The toner was charged in LED Printer OKI MIKROLINE16n and used in printing. A fixation percentage thereof was measured. The toner indicated a sufficient fixation as shown in working examples 1-1 to 1-4.

A blocking resistance of this toner was measured in the same manner as that of working examples 1-1. This toner was very bad in a blocking resistance. It was therefore confirmed that the capsulated toner of this comparative example was not practically useful because of its blocking resistance.

Comparative Example 1-2

The following mixture was put into an attritor ("MA-01SC" manufactured by Mitsui Miike Engineering Corp.) and dispersed at 15° C. for 10 hrs. to prepare a polymerizable composition.

| Component of mixture: | |
|---|---|
| Styrene: | 85 parts by weight |
| n-butyl acrylate: | 15 parts by weight |
| Low molecular weight polyethylene: (used as an offset preventing agent) | 1.5 part by weight |
| Electrostatic preventing agent: ("Aizensupiro black TRH" manufactured by Hodogaya Chemical Corp.) | 1 part by weight |
| Carbon black ("Printexl" mannufactured by Degusa Co. Ltd.) | 7 parts by weight |
| 2,2'-Azo bis-isobutyronitrile | 1 part by weight |

8 Parts by weight of polyacrylate and 0.35 part by weight of divinylbenzen were solved in 180 parts by weight of ethanol. 600 Parts by weight of distilled water was added to the mixture to prepare a dispersion medium. The polymerizable composition was added to the mixture and dispersed at 15° C. for 10 minutes at a rate of 8,000 r.p.m in a TK homomixer ("M Type" manufactured by Tokusyu Kika Kogyo Co., Ltd.). The resultant dispersion was put into a separable-one litter flask and reacted at 85° C. for 12 hrs. under a nitrogen flow with stirring at a rate of 100 r.p.m.

At the time of completing the polymerization, the thermoplastic resin thus obtained has a Tg of 70° C.

This capsulated toner was treated by the same procedure as that used in working example 1-1 to prepare the toner of this comparative example.

The toner was charged in LED Printer OKI MIKROLINE16n and used in printing. A fixation percentage thereof was measured. The toner did not indicate a sufficient fixation.

Comparative Example 1-3

The following mixture was put into an attritor ("MA-01SC" manufactured by Mitsui Miike Engineering Corp.) and dispersed at 15° C. for 10 hrs. to prepare a polymerizable composition.

| Component of mixture: | |
|---|---|
| Styrene: | 72.5 parts by weight |
| n-butyl acrylate: | 27.5 parts by weight |
| Low molecular weight polyethylene: (used as an offset preventing agent) | 1.5 part by weight |
| Electrostatic preventing agent: ("Aizensupiro black TRH" manufactured by Hodogaya Chemical Corp.) | 1 part by weight |
| Carbon black ("Printexl" manufactured by Degusa Co. Ltd.) | 7 parts by weight |
| 2,2'-Azo bis-isobutyronitrile | 1 part by weight |

8 Parts by weight of polyacrylate and 0.35 part by weight of divinylbenzen were solved in 180 parts by weight of ethanol. 600 Parts by weight of distilled water was added to the mixture to prepare a dispersion medium. The polymerizable composition was added to the mixture and dispersed at 15° C. for 10 minutes at a rate of 8,000 r.p.m in a TK homomixer ("M Type" manufactured by Tokusyu Kika Kogyo Co., Ltd.). The resultant dispersion was put into a separable-one litter flask and reacted at 85° C. for 12 hrs. under a nitrogen flow with stirring at a rate of 100 r.p.m. The dispersoid obtained by polymerization of the polymerizable composition in these steps is referred to as "intermediate particle" hereinbelow.

10 Parts by weight of methyl methacrylate, 0.5 part by weight of 2,2'-azo bis-isobutyronitrile (used as a polymerization initiator), 0.1 part by weight of sodium laurylsulfate, and 80 parts by weight of water were mixed and the mixture was treated by ultrasonic generator ("US-150", Nippon Seiki Industry Co., Ltd.) to prepare aqueous emulsion C. 9 Parts by weight of aqueous emulsion C was dripped to the aqueous suspension of the intermediate particles to enlarge the particles. Just after dripping, the aqueous suspension was observed by optical microscope to see no droplet of the emulsion. It was therefore confirmed that the enlargement had done for a very short time.

The suspension was further reacted as the second polymerization at 85° C. for 10 hrs. under a nitrogen atmosphere with stirring. After cooling the reaction mixture, the dispersion medium was dissolved with a 0.5 N aqueous hydrochloride acid solution and the mixture was filtrated. The residue thus obtained was washed with water, air-dried, dried at 40° C. for 10 hrs. under a reduced pressure of 10 mmHg and classified by air classifier to obtain a capsulated toner having an average particle diameter of 7 $\mu$m.

A Tg of the resin particle obtained before the seeding polymerization was 45° C. It means that a core of the capsulated toner obtained in this working example has a Tg of 45° C.

The thermoplastic resin obtained by the polymerization of aqueous emulsion C alone has a Tg of 100° C. It means that a shell of the capsulated toner obtained in this working example has a Tg of 100° C.

This capsulated toner was treated by the same procedure as that used in working example 1-1 to prepare the toner of this comparative example.

The toner was charged in LED Printer OKI MIKROLINE16n and used in printing. A fixation percentage thereof was measured. The toner indicated a sufficient fixation as shown in working examples 1-1 to 1-4.

A blocking resistance of this toner was measured in the same manner as that of working examples 1-1. This toner was very bad in a blocking resistance. It was therefore confirmed that the capsulated toner of this comparative example was not practically useful because of its blocking resistance.

TABLE 1

| | Tg. of core resin(° C.) | Tg. of shell resin(° C.) | Blocking percentage (%) | Fixation |
|---|---|---|---|---|
| EE | 50 | 95 | 0 | ⊙ |
| Ex. 1-2 | 65 | 95 | 0 | ⊙ |
| Ex. 1-3 | 50 | 70 | 0 | ⊙ |
| Ex. 1-4 | 65 | 70 | 0 | ⊙ |
| Com ex. 1-1 | 65 | — | 85 | ⊙ |
| Com ex. 1-2 | 70 | — | 0 | X |
| Com ex. 1-3 | 45 | 100 | 95 | ⊙ |

*Ex. in the table means a working example.
*Com. ex. in the table means a comparative example.

Working Example 2-1

Working examples 2-1 to 2-4 and comparative examples 2-1 to 2-2 mainly illustrate embodiment 2 of the present invention in detail.

The following mixture was put into an attritor ("MA-01SC" manufactured by Mitsui Miike Engineering Corp.) and dispersed at 15° C. for 10 hrs. to prepare a polymerizable composition.

| Component of mixture: | |
|---|---|
| Styrene: | 77.5 parts by weight |
| n-butyl acrylate: | 22.5 parts by weight |
| Low molecular weight polyethylene: (used as an offset preventing agent) | 1.5 part by weight |
| Electrostatic preventing agent: ("Aizensupiro black TRH" manufactured by Hodogaya Chemical Corp.) | 1 part by weight |
| Carbon black ("Printexl" manufactured | 7 parts by weight |

-continued

| Component of mixture: | |
|---|---|
| by Degusa Co. Ltd.) | |
| 2,2'-Azo bis-isobutyronitrile | 1 part by weight |

8 Parts by weight of polyacrylate and 0.35 part by weight of divinylbenzen were dissolved in 180 parts by weight of ethanol. 600 Parts by weight of distilled water was added to the mixture to prepare a dispersion medium. The polymerizable composition was added to the mixture and dispersed at 15° C. for ten minutes at a rate of 8,000 r.p.m in a TK homomixer ("M Type" manufactured by Tokusyu Kika Kogyo Co., Ltd.). The resultant dispersion was put into a separable-one litter flask and reacted at 85° C. for 12 hrs. under a nitrogen flow with stirring at a rate of 100 r.p.m. The dispersoid obtained by polymerization of the polymerizable composition in these steps is referred to as "intermediate particle" hereinbelow.

8.5 Parts by weight of methyl methacrylate, 1.5 part by weight of n-butyl acrylate, 0.5 part by weight of 2,2'-azo bis-isobutyronitrile (used as a polymerization initiator), 0.1 part by weight of sodium laurylsulfate, and 80 parts by weight of water were mixed and the mixture was treated by ultrasonic generator ("US-150", Nippon Seiki Industry Co., Ltd.) to prepare aqueous emulsion A. 9 Parts by weight of aqueous emulsion A was dripped to the aqueous suspension of the intermediate particles to enlarge the particles. Just after dripping, the aqueous suspension was observed by optical microscope to see no droplet of the emulsion. It was therefore confirmed that the enlargement had done for a very short time.

The suspension was further reacted as the second polymerization at 85° C. for 10 hrs. under a nitrogen atmosphere with stirring. After cooling the reaction mixture, the dispersion medium was dissolved with a 0.5 N aqueous hydrochloride acid solution and the mixture was filtrated. The residue thus obtained was washed with water, air-dried, dried at 40° C. for 10 hrs. under a reduced pressure of 10 mmHg and classified by air classifier to obtain a capsulated toner having an average particle diameter of 7 $\mu$m.

A Tg of the resin particle obtained before the seeding polymerization was 55° C. It means that a core of the capsulated toner obtained in this working example has a Tg of 55° C.

The thermoplastic resin obtained by the polymerization of aqueous emulsion A alone has a Tg of 70° C. It means that a shell of the capsulated toner obtained in this working example has a Tg of 70° C.

0.35 Parts by weight of a fine powder of a hydrophobic silica "Aerosil R-972" (manufactured by Japan Aerosil Co., Lid.) was mixed with 50 parts by weight of the resultant capsulated toner to prepare the capsulated toner of the present invention.

The toner was charged in LED Printer OKI MIKROLINE16n and used in printing. A fixation percentage thereof was measured. A temperature of a fixation device (a heat-roller) was set at 130° C. The result is shown in Table 2.

The fixation percentage is defined by the following equation.

Fixation percentage (%)=(image density after rubbing/image density before rubbing)×100

The term "image density before rubbing" means an image density of a solid color of print which is measured by Macbeth densitometer. The term "image density after rubbing" means an image density which is retained on a print after Scotch-tape is overlaid on a solid color of the print, applied a load of 50 g/cm$^2$ to a given area by reciprocation and removed from the print at a rate of 3 cm/sec.

The fixation percentage thus measured is classified in the following manner and summarized in Table 2.

Fixation Percentage 90 to 100% ⊙: 50 to 90% ○: 0 to 50% X

The capsulated toner of this working example indicates a good fixation.

A blocking resistance of the toner was determined by the following method. A cylindrical container having a bottom of 20 cm$^2$ was charged with 20 grams of the toner sample, capped and given a pressure of 500 g/cm$^2$ by weight. The toner was kept at 50° C. in this condition for a month. All of the sample toner (20 g) was transferred onto a sieve of 45 $\mu$m mesh, vibrated at a rate of 1 KHz for 30 seconds and then the toner retained on the sieve was weighed. A blocking percentage (%) is defined by the following equation.

Blocking percentage (%)=Weight of toner retained on sieve (g)/Weight of sample toner (g)×100

The capsulated toner of this working example caused no blocking and indicated a very good stability in preservation.

As a result of the test mentioned above, it is confirmed that the capsulated toner of this working example has a good fixation and a very good stability in preservation, can be clearly applicable to a non-contacting development, which does not tend to apply a mechanical pressure thereto, and further sufficiently applicable to a contacting development which tends to apply a comparatively high pressure thereto.

Working Example 2-2

The following mixture was put into an attritor ("MA-01SC" manufactured by Mitsui Miike Engineering Corp.) and dispersed at 15° C. for 10 hrs. to prepare a polymerizable composition.

| Component of mixture: | |
|---|---|
| Styrene: | 77.5 parts by weight |
| n-butyl acrylate: | 22.5 parts by weiglit |
| Low molecular weight polyethylene: (used as an offset preventing agent) | 1.5 part by weight |
| Electrostatic preventing agent: ("Aizensupiro black TRH" manufactured by Hodogaya Chemical Corp.) | 1 part by weight |
| Carbon black ("Printexl" manufactured by Degusa Co. Ltd.) | 7 parts by weight |
| 2,2'-Azo bis-isobutyronitrile | 1 part by weight |

8 Parts by weight of polyacrylate and 0.35 part by weight of divinylbenzen were dissolved in 180 parts by weight of ethanol. 600 Parts by weight of distilled water was added to the mixture to prepare a dispersion medium. The polymerizable composition was added to the dispersion medium and dispersed at 15° C. for 10 minutes at a rate of 8,000 r.p.m in a TK homomixer ("M type" manufactured by Tokusyu Kika Kogyo Co., Ltd.). The resultant dispersion was put into a separable-one litter flask and reacted at 85° C. for 12 hrs. under a nitrogen flow with stirring at a rate of 100 r.p.m. The dispersoid obtained by polymerization of the polymerizable composition in these steps is referred to as "intermediate particle" hereinbelow.

10 Parts by weight of methyl methacrylate, 0.5 part by weight of 2,2'-azo bis-isobutyronitrile, 0.1 part by weight of sodium laurylsulfate, and 80 parts by weight of water were mixed and the mixture was treated by ultrasonic generator ("US-150", Nippon Seiki Industry Co., Ltd.) to prepare aqueous emulsion B. 9 Parts by weight of aqueous emulsion B was dripped to the aqueous suspension of the intermediate particles to enlarge the particles. Just after dripping, the aqueous suspension was observed by optical microscope to see no droplet of the emulsion. It was therefore confirmed that the enlargement had done for a very short time.

The suspension was further reacted as the second polymerization at 85° C. for 10 hrs. under a nitrogen atmosphere with stirring. After cooling the reaction mixture, the dispersion medium was dissolved with a 0.5 N aqueous hydrochloride acid solution and the mixture was filtrated. The residue thus obtained was washed with water, air-dried, dried at 40° C. for 10 hrs. under a reduced pressure of 10 mmHg and classified by air classifier to obtain a capsulated toner having an average particle diameter of 7 $\mu$m.

This toner was treated by the same procedure as that used in working example 2-1 to prepare the toner of the present invention.

A Tg of the resin particle obtained before the seeding polymerization was 55° C., which was the same temperature of the resin particle prepared in working example 2-1. It means that a core of the capsulated toner obtained in this working example has a Tg of 55° C.

The thermoplastic resin obtained by polymerization of aqueous emulsion B alone has a Tg of 100° C. It means that the shell resin of the capsulated toner obtained in this working example has a Tg of 100° C.

The toner was charged in LED Printer OKI MIKROLINE16n and used in printing. A fixation percentage thereof was measured. A temperature of a fixation device (a heat-roller) was set at 130° C. which is the same as that of working example 2-1. The result is shown in Table 2. The capsulated toner of this working example indicates a good fixation.

A blocking resistance of the toner was determined by the same method as that of working example 2-1. As shown in working example 2-1, the capsulated toner of this working example caused no blocking and indicated a very good blocking resistance.

As a result of the test mentioned above, it is confirmed that the capsulated toner of this working example has a good fixation and a very good stability in preservation, can be clearly applicable to a non-contacting development, which does not tend to apply a mechanical pressure thereto, and further sufficiently applicable to a contacting development which tends to apply a high pressure thereto.

Working Example 2-3

85 Parts by weight of methyl methacrylate, 15 parts by weight of n-butyl acrylate and 3 parts by weight of 2,2'-azo bis-isobutyronitrile were put into a two litter-four neck-glass flask which was equipped with a thermometer, a stainless steel stirring rod, a reflux condenser, and a nitrogen inlet tube. The flask was placed in a heating mantle and the mixture therein was reacted at 100° C. The polymerization product was occasionally sampled during the reaction to measure a Tg thereof. The reaction was ceased when the Tg of the polymerization product reached 60° C. The Tg was measured by differential scanning calorimeter (Type of "DSC220", manufactured by Seiko electronic industry Co., Ltd.). The resin thus obtained was designated as resin 2C. It was confirmed that the Tg of polymerization product was 70° C., when the reaction time of this polymerization was sufficiently extended.

The following mixture was put into an attritor ("MA-01SC" manufactured by Mitsui Miike Engineering Corp.) and dispersed at 15° C. for 10 hrs. to prepare a polymerizable composition.

| Component of mixture: | |
|---|---|
| Styrene: | 77.5 parts by weight |
| n-butyl acrylate: | 22.5 parts by weight |
| Resin C (explained above) | 0.25 part by weight |
| Low molecular weight polyethylene: (used as an offset preventing agent) | 1.5 part by weight |
| Electrostatic preventing agent: ("Aizensupiro black TRH" manufactured by Hodogaya Chemical Co. Ltd.) | 1 part by weight |
| Carbon black ("Printexl" manufactured by Degusa Co. Ltd.) | 7 parts by weight |
| 2,2'-Azo bis-isobutyronitrile | 1 part by weight |

8 Parts by weight of polyacrylate and 0.35 part by weight of divinylbenzen were dissolved in 180 parts by weight of ethanol. 600 Parts by weight of distilled water was added to the mixture to prepare a dispersion medium. The polymerizable composition was added to the mixture and dispersed at 15° C. for 10 minutes at a rate of 8,000 r.p.m in a TK homomixer ("M Type" manufactured by Tokusyu Kika Kogyo Co., Ltd.). The resultant dispersion was put into a separable-one litter flask and reacted at 85° C. for 12 hrs. under a nitrogen flow with stirring at a rate of 100 r.p.m. The dispersoid obtained by polymerization of the polymerizable composition in these steps is referred to as "intermediate particle" hereinbelow.

10 Parts by weight of methyl methacrylate, 0.5 part by weight of 2,2'-azo bis-isobutyronitrile, 0.1 part by weight of sodium laurylsulfate, and 80 parts by weight of water were mixed and the mixture was treated by ultrasonic generator ("US-150", Nippon Seiki Industry Co., Ltd.) to prepare aqueous emulsion B. 9 Parts by weight of aqueous emulsion B was dripped to the aqueous suspension of the intermediate particles to enlarge the particles. Just after dripping, the aqueous suspension was observed by optical microscope to see no droplet of the emulsion. It was therefore confirmed that the enlargement had done for a very short time.

The suspension was further reacted as the second polymerization at 85° C. for 10 hrs. under a nitrogen atmosphere with stirring. After cooling the reaction mixture, the dispersion medium was dissolved with a 0.5 N aqueous hydrochloride acid solution and the mixture was filtrated. The residue thus obtained was washed with water, air-dried, dried at 40° C. for 10 hrs. under a reduced pressure of 10 mmHg and classified by air classifier to obtain a capsulated toner having an average particle diameter of 7 $\mu$m.

This capsulated toner was treated by the same procedure as that used in working example 2-1 to prepare the toner of the present invention.

Where resin 2C was not used to polymerize the resin particle, a Tg thereof was 55° C. which is the same as that of working example 2-1. It means that a core of the capsulated toner obtained in this working example has a Tg of 55° C.

The toner was charged in LED Printer, OKI MIKROLINE16n and used in printing. A fixation percentage thereof was measured. A temperature of a fixation device (a heat-roller) was set at 130° C. which is the same as that of working example 2-1. The result is shown in Table 2. The capsulated toner of this working example indicated a good fixation.

A blocking resistance of the toner was determined by the same method as that of working example 2-1. As shown in working example 2-1, the capsulated toner of this working example caused no blocking and indicated a very good blocking resistance.

As a result of the test mentioned above, it is confirmed that the capsulated toner of this working example has a good fixation and a very good stability in preservation, can be clearly applicable to a non-contacting development, which does not tend to apply a mechanical pressure thereto, and further sufficiently applicable to a contacting development which tends to apply a high pressure thereto.

Working Example 2-4

100 Parts by weight of methyl methacrylate and 3 parts by weight of 2,2'-azo bis-isobutyronitrile were put into a two litter-four neck-glass flask which was equipped with a thermometer, a stainless steel stirring rod, a reflux condenser, and a nitrogen inlet tube. The flask was placed in a heating mantle and the mixture therein was reacted at 100° C. The polymerization product was occasionally sampled during the reaction to measure a Tg thereof. The reaction was ceased when the Tg of the polymerization product reached 60° C. The Tg was measured by differential scanning calorimeter (Type of "DSC220", manufactured by Seiko electronic industry Co., Ltd.). The resin thus obtained was designated as resin 2D. It was confirmed that the Tg of polymerization product was 100° C., where the reaction time of this polymerization was sufficiently extended.

The following mixture was put into an attritor ("MA-01SC" manufactured by Mitsui Miike Engineering Corp.) and dispersed at 15° C. for 10 hrs. to prepare a polymerizable composition.

| Component of mixture: | |
|---|---|
| Styrene: | 77.5 parts by weight |
| n-butyl acrylate: | 22.5 parts by weight |
| Resin 2D | 0.25 part by weight |
| Low molecular weight polyethylene: (used as an offset preventing agent) | 1.5 part by weight |
| Electrostatic preventing agent: ("Aizensupiro black TRH" manufactured by Hodogaya Chemical Co. Ltd.) | 1 part by weight |
| Carbon black ("Printexl" manufactured by Degusa Co. Ltd.) | 7 parts by weight |
| 2,2'-Azo bis-isobutyronitrile | 1 part by weight |

8 Parts by weight of polyacrylate and 0.35 part by weight of divinylbenzen were dissolved in 180 parts by weight of ethanol. 600 Parts by weight of distilled water was added to the mixture to prepare a dispersion medium. The polymerizable composition was added to the mixture and dispersed at 15° C. for 10 minutes at a rate of 8,000 r.p.m in a TK homomixer ("M Type" manufactured by Tokusyu Kika Kogyo Co., Ltd.). The resultant dispersion was put into a separable-one litter flask and reacted at 85° C. for 12 hrs. under a nitrogen flow with stirring at a rate of 100 r.p.m. After cooling the reaction mixture, the dispersion medium was dissolved with a 0.5 N aqueous hydrochloride acid solution and the mixture was filtrated. The residue thus obtained was washed with water, air-dried, dried at 40° C. for 10 hrs. under a reduced pressure of 10 mmHg and classified by air classifier to obtain a capsulated toner having an average particle diameter of 7 $\mu$m.

This capsulated toner was treated by the same procedure as that used in working example 2-1 to prepare the toner of the present invention.

Where resin 2D was not used to polymerize the resin particle, a Tg thereof was 55° C. which is the same as that of working example 2-1. It means that a core of the capsulated toner obtained in this working example has a Tg of 55° C.

The toner was charged in LED Printer, OKI MIKROLINE16n and used in printing. A fixation percentage thereof was measured. A temperature of a fixation device (a heat-roller) was set at 130° C. which is the same as that of working example 2-1. The result is shown in Table 2. The capsulated toner of this working example indicated a good fixation.

A blocking resistance of the toner was determined by the same method as that of working example 2-1. As shown in working example 2-1, the capsulated toner of this working example caused no blocking and indicated a very good blocking resistance.

As a result of the test mentioned above, it is confirmed that the capsulated toner of this working example has a good fixation and a very good stability in preservation, can be clearly applicable to a non-contacting development, which does not tend to apply a mechanical pressure thereto, and further sufficiently applicable to a contacting development which tends to apply a high pressure thereto.

Comparative Example 2-1

The following mixture was put into an attritor ("MA-01SC" manufactured by Mitsui Miike Engineering Corp.) and dispersed at 15° C. for 10 hrs. to prepare a polymerizable composition.

| Component of mixture: | |
|---|---|
| Styrene: | 77.5 parts by weight |
| n-butyl acrylate: | 22.5 parts by weight |
| Low molecular weight polyethylene: (used as an offset preventing agent) | 1.5 part by weight |
| Electrostatic preventing agent: ("Aizensupi1ro black TRH" manufactured by Hodogaya Chemical Co. Ltd.) | 1 part by weight |
| Carbon black ("Printexl" manufactured by Degusa Co. Ltd.) | 7 parts by weight |
| 2,2'-Azo bis-isobutyronitrile | 1 part by weight |

8 Parts by weight of polyacrylate and 0.35 part by weight of divinylbenzen were dissolved in 180 parts by weight of ethanol. 600 Parts by weight of distilled water was added to the mixture to prepare a dispersion medium. The polymerizable composition was added to the mixture and dispersed at 15° C. for 10 minutes at a rate of 8,000 r.p.m in a TK homomixer ("M Type" manufactured by Tokusyu Kika Kogyo Co., Ltd.). The resultant dispersion was put into a separable-one litter flask and reacted at 85° C. for 12 hrs. under a nitrogen flow with stirring at a rate of 100 r.p.m.

8.25 Parts by weight of methyl methacrylate, 1.75 part by weight of n-butyl acrylate, 0.5 part by weight of 2,2'-azo bis-isobutyronitrile, 0.1 part by weight of sodium laurylsulfate, and 80 parts by weight of water were mixed and the mixture was treated by ultrasonic generator ("US-150", Nippon Seiki Industry Co., Ltd.) to prepare aqueous emulsion E. 9 Parts by weight of aqueous emulsion E was dripped to the aqueous suspension of the intermediate particles to enlarge the particles. Just after dripping, the aqueous suspension was observed by optical microscope to see no droplet of the emulsion. It was therefore confirmed that the enlargement had done for a very short time. The suspension was therefore reacted as the second polymerization at 85° C. for 10 hrs. under a nitrogen atmosphere with stirring.

After cooling the reaction mixture, the dispersion medium was dissolved with a 0.5 N aqueous hydrochloride acid solution and the mixture was filtrated. The residue thus obtained was washed with water, air-dried, dried at 40° C. for 10 hrs. under a reduced pressure of 10 mmHg and classified by air classifier to obtain a capsulated toner having an average particle diameter of 7 μm.

This capsulated toner was treated by the same procedure as that used in working example 2-1 to prepare the toner of the present invention.

A Tg of the resin particle obtained before the seeding polymerization was 55° C. It means that a core of the capsulated toner obtained in this example has a Tg of 55° C.

The thermoplastic resin obtained by the polymerization of aqueous emulsion E alone has a Tg of 65° C. It means that a shell of the capsulated toner obtained in this example has a Tg of 65° C.

The toner was charged in LED Printer, OKI MIKROLINE16n and used in printing. A fixation percentage thereof was measured. A temperature of a fixation device (a heat-roller) was set at 130° C. which is the same as that of working example 2-1. The result is shown in Table 2. The capsulated toner of this example indicated a good fixation.

A blocking resistance of the toner was determined by the same method as that of working example 2-1. Since the capsulated toner of this example causes a terrible blocking, the toner appeared not to be practically useful.

Comparative Example 2-2

82.5 Parts by weight of methyl methacrylate, 17.5 part by weight of n-butyl acrylate and 3 parts by weight of 2,2'-azo bis-isobutyronitrile were put into a two litter-four neck-glass flask which was equipped with a thermometer, a stainless steel stirring rod, a reflux condenser, and a nitrogen inlet tube. The flask was placed in a heating mantle and the mixture therein was reacted at 100° C. under a nitrogen flow. The polymerization product was occasionally sampled during the reaction to measure a Tg thereof. The reaction was ceased when the Tg of the polymerization product reached 60° C. The Tg was measured by differential scanning calorimeter (Type of "DSC220", manufactured by Seiko electronic industry Co., Ltd.). The resin thus obtained was designated as resin 2F. It was confirmed that the Tg of polymerization product was 65° C., where the reaction time of this polymerization was sufficiently extended.

The following mixture was put into an attritor ("MA-01SC" manufactured by Mitsui Miike Engineering Corp.) and dispersed at 15° C. for 10 hrs. to prepare a polymerizable composition.

| Component of mixture: | |
|---|---|
| Styrene: | 77.5 parts by weight |
| n-butyl acrylate: | 22.5 parts by weight |
| Resin 2F | 0.25 part by weight |
| Low molecular weight polyethylene: (used as an offset preventing agent) | 1.5 part by weight |
| Electrostatic preventing agent: ("Aizensupiro black TRH" manufactured by Hodogaya Chemical Co. Ltd.) | 1 part by weight |
| Carbon black: ("Printexl" manufactured by Degusa Co. Ltd.) | 7 parts by weight |
| 2,2'-Azo bis-isobutyronitrile | 1 part by weight |

8 Parts by weight of polyacrylate and 0.35 part by weight of divinylbenzen were dissolved in 180 parts by weight of ethanol. 600 Parts by weight of distilled water was added to the mixture to prepare a dispersion medium. The polymerizable composition was added to the mixture and dispersed at 15° C. for 10 minutes at a rate of 8,000 r.p.m in a TK homomixer ("M Type" manufactured by Tokusyu Kika Kogyo Co., Ltd.). The resultant dispersion was put into a separable-one litter flask and reacted at 85° C. for 12 hrs. under a nitrogen flow with stirring at a rate of 100 r.p.m.

After cooling the reaction mixture, the dispersion medium was dissolved with a 0.5 N aqueous hydrochloride acid solution and the mixture was filtrated. The residue thus obtained was washed with water, air-dried, dried at 40° C. for 10 hrs. under a reduced pressure of 10 mmHg and classified by air classifier to obtain a capsulated toner having an average particle diameter of 7 μm.

This capsulated toner was treated by the same procedure as that used in working example 2-1 to prepare the toner of the present invention.

Where resin 2F was not used to polymerize the resin particle, a Tg thereof was 55° C. which is the same as that of working example 2-1. It means that a core of the capsulated toner obtained in this working example has a Tg of 55° C.

The toner was charged in LED Printer, OKI MIKROLINE16n and used in printing. A fixation percentage thereof was measured. A temperature of a fixation device (a heat-roller) was set at 130° C. which is the same as that of working example 2-1. The result is shown in Table 2. The capsulated toner of this example indicated a good fixation.

A blocking resistance of the toner was determined by the same method as that of working example 2-1. Since the capsulated toner of this example causes a terrible blocking, the toner appeared not to be practically useful.

TABLE 2

| | Tg. of Core resin (° C.) | Resin | Tg of shell resin (° C.) | Blocking percentage (%) | Fixation |
|---|---|---|---|---|---|
| Ex. 2-1 | 55 | — | 70 | 0 | ⊙ |
| Ex. 2-2 | 55 | — | 100 | 0 | ⊙ |
| Ex. 2-3 | 55 | 2C | — | 0 | ⊙ |
| Ex. 2-4 | 55 | 2D | — | 0 | ⊙ |

TABLE 2-continued

| | Tg. of Core resin (° C.) | Resin | Tg of shell resin (° C.) | Blocking percent-age (%) | Fixation |
|---|---|---|---|---|---|
| Com ex. 2-1 | 55 | — | 65 | 80 | ⊙ |
| Com ex. 2-2 | 55 | 2F | — | 70 | ⊙ |

*Ex. in the table means a working example.
*Com. ex. in the table means a comparative example.

Working Example 3-1

Working examples 3-1 to 3-2 and comparative examples 3-1 to 3-2 mainly illustrate embodiment 3 of the present invention in detail.

The following mixture was put into an attritor ("MA-01SC" manufactured by Mitsui Miike Engineering Corp.) and dispersed at 15° C. for 10 hrs. to prepare a polymerizable composition.

| Component of mixture: | |
|---|---|
| Styrene: | 77.5 parts by weight |
| n-butyl acrylate: | 22.5 parts by weight |
| Low molecular weight polyethylene: (used as an offset preventing agent) | 1.5 part by weight |
| Electrostatic preventing agent: ("Aizensupiro black TRH" manufactured by Hodogaya Chemical Corp.) | 1 part by weight |
| Carbon black ("Printexl" manufactured by Degusa Co. Ltd.) | 7 parts by weight |
| 2,2'-Azo bis-isobutyronitrile | 1 part by weight |

8 Parts by weight of polyacrylate and 0.35 part by weight of divinylbenzen were dissolved in 180 parts by weight of ethanol. 600 Parts by weight of distilled water was added to the mixture to prepare a dispersion medium. The polymerizable composition was added to the mixture and dipersed at 15° C. for 10 minutes at a rate of 8,000 r.p.m in a TK homomixer ("M Type" manufactured by Tokusyu Kika Kogyo Co., Ltd.). The resultant dispersion was put into a separable-one litter flask and reacted at 85° C. for 12 hrs. under a nitrogen flow with stirring at a rate of 100 r.p m. The dispersion obtained by polymerization of the polymerizable composition in these steps is referred to as "intermediate particle" hereinbelow.

8.5 Parts by weight of methyl methacrylate, 1.5 part by weight of n-butyl acrylate, 0.5 part by weight of 2,2'-azo bis-isobutyronitrile (used as a polymerization initiator), 0.1 part by weight of sodium laurylsulfate, and 80 parts by weight of water were mixed and the mixture was treated by ultrasonic generator ("US-150", Nippon Seiki Industry Co., Ltd.) to prepare aqueous emulsion A. 4 Parts by weight of aqueous emulsion A was dripped to the aqueous suspension of the intermediate particles to enlarge the particles. Just after dripping, the aqueous suspension was observed by optical microscope to see no droplet of the emulsion. It was therefore confirmed that the enlargement had done for a very short time.

The suspension was further reacted as the second polymerization at 85° C. for 10 hrs. under a nitrogen atmosphere with stirring. After cooling the reaction mixture, the dispersion medium was dissolved with a 0.5 N aqueous hydrochloride acid solution and the mixture was filtrated. The residue thus obtained was washed with water, air-dried, dried at 40° C. for 10 hrs. under a reduced pressure of 10 mmHg and classified by air classifier to obtain a capsulated toner having an average particle diameter of 7 $\mu$m.

A Tg of the resin particle obtained before the seeding polymerization was 55° C. It means that a core of the capsulated toner obtained in this working example has a Tg of 55° C.

The thermoplastic resin obtained by the polymerization of aqueous emulsion A alone has a Tg of 70° C. It means that a shell of the capsulated toner obtained in this working example has a Tg of 70° C.

0.35 Parts by weight of a fine powder of a hydrophobic silica "Aerosil R-972" (manufactured by Japan Aerosil Co., Lid.) was mixed with 50 parts by weight of the resultant capsulated toner to obtain the capsulate toner of the present invention.

The toner was charged in LED Printer OKI MIKROLINE16n and used in printing. A fixation percentage thereof was measured. A temperature of a fixation device (a heat-roller) was set at 130° C. The result is shown in Table 3.

The fixation percentage is defined by the following equation.

Fixation percentage (%)=(image density after rubbing/image density before rubbing)×100

The term "image density before rubbing" means an image density of a solid color of print which is measured by Macbeth densitometer. The term "image density after rubbing" means an image density which is retained on a print after Scotch-tape is overlaid on a solid color of the print, applied a load of 50 g/cm$^2$ to a given area by reciprocation action and removed from the print at a rate of 3 cm/sec.

The fixation percentage thus measured is classified in the following manner and summarized in Table 3.

Fixation percentage 90 to 100% ⊙: 50 to 90% ○: 0 to 50% X

The capsulated toner of this working example indicates a good fixation.

A blocking resistance of the toner was determined by the following method. A cylindrical container having a bottom of 20 cm$^2$ was charged with 20 grams of the toner sample, capped and given a pressure of 500 g/cm$^2$ by weight. The toner was kept at 50° C. in this condition for a month. All of the sample toner (20 g) was transferred onto a sieve of 45 $\mu$m mesh, vibrated at a rate of 1 KHz for 30 seconds and then the toner retained on the sieve was weighed. A blocking percentage (%) is defined by the following equation.

Blocking percentage (%)=Weight of toner retained on sieve (g)/Weight of sample toner (g)×100

The capsulated toner of this working example caused no blocking and indicated a very good stability in preservation.

As a result of the test mentioned above, it is confirmed that the capsulated toner of this working example has a good fixation and a very good stability in preservation, can be clearly applicable to a non-contacting development, which does not tend to apply a mechanical pressure thereto, and further sufficiently applicable to a contacting development which tends to apply a comparatively high pressure thereto.

Working Example 3-2

The following mixture was put into an attritor ("MA-01SC" manufactured by Mitsui Miike Engineering Corp.)

and dispersed at 10° C. for 6 hrs. to prepare a polymerizable composition.

| Component of mixture: | |
|---|---|
| Styrene: | 77.5 parts by weight |
| n-butyl acrylate: | 22.5 parts by weight |
| Low molecular weight polyethylene: (used as an offset preventing agent) | 1.5 part by weight |
| Electrostatic preventing agent: ("TRH" manufactured by Hodogaya Chemical Corp.) | 1 part by weight |
| Carbon black ("Printexl" manufactured by Degusa Co. Ltd.) | 7 parts by weight |
| 2,2'-Azo bis-isobutyronitrile (used as an polymerization initiator) | 1 part by weight |

8 Parts by weight of polyacrylate (dispersant) and 0.35 part by weight of divinylbenzen (crosslinking agent) were dissolved in 180 parts by weight of ethanol. 600 Parts by weight of distilled water was added to the mixture to prepare a dispersion medium. The polymerizable composition was added to the dispersion medium and dispersed at 10° C. for 10 minutes at a rate of 10,000 r.p.m in a TK homomixer ("M type" manufactured by Tokusyu Kika Kogyo Co., Ltd.). The resultant dispersion was put into a separable-one litter flask and reacted at 80° C. for 10 hrs. under a nitrogen flow with stirring at a rate of 150 r.p.m.

8.5 Parts by weight of methyl methacrylate, 1.5 part by weight of n-butyl acrylate, 0.5 part by weight of 2,2'-azo bis-isobutyronitrile (AIBN is oil soluble.), 0.1 part by weight of sodium laurylsulfate, and 80 parts by weight of water were mixed to prepare aqueous emulsion A. 4 Parts by weight of aqueous emulsion A was dripped to the aqueous suspension of the intermediate particles to enlarge the particles. Just after dripping, the aqueous suspension was observed by optical microscope to see no droplet of the emulsion. It was therefore confirmed that the enlargement had done for a very short time.

The suspension was further reacted as the second polymerization at 85° C. for 10 hrs. under a nitrogen atmosphere with stirring. After cooling the reaction mixture, the dispersion medium was dissolved with a 1 N aqueous hydrochloride acid solution and the mixture was filtrated. The residue thus obtained was washed with water, air-dried, dried at 40° C. for 12 hrs. under a reduced pressure of 20 mmHg and classified by air classifier to obtain a capsulated toner having an average particle diameter of 7 $\mu$m.

A Tg of the resin particle obtained before the seeding polymerization was 55° C. That is, it means that a core of the capsulated toner obtained in this working example has a Tg of 55° C.

The thermoplastic resin obtained by polymerization of aqueous emulsion A alone has a Tg of 70° C. That is, it means that the shell resin of the capsulated toner obtained in this working example has a Tg of 70° C.

0.35 Part by weight of a fine powder of a hydrophobic silica "Aerosil R-972" (manufactured by Japan Aerosil Co., Lid.) was mixed with 50 parts by weight of the resultant capsulated toner to obtain the capsulated toner of the present invention.

The toner was charged in LED Printer OKI MIKROLINE16n and used in printing. A fixation percentage thereof was measured. A temperature of a fixation device (a heat-roller) was set at 130° C. The result is shown in Table 3. The capsulated toner of this working example indicates a fixation of 100%.

A blocking resistance of the toner was determined one month after it was kept at 50° C. under a pressure of 500 g/cm$^2$ . The blocking property is shown in Table 3. The capsulated toner of this working example caused no blocking and indicated a very good blocking resistance.

As a result of the test mentioned above, it is confirmed that the capsulated toner of this working example has a good fixation and a very good stability in preservation, can be clearly applicable to a non-contacting development, which does not tend to apply a mechanical pressure thereto, and further sufficiently applicable to a contacting development which tends to apply a high pressure thereto.

Working Example 3-3

The following mixture was put into an attritor ("MA-01SC" manufactured by Mitsui Miike Engineering Corp.) and dispersed at 15° C. for 10 hrs. to prepare a polymerizable composition.

| Component of mixture: | |
|---|---|
| Styrene: | 77.5 parts by weight |
| n-butyl acrylate: | 22.5 parts by weight |
| Low molecular weight polyethylene: (used as an offset preventing agent) | 1.5 part by weight |
| Electrostatic preventing agent: ("TRH" manufactured by Hodogaya Chemical Corp.) | 1 part by weight |
| Carbon black ("Printexl" manufactured by Degusa Co. Ltd.) | 7 parts by weight |
| 2,2'-Azo bis-isobutyronitrile (used as an polymerization initiator) | 1 part by weight |

8 Parts by weight of polyacrylate and 0.35 part by weight of divinylbenzen were dissolved in 180 parts by weight of ethanol. 600 Parts by weight of distilled water was added to the mixture to prepare a dispersion medium. The polymerizable composition was added to the dispersion medium and dispersed at 15° C. for 10 minutes at a rate of 8,000 r.p.m in a TK homomixer ("M type" manufactured by Tokusyu Kika Kogyo Co., Ltd.). The resultant dispersion was put into a separable-one litter flask and reacted at 85° C. for 12 hrs. under a nitrogen flow with stirring at a rate of 100 r.p.m. The dispersoid obtained by polymerization of the polymerizable composition in these steps is referred to as "intermediate particle" hereinbelow.

0.1 Part by weight of aqueous emulsion A prepared in working example 3-1 was dripped to the aqueous suspension of the intermediate particles to enlarge the particles. Just after dripping, the aqueous suspension was observed by optical microscope to see no droplet of the emulsion. It was therefore confirmed that the enlargement had done for a very short time.

The suspension was further reacted as the second polymerization at 85° C. for 10 hrs. under a nitrogen atmosphere with stirring. After cooling the reaction mixture, the dispersion medium was dissolved with a 1 N aqueous hydrochloride acid solution and the mixture was filtrated. The residue thus obtained was washed with water, air-dried, dried at 40° C. for 12 hrs. under a reduced pressure of 20 mmHg and classified by air classifier to obtain a capsulated toner having an average particle diameter of 7 $\mu$m.

This toner was treated by the same procedure as that used in working example 3-1 to prepare the toner of the present invention.

A Tg of the resin particle obtained before the seeding polymerization was 55° C. which was the same as that of working example 3-1. That is, it means that a core of the capsulated toner obtained in this working example has a Tg of 55° C.

The toner was charged in LED Printer OKI MIKROLINE16n and used in printing. A fixation percentage thereof was measured. A temperature of a fixation device (a heat-roller) was set at 130° C. which was the same as that of working example 3-1. The result is shown in Table 3. The capsulated toner of this working example indicates a good fixation.

A blocking resistance of the toner was determined by the same method as that of working example 3-1. As shown in working example 3-1, the capsulated toner of this working example caused no blocking and indicated a very good blocking resistance. As a result of the test mentioned above, it is confirmed that the capsulated toner of this working example has a good fixation and a very good stability in preservation, can be clearly applicable to a non-contacting development, which does not tend to apply a mechanical pressure thereto, and further sufficiently applicable to a contacting development which tends to apply a high pressure thereto.

Comparative Example 3-1

The following mixture was put into an attritor ("MA-01SC" manufactured by Mitsui Miike Engineering Corp.) and dispersed at 15° C. for 10 hrs. to prepare a polymerizable composition.

| Component of mixture: | |
|---|---|
| Styrene: | 77.5 parts by weight |
| n-butyl acrylate: | 22.5 parts by weight |
| Low molecular weight polyethylene: (used as an offset preventing agent) | 1.5 part by weight |
| Electrostatic preventing agent: ("Aizensupiro black TRH" manufactured by Hodogaya Chemical Co. Ltd.) | 1 part by weight |
| Carbon black ("Printexl" manufactured by Degusa Co. Ltd.) | 7 parts by weight |
| 2,2'-Azo bis-isobutyronitrile | 1 part by weight |

8 Parts by weight of polyacrylate and 0.35 part by weight of divinylbenzen were dissolved in 180 parts by weight of ethanol. 600 Parts by weight of distilled water was added to the mixture to prepare a dispersion medium. The polymerizable composition was added to the medium and dispersed at 15° C. for 10 minutes at a rate of 8,000 r.p.m in a TK homomixer ("M Type" manufactured by Tokusyu Kika Kogyo Co., Ltd.). The resultant dispersion was put into a separable-one litter flask and reacted at 85° C. for 12 hrs. under a nitrogen flow with stirring at a rate of 100 r.p.m. The dispersoid obtained by polymerization of the polymerizable composition in these steps is referred to as "intermediate particle" hereinbelow.

0.05 Part by weight of aqueous emulsion A prepared in working example 3-1 was dripped to the aqueous suspension of the intermediate particles to enlarge the particles. Just after dripping, the aqueous suspension was observed by optical microscope to see no droplet of the emulsion. It was therefore confirmed that the enlargement had done for a very short time. The suspension was further reacted as the second polymerization at 85° C. for 10 hrs. under a nitrogen atmosphere with stirring. After cooling the reaction mixture, the dispersion medium was dissolved with a 1 N aqueous hydrochloride acid solution and the mixture was filtrated. The residue thus obtained was washed with water, air-dried, dried at 40° C. for 12 hrs. under a reduced pressure of 20 mmHg and classified by air classifier to obtain a capsulated toner having an average particle diameter of 7 $\mu$m.

This capsulated toner was treated by the same procedure as that used in working example 3-1 to prepare the toner of the present invention.

A Tg of the resin particle obtained before the seeding polymerization was 55° C. It means that a core of the capsulated toner obtained in this example has a Tg of 55° C.

The toner was charged in LED Printer, OKI MIKROLINE16n and used in printing. A fixation percentage thereof was measured. A temperature of a fixation device (a heat-roller) was set at 130° C. which is the same as that of working example 3-1. The result is shown in Table 3. The capsulated toner of this example indicated a good fixation.

A blocking resistance of the toner was determined by the same method as that of working example 3-1. Since the capsulated toner of this example causes a terrible blocking, the toner appeared not to be practically useful.

Comparative Example 3-2

The following mixture was put into an attritor ("MA-01SC" manufactured by Mitsui Miike Engineering Corp.) and dispersed at 15° C. for 10 hrs. to prepare a polymerizable composition.

| Component of mixture: | |
|---|---|
| Styrene: | 77.5 parts by weight |
| n-butyl acrylate: | 22.5 parts by weight |
| Low molecular weight polyethylene: (used as an offset preventing agent) | 1.5 part by weight |
| Electrostatic preventing agent: ("TRH" manufactured by Hodogaya Chemical Corp.) | 1 part by weight |
| Carbon black ("Printexl" manufactured by Degusa Co. Ltd.) | 7 parts by weight |
| 2,2'-Azo bis-isobutyronitrile | 1 part by weight |

8 Parts by weight of polyacrylate and 0.35 part by weight of divinylbenzen were dissolved in 180 parts by weight of ethanol. 600 Parts by weight of distilled water was added to the mixture to prepare a dispersion medium. The polymerizable composition was added to the dispersion medium and dispersed at 15° C. for 10 minutes at a rate of 8,000 r.p.m in a TK homomixer ("M type" manufactured by Tokusyu Kika Kogyo Co., Ltd.). The resultant dispersion was put into a separable-one litter flask and reacted at 85° C. for 12 hrs. under a nitrogen flow with stirring at a rate of 100 r.p.m. The dispersoid obtained by polymerization of the polymerizable composition in these steps is referred to as "intermediate particle" hereinbelow.

5 Parts by weight of aqueous emulsion A prepared in working example 3-1 was dripped to the aqueous suspension of the intermediate particles to enlarge the particles. Just after dripping, the aqueous suspension was observed by optical microscope to see no droplet of the emulsion. It was therefore confirmed that the enlargement had done for a very short time. The suspension was further reacted as the second polymerization at 85° C. for 10 hrs. under a nitrogen atmosphere with stirring. After cooling the reaction mixture, the dispersion medium was dissolved with a 1 N aqueous hydrochloride acid solution and the mixture was filtrated.

The residue thus obtained was washed with water, air-dried, dried at 40° C. for 12 hrs. under a reduced pressure of 20 mmHg and classified by air classifier to obtain a capsulated toner having an average particle diameter of 7 μm.

This capsulated toner was treated by the same procedure as that used in working example 3-1 to prepare the toner of the present invention. A Tg of the resin particle obtained before the seeding polymerization was 55° C. It means that a core of the capsulated toner obtained in this example has a Tg of 55° C.

The toner was charged in LED Printer, OKI MIKROLINE16n and used in printing. A fixation percentage thereof was measured. A temperature of a fixation device (a heat-roller) was set at 130° C. which is the same as that of working example 3-1. The result is shown in Table 3. The capsulated toner of this example indicated a good fixation. A blocking resistance of the toner was determined by the same method as that of working example 3-1. The capsulated toner of this example does not cause a terrible blocking and the toner had a good blocking resistance. However a quality of printing was poor and a fog was generated in a background.

TABLE 3

| | Tg. of core resin (° C.) | Shell polymeriz--able monomer (Part by weight) | blocking percentage (%) | Fixation | Fog |
|---|---|---|---|---|---|
| Ex. 3-1 | 55 | 4 | 0 | ◎ | Good |
| Ex. 3-2 | 55 | 0.1 | 0 | ◎ | Good |
| Com ex.3-1 | 55 | 0.05 | 80 | ◎ | Good |
| Com ex.3-2 | 55 | 5 | 70 | ◎ | Bad |

*Ex. in the table means a working example.
*Com. ex. in the table means a comparative example.

Working Example 4-1

Working examples 4-1 to 4-2 and comparative examples 4-1 to 4-2 mainly illustrate embodiment 4 of the present invention in detail.

The following mixture was put into an attritor ("MA-01SC" manufactured by Mitsui Miike Engineering Corp.) and dispersed at 15° C. for 10 hrs. to prepare a polymerizable composition.

| Component of mixture: | |
|---|---|
| Styrene: | 77.5 parts by weight |
| n-butyl acrylate: | 22.5 parts by weight |
| Low molecular weight polyethylene: (used as an offset preventing agent) | 1.5 part by weight |
| Electrostatic preventing agent: ("Aizensupiro black TRH" manufactured by Hodogaya Chemical Corp.) | 1 part by weight |
| Carbon black ("Printexl" manufactured by Degusa Co. Ltd.) | 7 parts by weight |
| 2,2'-Azo bis-isobutyronitrile | 1 part by weight |

8 Parts by weight of polyacrylate and 0.35 part by weight of divinylbenzen were solved in 180 parts by weight of ethanol. 600 Parts by weight of distilled water was added to the mixture to prepare a dispersion medium. The polymerizable composition was added to the medium and dispersed at 15° C. for 10 minutes at a rate of 8,000 r.p.m in a TK homomixer ("M Type" manufactured by Tokusyu Kika Kogyo Co., Ltd.). The resultant dispersion was put into a separable-one litter flask and reacted at 85° C. for 12 hours under a nitrogen flow with stirring at a rate of 100 r.p.m. The dispersoid obtained by polymerization of the polymerizable composition in these steps is referred to as "intermediate particle" hereinbelow.

8.5 Parts by weight of methyl methacrylate, 1.5 part by weight of n-butyl acrylate, 0.4 part by weight of 2,2'-azo bis-isobutyronitrile (used as a polymerization initiator), 0.1 part by weight of sodium laurylsulfate, and 80 parts by weight of water were mixed to prepare aqueous emulsion A. 9 Parts by weight of aqueous emulsion A was dripped to the aqueous suspension of the intermediate particles to enlarge the particles. Just after dripping, the aqueous suspension was observed by optical microscope to see no droplet of the emulsion. It was therefore confirmed that the enlargement had done for a very short time.

The suspension was further reacted as the second polymerization at 85° C. for 10 hrs. under a nitrogen atmosphere with stirring. After cooling the reaction mixture, the dispersion medium was dissolved with a 0.5 N aqueous hydrochloride acid solution and the mixture was filtrated. The residue thus obtained was washed with water, air-dried, dried at 40° C. for 10 hrs. under a reduced pressure of 10 mmHg and classified by air classifier to obtain a capsulated toner having an average particle diameter of 7 μm.

A Tg of the resin particle obtained before the seeding polymerization was 55° C. It means that a core of the capsulated toner obtained in this working example has a Tg of 55° C.

The thermoplastic resin obtained by polymerization of aqueous emulsion A alone has a Tg of 70° C. It means that a shell of the capsulated toner obtained in this working example has a Tg of 70°0 C.

0.35 Parts by weight of a fine powder of hydrophobic silica "Aerosil R-972" (manufactured by Japan Aerosil Co., Lid.) was mixed with 50 parts by weight of the resultant capsulated toner to obtain the capsulated toner of the present invention.

The toner was charged in LED Printer OKI MIKROLINE16n and used in printing. A fixation percentage thereof was measured. A temperature of a fixation device (a heat-roller) was set at 130° C. The result is shown in Table 4.

The fixation percentage is defined by the following equation.

Fixation percentage (%)=(image density after rubbing/image density before rubbing)×100

The term "image density before rubbing" means an image density of a solid color of print which is measured by Macbeth densitometer. The term "image density after rubbing" means an image density which is retained on a print after Scotch-tape is overlaid on a solid color of the print, applied a load of 50 g/cm$^2$ to a given area by reciprocation and removed from the print at a rate of 3 cm/sec.

The fixation percentage thus measured is classified in the following manner and summarized in Table 4.

Fixation percentage 90 to 100% ◎: 50 to 90% ○: 0 to 50% X

The capsulated toner of this working example indicates a good fixation.

A blocking resistance of the toner was determined by the following method. A cylindrical container having a bottom of 20 $cm^2$ was charged with 20 grams of the toner sample, capped and given a pressure of 500 $g/cm^2$ by weight. The toner was kept at 50° C. in this condition for a month. All of the sample toner (20 g) was transferred onto a sieve of 45 $\mu$m mesh, vibrated at a rate of 1 KHz for 30 seconds and then the toner retained on the sieve was weighed.

A blocking percentage (%) is defined by the following equation.

Blocking percentage (%)=Weight of toner retained on sieve (g)/Weight of sample toner (g)×100

The capsulated toner of this working example caused no blocking and indicated a very good stability in preservation.

As a result of the test mentioned above, it is confirmed that the capsulated toner of this working example has a good fixation and a very good stability in preservation, can be clearly applicable to a non-contacting development, which does not tend to apply a mechanical pressure thereto, and further sufficiently applicable to a contacting development which tends to apply a comparatively high pressure thereto.

Working Example 4-2

The following mixture was put into an attritor ("MA-01SC" manufactured by Mitsui Miike Engineering Corp.) and dispersed at 15° C. for 10 hrs. to prepare a polymerizable composition.

| Component of mixture: | |
|---|---|
| Styrene: | 77.5 parts by weight |
| n-butyl acrylate: | 22.5 parts byweight |
| Low molecular weight polyethylene: (used as an offset preventing agent) | 1.5 part by weight |
| Electrostatic preventing agent: ("Aizensupiro black TRH" manufactured by Hodogaya Chemical Corp.) | 1 part by weight |
| Carbon black ("Printexl" manufactured by Degusa Co. Ltd.) | 7 parts by weight |
| 2,2'-Azo bis-isobutyronitrile | 1 part by weight |

8 Parts by weight of polyacrylate and 0.35 part by weight of divinylbenzen were dissolved in 180 parts by weight of ethanol. 600 Parts by weight of distilled water was added to the mixture to prepare a dispersion medium. The polymerizable composition was added to the dispersion medium and dispersed at 15° C. for 10 minutes at a rate of 8,000 r.p.m in a TK homomixer ("M type" manufactured by Tokusyu Kika Kogyo Co., Ltd.). The resultant dispersion was put into a separable-one litter flask and reacted at 85° C. for 12 hrs. under a nitrogen flow with stirring at a rate of 100 r.p.m. The dispersoid obtained by polymerization of the polymerizable composition in these steps is referred to as "intermediate particle" hereinbelow.

8.5 Parts by weight of methyl methacrylate, 1.5 part by weight of n-butyl acrylate, 0.5 part by weight of 2,2'-azo bis-isobutyronitrile (polymerization initiator), 0.1 part by weight of sodium laurylsulfate, and 80 parts by weight of water were mixed to prepare aqueous emulsion B. 9 Parts by weight of aqueous emulsion B was dripped to the aqueous suspension of the intermediate particles to enlarge the particles. Just after dripping, the aqueous suspension was observed by optical microscope to see no droplet of the emulsion. It was therefore confirmed that the enlargement had done for a very short time. The suspension was further reacted as the second polymerization at 85° C. for 10 hrs. under a nitrogen atmosphere with stirring. After cooling the reaction mixture, the dispersion medium was dissolved with a 0.5 N aqueous hydrochloride acid solution and the mixture was filtrated. The residue thus obtained was washed with water, air-dried, dried at 40° C. for 10 hrs. under a reduced pressure of 10 mmHg and classified by air classifier to obtain a capsulated toner having an average particle diameter of 7 $\mu$m.

A Tg of the resin particle obtained before the seeding polymerization was 55° C. It means that a core of the capsulated toner obtained in this working example has a Tg of 55° C.

The thermoplastic resin obtained by polymerization of aqueous emulsion B alone has a Tg of 70° C. It means that the shell resin of the capsulated toner obtained in this working example has a Tg of 70° C.

The toner was treated with an additive in the same manner as that used in working example 4-1.

The toner was charged in LED Printer OKI MIKROLINE16n and used in printing. A fixation percentage thereof was measured. A temperature of a fixation device (a heat-roller) was set at 130° C. which is the same as that of working example 4-1. The result is shown in Table 4. The capsulated toner of this working example indicates a good fixation.

A blocking resistance of the toner was determined by the same method as that of working example 4-1. As shown in working example 4-1, the capsulated toner of this working example caused no blocking and indicated a very good blocking resistance.

As a result of the test mentioned above, it is confirmed that the capsulated toner of this working example has a good fixation and a very good stability in preservation, can be clearly applicable to a non-contacting development, which does not tend to apply a mechanical pressure thereto, and further sufficiently applicable to a contacting development which tends to apply a high pressure thereto.

Comparative Example 4-1

The following mixture was put into an attritor ("MA-01SC" manufactured by Mitsui Miike Engineering Corp.) and dispersed at 15° C. for 10 hrs. to prepare a polymerizable composition.

| Component of mixture: | |
|---|---|
| Styrene: | 77.5 parts by weight |
| n-butyl acrylate: | 22.5 parts by weight |
| Low molecular weight polyethylene: (used as an offset preventing agent) | 1.5 part by weight |
| Electrostatic preventing agent: ("Azensupiro black TRH" manufactured by Hodogaya Chemical Corp.) | 1 part by weight |
| Carbon black ("Printexl" manufactured by Degusa Co. Ltd.) | 7 parts by weight |
| 2,2'-Azo bis-isobutyronitrile | 1 part by weight |

8 Parts by weight of polyacrylate and 0.35 part by weight of divinylbenzen were dissolved in 180 parts by weight of ethanol. 600 Parts by weight of distilled water was added to the mixture to prepare a dispersion medium. The polymerizable composition was added to the dispersion medium and dispersed at 15° C. for 10 minutes at a rate of 8,000 r.p.m in a TK homomixer ("M type" manufactured by Tokusyu Kika Kogyo Co., Ltd.). The resultant dispersion was put into a separable-one litter flask and reacted at 85° C. for 12 hrs. under a nitrogen flow with stirring at a rate of 100 r.p.m. The dispersoid obtained by polymerization of the polymerizable composition in these steps is referred to as "intermediate particle" hereinbelow.

8.5 Parts by weight of methyl methacrylate, 1.5 part by weight of n-butyl acrylate, 0.5 part by weight of 2,2'-azo bis-isobutyronitrile (polymerization initiator), 0.1 part by weight of sodium laurylsulfate, and 80 parts by weight of water were mixed to prepare aqueous emulsion C. 9 Parts by weight of aqueous emulsion C was dripped to the aqueous suspension of the intermediate particles to enlarge the particles. Just after dripping, the aqueous suspension was observed by optical microscope to see no droplet of the emulsion. It was therefore confirmed that the enlargement had done for a very short time.

The suspension was further reacted as the second polymerization at 85° C. for 10 hrs. under a nitrogen atmosphere with stirring. After cooling the reaction mixture, the dispersion medium was dissolved with a 0.5 N aqueous hydrochloride acid solution and the mixture was filtrated. The residue thus obtained was washed with water, air-dried, dried at 40° C. for 10 hrs. under a reduced pressure of 10 mmHg and classified by air classifier to obtain a capsulated toner having an average particle diameter of 7 $\mu$m.

A Tg of the resin particle obtained before the seeding polymerization was 55° C. It means that a core of the capsulated toner obtained in this working example has a Tg of 55° C.

The thermoplastic resin obtained by polymerization of aqueous emulsion C alone had a Tg of 70° C. It means that the shell resin of the capsulated toner obtained in this working example has a Tg of 70° C.

The toner was treated with an additive in the same manner as that used in working example 4-1.

The toner was charged in LED Printer OKI MIKROLINE16n and used in printing. A fixation percentage thereof was measured. A temperature of a fixation device (a heat-roller) was set at 130° C. which is the same as that of working example 4-1. The result is shown in Table 4. The capsulated toner of this example indicates a good fixation.

A blocking resistance of the toner was determined by the same method as that of working example 4-1. The capsulated toner of this working example caused a high blocking, or a blocking ratio was 80%. That is, since the capsulated toner of this comparative example was bad at a blocking resistance, the toner appeared not to be practically useful.

Comparative Example 4-2

The following mixture was put into an attritor ("MA01SC" manufactured by Mitsui Miike Engineering Corp.) and dispersed at 15° C. for 10 hrs. to prepare a polymerizable composition.

| Component of mixture: | |
|---|---|
| Styrene: | 77.5 parts by weight |
| n-butyl acrylate: | 22.5 parts by weight |
| Low molecular weight polyethylene: (used as an offset preventing agent) | 1.5 part by weight |
| Electrostatic preventing agent: ("Aizensupiro black TRH" manufactured by | 1 part by weight |

-continued

| Component of mixture: | |
|---|---|
| Hodogaya Chemical Corp.) | |
| Carbon black ("Printexl" manufactured by Degusa Co. Ltd.) | 7 parts by weight |
| 2,2'-Azo bis-isobutyronitrile | 1 part by weight |

8 Parts by weight of polyacrylate and 0.35 part by weight of divinylbenzen were dissolved in 180 parts by weight of ethanol. 600 Parts by weight of distilled water was added to the mixture to prepare a dispersion medium. The polymerizable composition was added to the dispersion medium and dispersed at 15° C. for 10 minutes at a rate of 8,000 r.p.m in a TK homomixer ("M type" manufactured by Tokusyu Kika Kogyo Co., Ltd.). The resultant dispersion was put into a separable-one litter flask and reacted at 85° C. for 12 hrs. under a nitrogen flow with stirring at a rate of 100 r.p.m. The dispersoid obtained by polymerization of the polymerizable composition in these steps is referred to as "intermediate particle" hereinbelow.

8.5 Parts by weight of methyl methacrylate, 1.5 part by weight of n-butyl acrylate, 0.5 part by weight of 2,2'-azo bis-isobutyronitrile (polymerization initiator), 0.1 part by weight of sodium laurylsulfate, and 80 parts by weight of water were mixed to prepare aqueous emulsion D. 9 Parts by weight of aqueous emulsion D was dripped to the aqueous suspension of the intermediate particles to enlarge the particles. The suspension was then reacted as the second polymerization at 85° C. for 10 hrs. under a nitrogen atmosphere with stirring. After cooling the reaction mixture, the dispersion medium was dissolved with a 0.5 N aqueous hydrochloride acid solution and the mixture was filtrated. The residue thus obtained was washed with water, air-dried, dried at 40° C. for 10 hrs. under a reduced pressure of 10 mmHg and classified by air classifier to obtain a capsulated toner having an average particle diameter of 7 $\mu$m.

A Tg of the resin particle obtained before the seeding polymerization was 55° C. It means that a core of the capsulated toner obtained in this working example has a Tg of 55° C.

The thermoplastic resin obtained by polymerization of aqueous emulsion D alone had a Tg of 70° C. It means that the shell resin of the capsulated toner obtained in this working example has a Tg of 70° C.

The toner was treated with an additive in the same manner as that used in working example 4-1.

The toner was charged in LED Printer OKI MIKROLINE16n and used in printing. A fixation percentage thereof was measured. A temperature of a fixation device (a heat-roller) was set at 130° C. which is the same as that of working example 4-1. The result is shown in Table 4. The capsulated toner of this working example indicates a good fixation.

A blocking resistance of the toner was determined by the same method as that of working example 4-1. The capsulated toner of this example caused no blocking and indicated a very good blocking resistance. However there was a fog in a background and therefore the toner of this example did not provide a good printing property.

| | Polymerization Initiator for Shell (Part by weight) | Blocking percentage (%) | Fixation | Fog in background |
|---|---|---|---|---|
| Ex. 4-1 | 4 | 0 | ◎ | None |
| Ex. 4-2 | 15 | 0 | ◎ | None |
| Com ex.4-1 | 3 | 80 | ◎ | None |
| Com ex.4-2 | 20 | 0 | ◎ | Much |

*Ex. in the table means a working example.
*Com. ex. in the table means a comparative example.

Working Example 5-1

Working examples 5-1 to 5-4 and comparative examples 5-1 to 5-2 mainly illustrate embodiment 5 of the present invention in detail.

90 g of methyl methacrylate, 10 g of n-butyl acrylate and 3 g of 2,2'-azo bis-isobutyronitrile were put into a two litter-four neck-glass flask which was equipped with a thermometer, a stainless steel stirring rod, a reflux condenser, and a nitrogen inlet tube. The flask was placed in a heating mantle and the mixture therein was reacted at 100° C. The polymerization product was occasionally sampled during the reaction to measure a Tg thereof. The reaction was ceased when the Tg of the polymerization product reached 60° C. The Tg was measured by differential scanning calorimeter (Type of "DSC220", manufactured by Seiko electronic industry Co., Ltd.). The resin thus obtained was designated as resin 5A. It was confirmed that the Tg of polymerization product was 90° C., when the reaction time of this polymerization was sufficiently extended.

The following mixture was put into an attritor ("MA-01SC" manufactured by Mitsui Miike Engineering Corp.) and dispersed at 15° C. for 10 hrs. to prepare a polymerizable composition.

| Component of mixture: | |
|---|---|
| Styrene: | 72.5 parts by weight |
| n-butyl acrylate: | 22.5 parts by weight |
| Resin 5A | 0.25 part by weight |
| Low molecular weight polyethylene: (used as an offset preventing agent) | 1.5 part by weight |
| Electrostatic preventing agent: ("Aizensupiro black TRH" manufactured by Hodogaya Chemical Co. Ltd.) | 1 part by weight |
| Carbon black ("Printexl" manufactured by Degusa Co. Ltd.) | 7 parts by weight |
| 2,2'-Azo bis-isobutyronitrile | 1 part by weight |

8 Parts by weight of polyacrylate and 0.35 part by weight of divinylbenzen were dissolved in 180 parts by weight of ethanol. 600 Parts by weight of distilled water was added to the mixture to prepare a dispersion medium. The polymerizable composition was added to the medium and dispersed at 15° C. for 10 minutes at a rate of 8,000 r.p.m in a TK homomixer ("M Type" manufactured by Tokusyu Kika Kogyo Co., Ltd.). The resultant dispersion was put into a separable-one litter flask and reacted at 85° C. for 12 hrs. under a nitrogen flow with stirring at a rate of 100 r.p.m.

After cooling the reaction mixture, the dispersion medium was dissolved with a 0.5 N aqueous hydrochloride acid solution and the mixture was filtrated. The residue thus obtained was washed with water, air-dried, dried at 40° C. for 10 hrs. under a reduced pressure of 10 mmHg and classified by air classifier to obtain a capsulated toner having an average particle diameter of 7 $\mu$m.

0.35 Parts by weight of a fine powder of hydrophobic silica "Aerosil R-972" (manufactured by Japan Aerosil Co., Lid.) was mixed with 50 parts by weight of the resultant capsulated toner to obtain the capsulated toner of the present invention.

Where the same polymerization of working example 5-1, except for that resin A was not used, was done, the Tg of the resultant toner was 55° C. It means that the thermoplastic resin forming a core of the capsulated toner obtained in this working example has a Tg of 55° C.

The toner was charged in LED Printer OKI MIKROLINE16n and used in printing. A fixation percentage thereof was measured. A temperature of a fixation device (a heat-roller) was set at 130° C.

The fixation percentage is defined by the following equation.

Fixation percentage (%)=(image density after rubbing/image density before rubbing)×100

The term "image density before rubbing" means an image density of a solid color of print which is measured by Macbeth densitometer. The term "image density after rubbing" means an image density which is retained on a print after Scotch-tape is overlaid on a solid color of the print, applied a load of 50 g/cm$^2$ to a given area by reciprocation action and removed from the print at a rate of 3 cm/sec.

The fixation percentage thus measured is classified in the following manner and summarized in Table 5.

Fixation percentage 90 to 100% ◎: 50 to 90% ○: 0 to 50% X

The capsulated toner of this working example indicates a good fixation.

A blocking resistance of the toner was determined by the following method. A cylindrical container having a bottom of 20 cm$^2$ was charged with 20 grams of the toner sample, capped and given a pressure of 500 g/cm$^2$ by weight. The toner was kept at 50° C. in this condition for a month. All of the sample toner (20 g) was transferred onto a sieve of 45 $\mu$m mesh, vibrated at a rate of 1 KHz for 30 seconds and then the toner retained on the sieve was weighed.

A blocking percentage (%) is defined by the following equation.

Blocking percentage (%)=Weight of toner retained on sieve (g)/Weight of sample toner (g)×100

The capsulated toner of this working example caused no blocking and indicated a very good stability in preservation.

As a result of the test mentioned above, it is confirmed that the capsulated toner of this working example has a good fixation and a very good stability in preservation, can be clearly applicable to a non-contacting development, which does not tend to apply a mechanical pressure thereto, and further sufficiently applicable to a contacting development which tends to apply a comparatively high pressure thereto.

Working Example 5-2

100 g of methyl methacrylate and 3 g of 2,2'-azo bis-isobutyronitrile were put into a two litter-four neck-glass flask which was equipped with a thermometer, a stainless steel stirring rod, a reflux condenser, and a nitrogen inlet tube. The flask was placed in a heating mantle and the mixture therein was reacted at 100° C. The polymerization product was occasionally sampled during the reaction to measure a Tg thereof. The reaction was ceased when the Tg of the polymerization product reached 60° C. The Tg was measured by differential scanning calorimeter (Type of "DSC220", manufactured by Seiko electronic industry Co., Ltd.). The resin thus obtained was designated as resin 5B.

A Tg of the polymerization product was 100° C., where the reaction time of this polymerization was sufficiently extended.

The following mixture was put into an attritor ("MA-01SC" manufactured by Mitsui Miike Engineering Corp.) and dispersed at 15° C. for 10 hrs. to prepare a polymerizable composition.

| Component of mixture: | |
|---|---|
| Styrene: | 72.5 parts by weight |
| n-butyl acrylate: | 22.5 parts by weight |
| Resin 5B | 0.25 part by weight |
| Low molecular weight polyethylene: (used as an offset preventing agent) | 1.5 part by weight |
| Electrostatic preventing agent: ("Aizensupiro black TRH" manufactured by Hodogaya Chemical Co. Ltd.) | 1 part by weight |
| Carbon black ("Printexl" manufactured by Degusa Co. Ltd.) | 7 parts by weight |
| 2,2'-Azo bis-isobutyronitrile | 1 part by weight |

8 Parts by weight of polyacrylate and 0.35 part by weight of divinylbenzen were dissolved in 180 parts by weight of ethanol. 600 Parts by weight of distilled water was added to the mixture to prepare a dispersion medium. The polymerizable composition was added to the mixture and dispersed at 15° C. for 10 minutes at a rate of 8,000 r.p.m in a TK homomixer ("M Type" manufactured by Tokusyu Kika Kogyo Co., Ltd.). The resultant dispersion was put into a separable-one litter flask and reacted at 85° C. for 12 hrs. under a nitrogen flow with stirring at a rate of 100 r.p.m.

After cooling the reaction mixture, the dispersion medium was dissolved with a 0.5 N aqueous hydrochloride acid solution and the mixture was filtrated. The residue thus obtained was washed with water, air-dried, dried at 40° C. for 10 hrs. under a reduced pressure of 10 mmHg and classified by air classifier to obtain a capsulated toner having an average particle diameter of 7 $\mu$m.

This capsulated toner was treated by the same procedure as that used in working example 5-1 to prepare the toner of the present invention.

Where resin 5B was not used to polymerize the resin particle in the same manner as that of working example 5-1, a Tg thereof was 55° C. It means that a core of the capsulated toner obtained in this working example has a Tg of 55° C.

The toner was charged in LED Printer, OKI MIKROLINE16n and used in printing. A fixation percentage thereof was measured. A temperature of a fixation device (a heat-roller) was set at 130° C. which is the same as that of working example 5-1. The result is shown in Table 5. The capsulated toner of this working example indicated a good fixation.

A blocking resistance of the toner was determined by the same method as that of working example 5-1. As shown in working example 5-1, the capsulated toner of this working example caused no blocking and indicated a very good blocking resistance.

As a result of the test mentioned above, it is confirmed that the capsulated toner of this working example has a good fixation and a very good stability in preservation, can be clearly applicable to a non-contacting development, which does not tend to apply a mechanical pressure thereto, and further sufficiently applicable to a contacting development which tends to apply a high pressure thereto.

Working Example 5-3

The following mixture was put into an attritor ("MA-01SC" manufactured by Mitsui Miike Engineering Corp.) and dispersed at 15° C. for 10 hrs. to prepare a polymerizable composition.

| Component of mixture: | |
|---|---|
| Styrene: | 67.5 parts by weight |
| n-butyl acrylate: | 32.5 parts by weight |
| Resin 5A Resin 5A was prepared in working example 5-1. | 0.25 part by weight |
| Low molecular weight polyethylene: (used as an offset preventing agent) | 1.5 part by weight |
| Electrostatic preventing agent: ("Aizensupiro black TRH" manufactured by Hodogaya Chemical Co. Ltd.) | 1 part by weight |
| Carbon black ("Printexl" manufactured by Degusa Co. Ltd.) | 7 parts by weight |
| 2,2'-Azo bis-isobutyronitrile | 1 part by weight |

8 Parts by weight of polyacrylate and 0.35 part by weight of divinylbenzen were dissolved in 180 parts by weight of ethanol. 600 Parts by weight of distilled water was added to the mixture to prepare a dispersion medium. The polymerizable composition was added to the mixture and dispersed at 15° C. for 10 minutes at a rate of 8,000 r.p.m in a TK homomixer ("M Type" manufactured by Tokusyu Kika Kogyo Co., Ltd.). The resultant dispersion was put into a separable-one litter flask and reacted at 85° C. for 12 hrs. under a nitrogen flow with stirring at a rate of 100 r.p.m.

After cooling the reaction mixture, the dispersion medium was dissolved with a 0.5 N aqueous hydrochloride acid solution and the mixture was filtrated. The residue thus obtained was washed with water, air-dried, dried at 40° C. for 10 hrs. under a reduced pressure of 10 mmHg and classified by air classifier to obtain a capsulated toner having an average particle diameter of 7 $\mu$m.

This capsulated toner was treated by the same procedure as that used in working example 5-1 to prepare the toner of the present invention.

Where resin 5A was not used to polymerize the resin particle in the same manner as that used in working example 5-1, a Tg thereof was 35° C. It means that a core of the capsulated toner obtained in this working example has a Tg of 35° C.

The toner was charged in LED Printer, OKI MIKROLINE16n and used in printing. A fixation percentage thereof was measured. A temperature of a fixation device (a heat-roller) was set at 130° C. which is the same as that of working example 5-1. The result is shown in Table 5. The capsulated toner of this working example indicated a good fixation.

A blocking resistance of the toner was determined by the same method as that of working example 5-1. As shown in working example 5-1, the capsulated toner of this working example caused no blocking and indicated a very good blocking resistance.

As a result of the test mentioned above, it is confirmed that the capsulated toner of this working example has a good fixation and a very good stability in preservation, can be clearly applicable to a non-contacting development, which does not tend to apply a mechanical pressure thereto, and further sufficiently applicable to a contacting development which tends to apply a high pressure thereto.

Working Example 5-4

The following mixture was put into an attritor ("MA-01SC" manufactured by Mitsui Miike Engineering Corp.) and dispersed at 15° C. for 10 hrs. to prepare a polymerizable composition.

| Component of mixture: | |
|---|---|
| Styrene: | 67.5 parts by weight |
| n-butyl acrylate: | 32.5 parts by weight |
| Resin 5B | 0.25 part by weight |
| *Resin 5B was used in working example 5-2. | |
| Low molecular weight polyethylene: (used as an offset preventing agent) | 1.5 part by weight |
| Electrostatic preventing agent: ("Aizensupiro black TRH" manufactured by Hodogaya Chemical Co. Ltd.) | 1 part by weight |
| Carbon black ("Printexl" manufactured by Degusa Co. Ltd.) | 7 parts by weight |
| 2,2'-Azo bis-isobutyronitrile | 1 part by weight |

8 Parts by weight of polyacrylate and 0.35 part by weight of divinylbenzen were dissolved in 180 parts by weight of ethanol. 600 Parts by weight of distilled water was added to the mixture to prepare a dispersion medium. The polymerizable composition was added to the mixture and dispersed at 15° C. for 10 minutes at a rate of 8,000 r.p.m in a TK homomixer ("M Type" manufactured by Tokusyu Kika Kogyo Co., Ltd.). The resultant dispersion was put into a separable-one litter flask and reacted at 85° C. for 12 hrs. under a nitrogen flow with stirring at a rate of 100 r.p.m.

After cooling the reaction mixture, the dispersion medium was dissolved with a 0.5 N aqueous hydrochloride acid solution and the mixture was filtrated. The residue thus obtained was washed with water, air-dried, dried at 40° C. for 10 hrs. under a reduced pressure of 10 mmHg and classified by air classifier to obtain a capsulated toner having an average particle diameter of 7 $\mu$m. This capsulated toner was treated by the same procedure as that used in working example 5-1 to prepare the toner of the present invention.

Where resin 5B was not used to polymerize the resin particle in the same manner as that used in working example 5-1, a Tg thereof was 35° C. It means that a core of the capsulated toner obtained in this working example has a Tg of 35° C.

The toner was charged in LED Printer, OKI MIKROLINE16n and used in printing. A fixation percentage thereof was measured. A temperature of a fixation device (a heat-roller) was set at 130° C. which is the same as that of working example 5-1. The result is shown in Table 5. The capsulated toner of this working example indicated a good fixation.

A blocking resistance of the toner was determined by the same method as that of working example 5-1. As shown in working example 5-1, the capsulated toner of this working example caused no blocking and indicated a very good blocking resistance.

As a result of the test mentioned above, it is confirmed that the capsulated toner of this working example has a good fixation and a very good stability in preservation, can be clearly applicable to a non-contacting development, which does not tend to apply a mechanical pressure thereto, and further sufficiently applicable to a contacting development which tends to apply a high pressure thereto.

Comparative Example 5-1

The following mixture was put into an attritor ("MA-01SC" manufactured by Mitsui Miike Engineering Corp.) and dispersed at 15° C. for 10 hrs. to prepare a polymerizable composition.

| Component of mixture: | |
|---|---|
| Styrene: | 72.5 parts by weight |
| n-butyl acrylate: | 22.5 parts by weight |
| Low molecular weight polyethylene: (used as an offset preventing agent) | 1.5 part by weight |
| Electrostatic preventing agent: ("Aizensupiro black TRH" manufactured by Hodogaya Chemical Co. Ltd.) | 1 part by weight |
| Carbon black ("Printexl" manufactured by Degusa Co. Ltd.) | 7 parts by weight |
| 2,2'-Azo bis-isobutyronitrile | 1 part by weight |

8 Parts by weight of polyacrylate and 0.35 part by weight of divinylbenzen were dissolved in 180 parts by weight of ethanol. 600 Parts by weight of distilled water was added to the mixture to prepare a dispersion medium. The polymerizable composition was added to the mixture and dispersed at 15° C. for 10 minutes at a rate of 8,000 r.p.m in a TK homomixer ("M Type" manufactured by Tokusyu Kika Kogyo Co., Ltd.). The resultant dispersion was put into a separable-one litter flask and reacted at 85° C. for 12 hrs. under a nitrogen flow with stirring at a rate of 100 r.p.m.

After cooling the reaction mixture, the dispersion medium was dissolved with a 0.5 N aqueous hydrochloride acid solution and the mixture was filtrated. The residue thus obtained was washed with water, air-dried, dried at 40° C. for 10 hrs. under a reduced pressure of 10 mmHg and classified by air classifier to obtain a capsulated toner having an average particle diameter of 7 $\mu$m.

This capsulated toner was treated by the same procedure as that used in working example 5-1 to prepare the toner of the present invention. The capsulated toner obtained in this working example has a Tg of 55° C.

The toner was charged in LED Printer, OKI MIKROLINE16n and used in printing. A fixation percentage thereof was measured. The capsulated toner of this working example indicated a sufficient fixation which is the same as those shown in working examples 5-1 to 5-4.

A blocking resistance of the toner was determined by the same method as that of working example 5-1 to 5-4. The capsulated toner of this working example indicated a bad blocking resistance. It was confirmed that the capsulated toner of this comparative example was not practically useful because it had caused a terrible blocking.

Comparative Example 5-2

The following mixture was put into an attritor ("MA-01SC" manufactured by Mitsui Miike Engineering Corp.)

and dispersed at 15° C. for 10 hrs. to prepare a polymerizable composition.

| Component of mixture: | |
|---|---|
| Styrene: | 67.5 parts by weight |
| n-butyl acrylate: | 32.5 parts by weight |
| Low molecular weight polyethylene: (used as an offset preventing agent) | 1.5 part by weight |
| Electrostatic preventing agent: ("Aizensupiro black TRH" manufactured by Hodogaya Chemical Co. Ltd.) | 1 part by weight |
| Carbon black ("Printexl" manufactured by Degusa Co. Ltd.) | 7 parts by weight |
| 2,2'-Azo bis-isobutyronitrile | 1 part by weight |

8 Parts by weight of polyacrylate and 0.35 part by weight of divinylbenzen were dissolved in 180 parts by weight of ethanol. 600 Parts by weight of distilled water was added to the mixture to prepare a dispersion medium. The polymerizable composition was added to the mixture and dispersed at 15° C. for 10 minutes at a rate of 8,000 r.p.m in a TK homomixer ("M Type" manufactured by Tokusyu Kika Kogyo Co., Ltd.). The resultant dispersion was put into a separable-one litter flask and reacted at 85 C. for 12 hrs. under a nitrogen flow with stirring at a rate of 100 r.p.m.

After cooling the reaction mixture, the dispersion medium was dissolved with a 0.5 N aqueous hydrochloride acid solution and the mixture was filtrated. The residue thus obtained was washed with water, air-dried, dried at 20° C. for 10 hrs. under a reduced pressure of 10 mmHg and classified by air classifier to obtain a capsulated toner having an average particle diameter of 7 $\mu$m.

This capsulated toner was treated by the same procedure as that used in working example 5-1 to prepare the toner of the present invention. The capsulated toner obtained in this working example has a Tg of 35° C.

The toner was charged in LED Printer, OKI MIKROLINE16n and used in printing. A fixation percentage thereof was measured. The toner melted and accreted onto a developing roller in a development apparatus, and a normal print was not obtained.

Further the toner lacked a blocking resistance and caused a complete blocking.

TABLE 5

| | Tg. of core resin(° C.) | Resin | Blocking percent-age(%) | Fixation |
|---|---|---|---|---|
| Ex. 5-1 | 55 | 5A | 0 | ⊚ |
| Ex. 5-2 | 55 | 5B | 0 | ⊚ |
| Ex. 5-3 | 35 | 5A | 0 | ⊚ |
| Ex. 5-4 | 35 | 5B | 0 | ⊚ |
| Com ex.5-1 | 55 | — | 80 | ⊚ |
| Com ex.5-2 | 35 | — | 100 | Unmeasurable |

*Ex. in the table means a working example.
*Com. ex. in the table means a comparative example.

Working Example 6-1

Working examples 6-1 to 6-3 and comparative examples 6-1 to 6-3 mainly illustrate embodiment 6 of the present invention in detail.

100 Parts by weight of methyl methacrylate and 3 parts by weight of 2,2'-azo bis-isobutyronitrile were put into a two litter-four neck-glass flask which was equipped with a thermometer, a stainless steel stirring rod, a reflux condenser, and a nitrogen inlet tube. The flask was placed in a heating mantle and the mixture therein was reacted at 100° C. The polymerization product was occasionally sampled during the reaction to measure a Tg thereof. The reaction was ceased when a Tg of the polymerization product reached 60° C. The Tg was measured by differential scanning calorimeter (Type of "DSC220", manufactured by Seiko electronic industry Co., Ltd.). The resin thus obtained was designated as resin 6A. It was confirmed that a Tg of polymerization product was 100 ° C., when the reaction time of this polymerization was sufficiently extended.

The following mixture was put into an attritor ("MA-01SC" manufactured by Mitsui Miike Engineering Corp.) and dispersed at 15° C. for 10 hrs. to prepare a polymerizable composition.

| Component of mixture: | |
|---|---|
| Styrene: | 67.5 parts by weight |
| n-butyl acrylate: | 32.5 parts by weight |
| Resin 6A: (produced in this working example) | 0.25 part by weight |
| Low molecular weight polyethylene: (used as an offset preventing agent) | 1.5 part by weight |
| Electrostatic preventing agent: ("Aizensupiro black TRH" manufactured by Hodogaya Chemical Corp.) | 1 part by weight |
| Carbon black ("Printexl" manufactured by Degusa Co. Ltd.) | 7 parts by weight |
| 2,2'-Azo bis-isobutyronitrile | 1 part by weight |

8 Parts by weight of polyacrylate and 0.35 part by weight of divinylbenzen were dissolved in 180 parts by weight of ethanol. 600 Parts by weight of a distilled water was added to the mixture to prepare a dispersion medium. The polymerizable composition was added to the dispersion medium and dispersed at 15° C. for 10 minutes at a rate of 8,000 r.p.m in a TK homomixer ("M type" manufactured by Tokusyu Kika Kogyo Co., Ltd.). The resultant dispersion was put into a separable-one litter flask and reacted at 85° C. for 12 hrs. under a nitrogen flow with stirring at a rate of 100 r.p.m. The dispersoid obtained by polymerization of the polymerizable composition in these steps is referred to as "intermediate particle" hereinbelow.

10 Parts by weight of methyl methacrylate, 0.5 part by weight of 2,2'-azo bis-isobutyronitrile, 0.1 part by weight of sodium laurylsulfate and 80 parts by weight of water were mixed and the mixture was treated by ultrasonic generator ("US-150", Nippon Seiki Industry Co., Ltd.) to prepare aqueous emulsion B. 9 Parts by weight of aqueous emulsion B was dripped to the aqueous suspension of the intermediate particles to enlarge the particles. Just after dripping, the aqueous suspension was observed by optical microscope to see no droplet of the emulsion. It was therefore confirmed that the enlargement had done for a very short time.

The suspension was further reacted as the second polymerization at 85° C. for 10 hrs. under a nitrogen atmosphere with stirring. After cooling the reaction mixture, the dispersion medium was dissolved with a 0.5 N aqueous hydrochloride acid solution and the mixture was filtrated. The residue thus obtained was washed with water, air-dried, dried at 40° C. for 10 hrs. under a reduced pressure of 10 mmHg and classified by air classifier to obtain a capsulated toner having an average particle diameter of 7 $\mu$m.

In addition to a series of the reactions described above, an in situ polymerization was done in the same manner as that used in this working example except for that resin 6A was not used. A Tg. of the resultant thermoplastic resin was 35° C. It means that a core of the capsulated toner obtained in this working example has a Tg of 35° C.

The thermoplastic resin obtained by the polymerization of aqueous emulsion B alone has a Tg of 100° C. It means that a shell resin of the capsulated toner obtained in this working example has a Tg of 100° C.

The toner was charged in LED Printer OKI MIKROLINE16n and used in printing. A fixation percentage thereof was measured. A temperature of a fixation device (a heat-roller) was set at 130° C. The result is shown in Table 6.

A fixation percentage is defined by the following equation.

Fixation percentage (%)=(image density after rubbing/image density before rubbing)×100

The term "image density before rubbing" means an image density of a solid color of print which is measured by Macbeth densitometer. The term "image density after rubbing" means an image density which is retained on a print after Scotch-tape is overlaid on a solid color of the print, applied a load of 50 g/cm$^2$ to a given area by reciprocation action and removed from the print at a rate of 3 cm/sec.

The fixation percentage thus measured is classified in the following manner and summarized in Table 6.

Fixation percentage 90 to 100% ○: 50 to 90% ◎: 0 to 50% X

The capsulated toner of this working example indicates a good fixation.

A blocking resistance of the toner was determined by the following method. A cylindrical container having a bottom of 20 cm$^2$ was charged with 20 grams of the toner sample, capped and given a pressure of 500 g/cm$^2$ by weight. The toner was kept at 50° C. in this condition for a month. All of the sample toner (20 g) was transferred onto a sieve of 45 $\mu$m mesh, vibrated at a rate of 1 KHz for 30 seconds and then the toner retained on the sieve was weighed.

A blocking percentage (%) is defined by the following equation.

Blocking percentage (%)=Weight of toner retained on sieve (g)/Weight of sample toner (g)×100

The capsulated toner of this working example caused no blocking and indicated a very good stability in preservation.

As a result of the test mentioned above, it is confirmed that the capsulated toner of this working example has a good fixation and a very good stability in preservation, can be clearly applicable to a non-contacting development, which does not tend to apply a mechanical pressure thereto, and further sufficiently applicable to a contacting development which tends to apply a comparatively high pressure thereto.

Working Example 6-2

100 Parts by weight of methyl methacrylate, 10 parts by weight of n-butyl acrylate and 3 parts by weight of 2,2'-azo bis-isobutyronitrile were put into a two litter-four neck-glass flask which was equipped with a thermometer, a stainless steel stirring rod, a reflux condenser, and a nitrogen inlet tube. The flask was placed in a heating mantle and the mixture therein was reacted at 100° C. The polymerization product was occasionally sampled during the reaction to measure a Tg thereof The reaction was ceased when the Tg of the polymerization product reached 60° C. The Tg was measured by differential scanning calorimeter (Type of "DSC220", manufactured by Seiko electronic industry Co., Ltd.). The resin thus obtained was designated as resin 6C. It was confirmed that the Tg of polymerization product was 90° C., when the reaction time of this polymerization was sufficiently extended.

The following mixture was put into an attritor ("MA-01SC" manufactured by Mitsui Miike Engineering Corp.) and dispersed at 15° C. for 10 hrs. to prepare a polymerizable composition.

| Component of mixture: | |
|---|---|
| Styrene: | 72.5 parts by weight |
| n-butyl acrylate: | 27.5 parts by weight |
| Resin 6C: (produced in this working example) | 0.25 part by weight |
| Low molecular weight polyethylene: (used as an offset preventing agent) | 1.5 part by weight |
| Electrostatic preventing agent: ("Aizensupiro black TRH" manufactured by Hodogaya Chemical Corp.) | 1 part by weight |
| Carbon black ("Printexl" manufactured by Degusa Co. Ltd.) | 7 parts by weight |
| 2,2'-Azo bis-isobutyronitrile | 1 part by weight |

8 Parts by weight of polyacrylate and 0.35 part by weight of divinylbenzen were dissolved in 180 parts by weight of ethanol. 600 Parts by weight of a distilled water was added to the mixture to prepare a dispersion medium. The polymerizable composition was added to the dispersion medium and dispersed at 15° C. for 10 minutes at a rate of 8,000 r.p.m in a TK homomixer ("M type" manufactured by Tokusyu Kika Kogyo Co., Ltd.). The resultant dispersion was put into a separable-one litter flask and reacted at 85° C. for 12 hrs. under a nitrogen flow with stirring at a rate of 100 r.p.m. The dispersoid obtained by polymerization of the polymerizable composition in these steps is referred to as "intermediate particle" in the same manner in working example 6-1.

9 Parts by weight of methyl methacrylate, 1 part by weight of n-butyl acrylate, 0.5 part by weight of 2,2'-azo bis-isobutyronitrile, 0.1 part by weight of sodium laurylsulfate and 80 parts by weight of water were mixed and the mixture was treated by ultrasonic generator ("US-150", Nippon Seiki Industry Co., Ltd.) to prepare aqueous emulsion D. 9 Parts by weight of aqueous emulsion D was dripped to the aqueous suspension of the intermediate particles to enlarge the particles. Just after dripping, the aqueous suspension was observed by optical microscope to see no droplet of the emulsion. It was therefore confirmed that the enlargement had done for a very short time.

The suspension was further reacted as the second polymerization at 85° C. for 10 hrs. under a nitrogen atmosphere with stirring. After cooling the reaction mixture, the dispersion medium was dissolved with a 0.5 N aqueous hydrochloride acid solution and the mixture was filtrated. The residue thus obtained was washed with water, air-dried, dried at 40° C. for 10 hrs. under a reduced pressure of 10 mmHg and classified by air classifier to obtain a capsulated toner having an average particle diameter of 7 $\mu$m.

The toner was treated with an additive in the same manner in working example 6-1 to prepare the capsulated toner of the present invention.

In addition to a series of the reactions described above, the in situ polymerization was done in the same manner as that used in this working example except for that resin 6C was not used. A Tg. of the resultant thermoplastic resin was 45° C. It means that a core of the capsulated toner obtained in this working example has a Tg of 45° C.

The thermoplastic resin obtained by the polymerization of aqueous emulsion C alone has a Tg of 90 ° C. It means that a shell resin of the capsulated toner obtained in this working example has a Tg of 90° C.

The toner was charged in LED Printer OKI MIKROLINE16n and used in printing. A fixation percentage thereof was measured. A temperature of a fixation device (a heat-roller) was set at 130° C. which was the same temperature as that of working example 6-1. The result is shown in Table 6. The capsulated toner of this working example indicates a good fixation.

A blocking resistance was determined in the same manner as that used in working example 6-1. As shown in working example 6-1, the capsulated toner of this working example caused no blocking and indicated a very good blocking resistance.

As a result of the test mentioned above, it is confirmed that the capsulated toner of this working example has a good fixation and a very good stability in preservation, can be clearly applicable to a non-contacting development, which does not tend to apply a mechanical pressure thereto, and further sufficiently applicable to a contacting development which tends to apply a comparatively high pressure thereto.

Working Example 6-3

85 Parts by weight of methyl methacrylate, 15 parts by weight of n-butyl acrylate and 3 parts by weight of 2,2'-azo bis-isobutyronitrile were put into a two litter-four neck-glass flask which was equipped with a thermometer, a stainless steel stirring rod, a reflux condenser, and a nitrogen inlet tube. The flask was placed in a heating mantle and the mixture therein was reacted at 100° C. The polymerization product was occasionally sampled during the reaction to measure a Tg thereof. The reaction was ceased when the Tg of the polymerization product reached 60° C. The Tg was measured by differential scanning calorimeter (Type of "DSC220", manufactured by Seiko electronic industry Co., Ltd.). The resin thus obtained was designated as resin 6E. It was confirmed that a Tg of the polymerization product was 90° C., when the reaction time of this polymerization was sufficiently extended.

The following mixture was put into an attritor ("MA-01SC" manufactured by Mitsui Miike Engineering Corp.) and dispersed at 15° C. for 10 hrs. to prepare a polymerizable composition.

| Component of mixture: | |
|---|---|
| Styrene: | 77.5 parts by weight |
| n-butyl acrylate: | 22.5 parts by weight |
| Resin 6E (produced in this working example) | 0.25 part by weight |
| Low molecular weight polyethylene: (used as an offset preventing agent) | 1.5 part by weight |
| Electrostatic preventing agent: ("Aizensupiro black TRH" manufactured by Hodogaya Chemical Corp.) | 1 part by weight |
| Carbon black | 7 parts by weight |

-continued

| Component of mixture: | |
|---|---|
| ("Printexl" manufactured by Degusa Co. Ltd.) | |
| 2,2'-Azo bis-isobutyronitrile | 1 part by weight |

8 Parts by weight of polyacrylate and 0.35 part by weight of divinylbenzen were dissolved in 180 parts by weight of ethanol. 600 Parts by weight of a distilled water was added to the mixture to prepare a dispersion medium. The polymerizable composition was added to the dispersion medium and dispersed at 15° C. for 10 minutes at a rate of 8,000 r.p.m in a TK homomixer ("M type" manufactured by Tokusyu Kika Kogyo Co., Ltd.). The resultant dispersion was put into a separable-one litter flask and reacted at 85° C. for 12 hrs. under a nitrogen flow with stirring at a rate of 100 r.p.m. The dispersoid obtained by polymerization of the polymerizable composition in these steps is referred to as "intermediate particle" in the same manner in working example 6-1.

8.5 Parts by weight of methyl methacrylate, 1.5 part by weight of n-butyl acrylate, 0.5 part by weight of 2,2'-azo bis-isobutyronitrile, 0.1 part by weight of sodium laurylsulfate and 80 parts by weight of water were mixed and the mixture was treated by ultrasonic generator ("US-150", Nippon Seiki Industry Co., Ltd.) to prepare aqueous emulsion F. 9 Parts by weight of aqueous emulsion F was dripped to the aqueous suspension of the intermediate particles to enlarge the particles. Just after dripping, the aqueous suspension was observed by optical microscope to see no droplet of the emulsion. It was therefore confirmed that the enlargement had done for a very short time.

The suspension was further reacted as the second polymerization at 85° C. for 10 hrs. under a nitrogen atmosphere with stirring. After cooling the reaction mixture, the dispersion medium was dissolved with a 0.5 N aqueous hydrochloride acid solution and the mixture was filtrated. The residue thus obtained was washed with water, air-dried, dried at 40° C. for 10 hrs. under a reduced pressure of 10 mmHg and classified by air classifier to obtain a capsulated toner having an average particle diameter of 7 $\mu$m.

The toner was treated with an additive in the same manner in working example 6-1 to prepare the capsulated toner of the present invention.

In addition to a series of the reactions described above, an in situ polymerization was done in the same manner as that used in this working example except for that resin 6E was not used. A Tg. of the resultant thermoplastic resin was 45° C. It means that a core of the capsulated toner obtained in this working example has a Tg of 45° C.

The thermoplastic resin obtained by the polymerization of aqueous emulsion F alone has a Tg of 70 ° C. It means that a shell resin of the capsulated toner obtained in this working example has a Tg of 70° C.

The toner was charged in LED Printer OKI MIKROLINE16n and used in printing. A fixation percentage thereof was measured. A temperature of a fixation device (a heat-roller) was set at 130° C. which was the same temperature as that of working example 6-1. The result is shown in Table 6. The capsulated toner of this working example indicates a good fixation.

A blocking resistance was determined in the same manner as that used in working example 6-1. As shown in working example 6-1, the capsulated toner of this working example caused no blocking and indicated a very good blocking resistance.

As a result of the test mentioned above, it is confirmed that the capsulated toner of this working example has a good fixation and a very good stability in preservation, can be clearly applicable to a non-contacting development, which does not tend to apply a mechanical pressure thereto, and further sufficiently applicable to a contacting development which tends to apply a comparatively high pressure thereto.

Comparative Example 6-1

The following mixture was put into an attritor ("MA-01SC" manufactured by Mitsui Miike Engineering Corp.) and dispersed at 15° C. for 10 hrs. to prepare a polymerizable composition.

| Component of mixture: | |
|---|---|
| Styrene: | 67.5 parts by weight |
| n-butyl acrylate: | 32.5 parts by weight |
| Low molecular weight polyethylene: (used as an offset preventing agent) | 1.5 part by weight |
| Electrostatic preventing agent: ("Aizensupiro black TRH" manufactured by Hodogaya Chemical Corp.) | 1 part by weight |
| Carbon black ("Printexl" manufactured by Degusa Co. Ltd.) | 7 parts by weight |
| 2,2'-Azo bis-isobutyronitrile | 1 part by weight |

8 parts by weight of polyacrylate and 0.35 part by weight of divinylbenzen were dissolved in 180 parts by weight of ethanol. 600 Parts by weight of a distilled water was added to the mixture to prepare a dispersion medium. The polymerizable composition was added to the dispersion medium and dispersed at 15° C. for 10 minutes at a rate of 8,000 r.p.m in a TK homomixer ("M type" manufactured by Tokusyu Kika Kogyo Co., Ltd.). The resultant dispersion was put into a separable-one litter flask and reacted at 85° C. for 12 hrs. under a nitrogen flow with stirring at a rate of 100 r.p.m. The dispersoid obtained by polymerization of the polymerizable composition in these steps is referred to as "intermediate particle" in the same manner in working example 6-1.

18 Parts by weight of aqueous emulsion B was dripped to the aqueous suspension of the intermediate particles to enlarge the particles. Just after dripping, the aqueous suspension was observed by optical microscope to see no droplet of the emulsion. It was therefore confirmed that the enlargement had done for a very short time.

The suspension was further reacted as the second polymerization at 85° C. for 10 hrs. under a nitrogen atmosphere with stirring. After cooling the reaction mixture, the dispersion medium was dissolved with a 0.5 N aqueous hydrochloride acid solution and the mixture was filtrated. The residue thus obtained was washed with water, air-dried, dried at 40° C. for 10 hrs. under a reduced pressure of 10 mmHg and classified by air classifier to obtain a capsulated toner having an average particle diameter of 7 $\mu$m.

The toner was treated with an additive in the same manner as that of working example 6-1 to prepare the capsulated toner of the present invention.

A core of the capsulated toner obtained in this working example has a Tg of 35° C.

The toner was charged in LED Printer OKI MIKROLINE16n and then used in printing. A fixation percentage thereof was measured. A temperature of a fixation device (a heat-roller) was set at 130° C. which was the same temperature as that of working example 6-1. The result is shown in Table 6. The capsulated toner of this working example indicates a good fixation.

A blocking resistance was determined in the same manner as that used in working example 6-1. The toner of this working example caused a complete blocking and it appeared that the toner was not practically useful.

Comparative Example 6-2

The following mixture was put into an attritor ("MA-01SC" manufactured by Mitsui Miike Engineering Corp.) and dispersed at 15° C. for 10 hrs. to prepare a polymerizable composition.

| Component of mixture: | |
|---|---|
| Styrene: | 72.5 parts by weight |
| n-butyl acrylate: | 27.5 parts by weight |
| Low molecular weight polyethylene: (used as an offset preventing agent) | 1.5 part by weight |
| Electrostatic preventing agent: ("Aizensupiro black TRH" manufactured by Hodogaya Chemical Corp.) | 1 part by weight |
| Carbon black ("Printexl" manufactured by Degusa Co. Ltd.) | 7 parts by weight |
| 2,2'-Azo bis-isobutyronitrile | 1 part by weight |

8 Parts by weight of polyacrylate and 0.35 part by weight of divinylbenzen were dissolved in 180 parts by weight of ethanol. 600 Parts by weight of a distilled water was added to the mixture to prepare a dispersion medium. The polymerizable composition was added to the dispersion medium and dispersed at 15° C. for 10 minutes at a rate of 8,000 r.p.m in a TK homomixer ("M type" manufactured by Tokusyu Kika Kogyo Co., Ltd.). The resultant dispersion was put into a separable-one litter flask and reacted at 85° C. for 12 hrs. under a nitrogen flow with stirring at a rate of 100 r.p.m. The dispersoid obtained by polymerization of the polymerizable composition in these steps is referred to as "intermediate particle" in the same manner as that of working example 6-1.

8 Parts by weight of aqueous emulsion D which was used in working example 6-2, was dripped to the aqueous suspension of the intermediate particles to enlarge the particles. Just after dripping, the aqueous suspension was observed by optical microscope to see no droplet of the emulsion. It was therefore confirmed that the enlargement had done for a very short time.

The suspension was further reacted as the second polymerization at 85° C. for 10 hrs. under a nitrogen atmosphere with stirring. After cooling the reaction mixture, the dispersion medium was dissolved with a 0.5 N aqueous hydrochloride acid solution and the mixture was filtrated. The residue thus obtained was washed with water, air-dried, dried at 40° C. for 10 hrs. under a reduced pressure of 10 mmHg and classified by air classifier to obtain a capsulated toner having an average particle diameter of 7 $\mu$m.

The toner was treated with an additive in the same manner as that of working example 6-1 to prepare the capsulated toner of the present invention.

A core of the capsulated toner obtained in this working example has a Tg of 45C.

The toner was charged in LED Printer OKI MIKROLINE16n and used in printing. A fixation percentage thereof was measured. A temperature of a fixation device (a heat-roller) was set at 130° C. which was the same temperature as that of working example 6-1. The result is shown in Table 6. The capsulated toner of this working example indicates a good fixation.

A blocking resistance was determined in the same manner as that used in working example 6-1. The toner of this working example caused a blocking completely and it appeared that the toner was not practically useful.

Comparative Example 6-3

The following mixture was put into an attritor ("MA-01SC" manufactured by Mitsui Miike Engineering Corp.) and dispersed at 15° C. for 10 hrs. to prepare a polymerizable composition.

| Component of mixture: | |
|---|---|
| Styrene: | 77.5 parts by weight |
| n-butyl acrylate: | 22.5 parts by weight |
| Low molecular weight polyethylene: (used as an offset preventing agent) | 1.5 part by weight |
| Electrostatic preventing agent: ("Aizensupiro black TRH" manufactured by Hodogaya Chemical Corp.) | 1 part by weight |
| Carbon black ("Printexl" manufactured by Degusa Co. Ltd.) | 7 parts by weight |
| 2,2'-Azo bis-isobutyronitrile | 1 part by weight |

8 Parts by weight of polyacrylate and 0.35 part by weight of divinylbenzen were dissolved in 180 parts by weight of ethanol. 600 Parts by weight of a distilled water was added to the mixture to prepare a dispersion medium. The polymerizable composition was added to the dispersion medium and dispersed at 15° C. for 10 minutes at a rate of 8,000 r.p.m in a TK homomixer ("M type" manufactured by Tokusyu Kika Kogyo Co., Ltd.). The resultant dispersion was put into a separable-one litter flask and reacted at 85° C. for 12 hrs. under a nitrogen flow with stirring at a rate of 100 r.p.m. The dispersoid obtained by polymerization of the polymerizable composition in these steps is referred to as "intermediate particle" in the same manner as that of working example 6-1.

8 Parts by weight of aqueous emulsion F which was used in working example 6-3, was dripped to the aqueous suspension of the intermediate particles to enlarge the particles. Just after dripping, the aqueous suspension was observed by optical microscope to see no droplet of the emulsion. It was therefore confirmed that the enlargement had done for a very short time.

The suspension was further reacted as the second polymerization at 85° C. for 10 hrs. under a nitrogen atmosphere with stirring. After cooling the reaction mixture, the dispersion medium was dissolved with a 0.5 N aqueous hydrochloride acid solution and the mixture was filtrated. The residue thus obtained was washed with water, air-dried, dried at 40° C. for 10 hrs. under a reduced pressure of 10 mmHg and classified by air classifier to obtain a capsulated toner having an average particle diameter of 7 $\mu$m.

The toner was treated with an additive in the same manner as that of Fworking example 6-1 to prepare the capsulated toner of the present invention.

A core of the capsulated toner obtained in this working example has a Tg of 55° C.

The toner was charged in LED Printer WOKI MIKROLINE16n and used in printing. A fixation percentage thereof was measured. A temperature of a fixation device (a heat-roller) was set at 130° C. which was the same temperature as that of working example 6-1. The result is shown in Table 6. The capsulated toner of this working example indicates a good fixation.

A blocking resistance was determined in the same manner as that used in working example 6-1. The toner of this working example caused a blocking completely and it appeared that the toner was not practically useful.

TABLE 6

| | Tg. of Core resin (° C.) | Resin | Tg. of shell resin (° C.) | Blocking percentage (%) | Fixation |
|---|---|---|---|---|---|
| Ex. 6- 1 | 35 | 6A | 100 | 0 | ⊙ |
| Ex. 6-2 | 45 | 6C | 90 | 0 | ⊙ |
| Ex. 6-3 | 55 | 6E | 70 | 0 | ⊙ |
| Com ex.6-1 | 35 | — | 100 | 95 | ⊙ |
| Com ex.6-2 | .45 | — | 90 | 70 | ⊙ |
| Com ex.6-3 | 55 | — | 70 | 65 | ⊙ |

*Ex. in the table means a working example.
*Com. ex. in the table means a comparative example.

Working Example 7-1

Working Examples 7-1 to 7-4 and comparative examples 7-1 to 7-4 mainly illustrate embodiment 7 of the present invention in detail.

90 G of methyl methacrylate, 10 g of n-butyl acrylate and 3 g of 2,2'-azo bis-isobutyronitrile were put into a two litter-four neck-glass flask which was equipped with a thermometer, a stainless steel stirring rod, a reflux condenser and a nitrogen inlet tube. The flask was placed in a heating mantle and the mixture therein was reacted at 100° C. The polymerization product was occasionally sampled during the reaction to measure a Tg thereof. The reaction was ceased when the Tg of the polymerization product reached 60° C. The Tg was measured by differential scanning calorimeter (Type of "DSC220", manufactured by Seiko electronic industry Co., Ltd.). The resin thus obtained was designated as resin 7A. It was confirmed that the Tg of polymerization product was 90 ° C., when the reaction time of this polymerization was sufficiently extended.

The following mixture was put into an attritor ("MA-01SC" manufactured by Mitsui Miike Engineering Corp.) and dispersed at 15° C. for 10 hrs. to prepare a polymerizable composition.

| Component of mixture: | |
|---|---|
| Styrene: | 77.5 parts by weight |
| n-butyl acrylate: | 22.5 parts by weight |
| Resin 7A: (produced in this working example) | 0.25 part by weight |
| Low molecular weight polyethylene: (used as an offset preventing agent) | 1.5 part by weight |
| Electrostatic preventing agent: ("Aizensupiro black TRH" manufactured by Hodogaya Chemical Corp.) | 1 part by weight |
| Carbon black ("Printexl" manufactured by Degusa Co. Ltd.) | 7 parts by weight |
| 2,2'-Azo bis-isobutyronitrile | 1 part by weight |

8 Parts by weight of polyacrylate and 0.35 part by weight of divinylbenzen were dissolved in 180 parts by weight of ethanol. 600 Parts by weight of a distilled water was added to the mixture to prepare a dispersion medium. The polymerizable composition was added to the dispersion medium and dispersed at 15° C. for 10 minutes at a rate of 8,000 r.p.m in a TK homomixer ("M type" manufactured by Tokusyu Kika Kogyo Co., Ltd.). The resultant dispersion was put into a separable-one litter flask and reacted at 85° C. for 12 hrs. under a nitrogen flow with stirring at a rate of 100 r.p.m. The dispersoid obtained by polymerization of the polymerizable composition in these steps is referred to as "intermediate particle".

9.5 Parts by weight of methyl methacrylate, 0.5 part by weight of n-butyl acrylate, 0.5 part by weight of 2,2'-azo bis-isobutyronitrile, 0.1 part by weight of sodium laurylsulfate and 80 parts by weight of water were mixed to prepare aqueous emulsion B. 9 Parts by weight of aqueous emulsion B was dripped to the aqueous suspension of the intermediate particles to enlarge the particles. Just after dripping, the aqueous suspension was observed by optical microscope to see no droplet of the emulsion. It was therefore confirmed that the enlargement had done for a very short time.

The suspension was further reacted as the second polymerization at 85° C. for 10 hrs. under a nitrogen atmosphere with stirring. After cooling the reaction mixture, the dispersion medium was dissolved with a 0.5 N aqueous hydrochloride acid solution and the mixture was filtrated. The residue thus obtained was washed with water, air-dried, dried at 40° C. for 10 hrs. under a reduced pressure of 10 mmHg and classified by air classifier to obtain a capsulated toner having an average particle diameter of 7 $\mu$m.

The resin particles obtained before the seeding polymerization has a Tg. of 55° C. It means that a core of the capsulated toner obtained in this working example has a Tg of 55° C.

The thermoplastic resin obtained by the polymerization of aqueous emulsion B alone has a Tg of 95° C. It means that a shell resin of the capsulated toner obtained in this working example has a Tg of 95° C.

0.35 Parts by weight of a fine powder of a hydrophobic silica "Aerosil R-972" (manufactured by Japan Aerosil Co., Lid.) was mixed with 50 parts by weight of the resultant capsulated toner to obtain the capsulated toner of the present invention.

The toner was charged in LED Printer OKI MIKROLINE16n and used in printing. A fixation percentage thereof was measured. A temperature of a fixation device (a heat-roller) was set at 130° C.

A fixation percentage is defined by the following equation.

Fixation percentage (%)=(image density after rubbing/image density before rubbing)×100

The term "image density before rubbing" means an image density of a solid color of print which is measured by Macbeth densitometer. The term "image density after rubbing" means an image density which is retained on a print after Scotch-tape is overlaid on a solid color of the print, applied a load of 50 g/cm$^2$ to a given area by reciprocation action and removed from the print at a rate of 3 cm/sec.

The fixation percentage thus measured is classified in the following manner and summarized in Table 7.

Fixation percentage 90 to 100% ◎: 50 to 90% ○: 0 to 50% X

The capsulated toner of this working example indicates a good fixation.

A blocking resistance of the toner was determined by the following method. A cylindrical container having a bottom of 20 cm$^2$ was charged with 20 grams of the toner sample, capped and given a pressure of 500 g/cm$^2$ by weight. The toner was kept at 50° C. in this condition for a month. All of the sample toner (20 g) was transferred onto a sieve of 45 $\mu$m mesh, vibrated at a rate of 1 KHz for 30 seconds and then the toner retained on the sieve was weighed.

A blocking percentage (%) is defined by the following equation.

Blocking percentage (%)=Weight of toner retained on sieve (g)/Weight of sample toner (g)×100

The capsulated toner of this working example caused no blocking and indicated a very good stability in preservation.

As a result of the test mentioned above, it is confirmed that the capsulated toner of this working example has a good fixation and a very good stability in preservation, can be clearly applicable to a non-contacting development, which does not tend to apply a mechanical pressure thereto, and further sufficiently applicable to a contacting development which tends to apply a comparatively high pressure thereto.

Working Example 7-2

The in situ polymerization was conducted in the same conditions as those in working example 7-1 to prepare the intermediate particles.

10 Parts by weight of methyl methacrylate, 0.5 part by weight of 2,2'-azo bis-isobutyronitrile, 0.1 part by weight of sodium laurylsulfate and 80 parts by weight of water were treated to prepare aqueous emulsion C. 9 Parts by weight of aqueous emulsion C was dripped to the aqueous suspension of the intermediate particles to enlarge the particles. Just after dripping, the aqueous suspension was observed by optical microscope to see no droplet of the emulsion. It was therefore confirmed that the enlargement had done for a very short time.

The suspension was further reacted as the second polymerization at 85° C. for 10 hrs. under a nitrogen atmosphere with stirring. After cooling the reaction mixture, the dispersion medium was dissolved with a 0.5 N aqueous hydrochloride acid solution and the mixture was filtrated. The residue thus obtained was washed with water, air-dried, dried at 40° C. for 10 hrs. under a reduced pressure of 10 mmHg and classified by air classifier to obtain a capsulated toner having an average particle diameter of 7 $\mu$m.

The thermoplastic resin obtained by the polymerization of aqueous emulsion C alone has a Tg of 100° C.

The toner was treated with an additive to prepare the toner of the present invention.

The toner was charged in LED Printer OKI MIKROLINE16n and used in printing. A fixation percentage thereof was measured. A temperature of a fixation device (a heat-roller) was set at 130° C. which was the same temperature as that of working example 7-1. The result is shown in Table 7. The capsulated toner of this working example indicated a good fixation.

A blocking resistance was determined in the same manner as that used in working example 7-1. As shown in working example 7-1, the capsulated toner of this working example caused no blocking and indicated a very good blocking resistance.

As a result of the test mentioned above, it is confirmed that the capsulated toner of this working example has a good fixation and a very good stability in preservation, can be clearly applicable to a non-contacting development, which does not tend to apply a mechanical pressure thereto, and further sufficiently applicable to a contacting development which tends to apply a comparatively high pressure thereto.

Working Example 7-3

The following mixture was put into an attritor ("MA-01SC" manufactured by Mitsui Miike Engineering Corp.) and dispersed at 15° C. for 10 hrs. to prepare a polymerizable composition.

| Component of mixture: | |
|---|---|
| Styrene: | 67.5 parts by weight |
| n-butyl acrylate: | 32.5 parts by weight |
| Resin 7A: (produced in this working example) | 0.25 part by weight |
| Low molecular weight polyethylene: (used as an offset preventing agent) | 1.5 part by weight |
| Electrostatic preventing agent: ("Aizensupiro black TRH" manufactured by Hodogaya Chemical Corp.) | 1 part by weight |
| Carbon black ("Printexl" manufactured by Degusa Co. Ltd.) | 7 parts by weight |
| 2,2'-Azo bis-isobutyronitrile | 1 part by weight |

8 Parts by weight of polyacrylate and 0.35 part by weight of divinylbenzen were dissolved in 180 parts by weight of ethanol. 600 Parts by weight of a distilled water was added to the mixture to prepare a dispersion medium. The polymerizable composition was added to the dispersion medium and dispersed at 15° C. for 10 minutes at a rate of 8,000 r.p.m in a TK homomixer ("M type" manufactured by Tokusyu Kika Kogyo Co., Ltd.). The resultant dispersion was put into a separable-one litter flask and reacted at 85° C. for 12 hrs. under a nitrogen flow with stirring at a rate of 100 r.p.m. The dispersoid obtained by polymerization of the polymerizable composition in these steps is referred to as "intermediate particle" in like manner of working example 7-1.

In addition to a series of the reactions described above, the in situ polymerization was done in the same manner as that used in this working example except for that resin 7A was not used. A Tg. of the resultant thermoplastic resin was 35° C. It means that a core of the capsulated toner obtained in this working example has a Tg of 35° C.

The toner was treated with an additive to prepare the toner of the present invention.

The toner was charged in LED Printer OKI MIKROLINE16n and used in printing. A fixation percentage thereof was measured. A temperature of a fixation device (a heat-roller) was set at 130° C. which was the same temperature as that of working example 7-1. The result is shown in Table 7. The capsulated toner of this working example indicated a good fixation.

A blocking resistance was determined in the same manner as that used in working example 7-1. As shown in working example 7-1, the capsulated toner of this working example caused no blocking and indicated a very good blocking resistance.

As a result of the test mentioned above, it is confirmed that the capsulated toner of this working example has a good fixation and a very good stability in preservation, can be clearly applicable to a non-contacting development, which does not tend to apply a mechanical pressure thereto, and further sufficiently applicable to a contacting development which tends to apply a comparatively high pressure thereto.

Working Example 7-4

The following mixture was put into an attritor ("MA-01SC" manufactured by Mitsui Miike Engineering Corp.) and dispersed at 15° C. for 10 hrs. to prepare a polymerizable composition.

| Component of mixture: | |
|---|---|
| Styrene: | 67.5 parts by weight |
| n-butyl acrylate: | 32.5 parts by weight |
| Resin 7A: (produced in this working example) | 0.25 part by weight |
| Low molecular weight polyethylene: (used as an offset preventing agent) | 1.5 part by weight |
| Electrostatic preventing agent: ("Aizensupiro black TRH" manufactured by Hodogaya Chemical Corp.) | 1 part by weight |
| Carbon black ("Printexl" manufactured by Degusa Co. Ltd.) | 7 parts by weight |
| 2,2'-Azo bis-isobutyronitrile | 1 part by weight |

8 Parts by weight of polyacrylate and 0.35 part by weight of divinylbenzen were dissolved in 180 parts by weight of ethanol. 600 Parts by weight of a distilled water was added to the mixture to prepare a dispersion medium. The polymerizable composition was added to the dispersion medium and dispersed at 15° C. for 10 minutes at a rate of 8,000 r.p.m in a TK homomixer ("M type" manufactured by Tokusyu Kika Kogyo Co., Ltd.). The resultant dispersion was put into a separable-one litter flask and reacted at 85° C. for 12 hrs. under a nitrogen flow with stirring at a rate of 100 r.p.m.

The intermediate particles thus obtained was treated by seeding polymerization in the same conditions as those used in working example 7-2. Then the toner was treated with an additive to prepare the toner of the present invention.

In addition to a series of the reactions described above, the in situ polymerization was done in the same manner as that used in this working example except for that resin 7A was not used. A Tg. of the resultant thermoplastic resin was 35° C. It means that a core of the capsulated toner obtained in this working example has a Tg of 35° C.

The toner was charged in LED Printer OKI MIKROLINE16n and used in printing. A fixation percentage thereof was measured. A temperature of a fixation device (a heat-roller) was set at 130° C. which was the same temperature as that of working example 7-1. The result is shown in Table 7. The capsulated toner of this working example indicated a good fixation.

A blocking resistance was determined in the same manner as that used in working example 7-1. As shown in working example 7-1, the capsulated toner of this working example also caused no blocking and indicated a very good blocking resistance.

As a result of the test mentioned above, it is confirmed that the capsulated toner of this working example has a good fixation and a very good stability in preservation, can be clearly applicable to a non-contacting development, which does not tend to apply a mechanical pressure thereto, and further sufficiently applicable to a contacting development which tends to apply a comparatively high pressure thereto.

Comparative Example 7-1

The following mixture was put into an attritor ("MA-01SC" manufactured by Mitsui Miike Engineering Corp.)

and dispersed at 15° C. for 10 hrs. to prepare a polymerizable composition.

| Component of mixture: | |
|---|---|
| Styrene: | 77.5 parts by weight |
| n-butyl acrylate: | 22.5 parts by weight |
| Low molecular weight polyethylene: (used as an offset preventing agent) | 1.5 part by weight |
| Electrostatic preventing agent: ("Aizensupiro black TRH" manufactured by Hodogaya Chemical Corp.) | 1 part by weight |
| Carbon black ("Pnntexl" manufactured by Degusa Co. Ltd.) | 7 parts by weight |
| 2,2'-Azo bis-isobutyronitrile | 1 part by weight |

8 Parts by weight of polyacrylate and 0.35 part by weight of divinylbenzen were dissolved in 180 parts by weight of ethanol. 600 Parts by weight of a distilled water was added to the mixture to prepare a dispersion medium. The polymerizable composition was added to the dispersion medium and dispersed at 15° C. for 10 minutes at a rate of 8,000 r.p.m in a TK homomixer ("M type" manufactured by Tokusyu Kika Kogyo Co., Ltd.). The resultant dispersion was put into a separable-one litter flask and reacted at 85° C. for 12 hrs. under a nitrogen flow with stirring at a rate of 100 r.p.m.

9 Parts by weight of methyl methacrylate, 1 part by weight of n-butyl acrylate, 0.5 part by weight of 2,2'-azo bis-isobutyronitrile, 0.1 part by weight of sodium laurylsulfate, and 80 parts by weight of water were mixed to prepare aqueous emulsion D. 18 Parts by weight of aqueous emulsion D was dripped to seeding-polymerize. After cooling the reaction mixture, the dispersion medium was dissolved with a 1 N aqueous hydrochloride acid solution and the mixture was filtrated. The residue thus obtained was washed with water, air-dried, dried at 40° C. for 12 hrs. under a reduced pressure of 20 mmHg and classified by air classifier to obtain a capsulated toner having an average particle diameter of 7 $\mu$m.

The toner was treated with an additive in the same manner as that used in working example 7-1 to prepare the toner of this comparative example.

A Tg. of the core thermoplastic resin obtained by in situ polymerization as 55° C. which is the same temperature of working example 7-1. The shell thermoplastic resin obtained by seeding polymerization has a Tg of 95° C.

The toner was charged in LED Printer OKI MIKROLINE16n and used in printing. A fixation percentage thereof was measured. The toner has a sufficient fixation like that of working examples 7-1 to 7-4.

A blocking resistance was determined in the same conditions as those used in working examples 7-1 to 7-4. A blocking resistance of the toner was very poor. The toner caused a terrible blocking and therefore it appeared that the capsulated toner of this comparative example was not practically useful.

Comparative Example 7-2

The following mixture was put into an attritor ("MA-01SC" manufactured by Mitsui Miike Engineering Corp.) and dispersed at 15° C. for 10 hrs. to prepare a polymerizable composition.

| Component of mixture: | |
|---|---|
| Styrene: | 67.5 parts by weight |
| n-butyl acrylate: | 32.5 parts by weight |
| Low molecular weight polyethylene: (used as an offset preventing agent) | 1.5 part by weight |
| Electrostatic preventing agent: ("Aizensupiro black TRH" manufactured by Hodogaya Chemical Co. Ltd.) | 1 part by weight |
| Carbon black ("Printexl" manufactured by Degusa Co. Ltd.) | 7 parts by weight |
| 2,2'-Azo bis-isobutyronitrile | 1 part by weight |

8 Parts by weight of polyacrylate and 0.35 part by weight of divinylbenzen were dissolved in 180 parts by weight of ethanol. 600 Parts by weight of distilled water was added to the mixture to prepare a dispersion medium. The polymerizable composition was added to the dispersion medium and dispersed at 15° C. for 10 minutes at a rate of 8,000 r.p.m in a TK homomixer ("M type" manufactured by Tokusyu Kika Kogyo Co., Ltd.). The resultant dispersion was put into a separable-one litter flask and reacted at 85° C. for 12 hrs. under a nitrogen flow with stirring at a rate of 100 r.p.m.

18 Parts by weight of aqueous emulsion C was dripped to seeding-polymerize. After cooling the reaction mixture, the dispersion medium was dissolved with a 1 N aqueous hydrochloride acid solution and the mixture was filtrated. The residue thus obtained was washed with water, air-dried, dried at 40° C. for 12 hrs. under a reduced pressure of 20 mmHg and classified by air classifier to obtain a capsulated toner having an average particle diameter of 7 $\mu$m.

The toner was treated with an additive in the same manner as that used in working example 7-1 to prepare the toner of this comparative example.

A Tg. of the core thermoplastic resin obtained by in situ polymerization is 35° C. which is the same temperature as that of working example 7-3. The shell thermoplastic resin obtained by seeding polymerization has a Tg of 100° C.

The toner was sufficient in a blocking resistance. The toner was charged in LED Printer OKI MIKROLINE16n and used in printing. A fixation percentage thereof was measured. The toner has an insufficient fixation.

Comparative Example 7-3

The following mixture was put into an attritor ("MA-01SC" manufactured by Mitsui Miike Engineering Corp.) and dispersed at 15° C. for 10 hrs. to prepare a polymerizable composition.

| Component of mixture: | |
|---|---|
| Styrene: | 77.5 parts by weight |
| n-butyl acrylate: | 22.5 parts by weight |
| Resin 7A | 0.25 part by weight |
| Low molecular weight polyethylene: (used as an offset preventing agent) | 1.5 part by weight |
| Electrostatic preventing agent: ("Aizensupiro black TRH" manufactured by Hodogaya Chemical Corp.) | 1 part by weight |
| Carbon black ("Printexl" manufactured by Degusa Co. Ltd.) | 7 parts by weight |

-continued

| Component of mixture: | |
|---|---|
| 2,2'-Azo bis-isobutyronitrile | 1 part by weight |

8 Parts by weight of polyacrylate and 0.35 part by weight of divinylbenzen were dissolved in 180 parts by weight of ethanol. 600 Parts by weight of a distilled water was added to the mixture to prepare a dispersion medium. The polymerizable composition was added to the dispersion medium and dispersed at 15° C. for 10 minutes at a rate of 8,000 r.p.m in a TK homomixer ("M type" manufactured by Tokusyu Kika Kogyo Co., Ltd.). The resultant dispersion was put into a separable-one litter flask and reacted at 85° C. for 12 hrs. under a nitrogen flow with stirring at a rate of 100 r.p.m.

9.25 Parts by weight of methyl methacrylate, 0.75 part by weight of n-butyl acrylate, 0.5 part by weight of 2,2'-azo bis-isobutyronitrile, 0.1 part by weight of sodium laurylsulfate, and 80 parts by weight of water were mixed to prepare aqueous emulsion E. 9 Parts by weight of aqueous emulsion E was dripped to enlarge. The suspension was further reacted as the second polymerization at 85° C. for 10 hrs. under a nitrogen atmosphere with stirring. After cooling the reaction mixture, the dispersion medium was dissolved with a 1 N aqueous hydrochloride acid solution and the mixture was filtrated. The residue thus obtained was washed with water, air-dried, dried at 40° C. for 12 hrs. under a reduced pressure of 20 mmHg and classified by air classifier to obtain a capsulated toner having an average particle diameter of 7 $\mu$m.

The toner was treated with an additive in the same manner as that used in working example 7-1 to prepare the toner of comparative example 3.

In addition to a series of the reactions described above, the in situ polymerization was done in the same manner as that used in this working example except for that resin 7A was not used. A Tg. of the resultant thermoplastic resin was 55° C. which is the same temperature as that of working example 7-1.

The thermoplastic resin obtained by the polymerization of aqueous emulsion E alone has a Tg of 92.5° C.

The toner was charged in LED Printer OKI MIKROLINE16n and used in printing. A fixation percentage thereof was measured in the same manner as that used in working example 7-1. Although the toner has a sufficient fixation, the blocking resistance of the toner very poor. Therefore it appeared that the capsulated toner of this comparative example was not practically useful.

Comparative Example 7-4

97.5 Parts by weight of methyl methacrylate, 2.5 part by weight of n-butyl acrylate and 3 parts by weight of 2,2'-azo bis-isobutyronitrile were put into a two litter-four neck-glass flask which was equipped with a thermometer, a stainless steel stirring rod, a reflux condenser and a nitrogen inlet tube. The flask was placed in a heating mantle and the mixture therein was reacted at 100° C. under a nitrogen flow. The polymerization product was occasionally sampled during the reaction to measure a Tg thereof. The reaction was ceased when the Tg of the polymerization product reached 60° C. The Tg was measured by differential scanning calorimeter (Type of "DSC220", manufactured by Seiko electronic industry Co., Ltd.). The resin thus obtained was designated as resin 7F.

It was confirmed that the Tg of polymerization product was 97.5° C., where the reaction time of this polymerization was sufficiently extended.

The following mixture was put into an attritor ("MA-01SC" manufactured by Mitsui Miike Engineering Corp.) and dispersed at 15° C. for 10 hrs. to prepare a polymerizable composition.

| Component of mixture: | |
|---|---|
| Styrene: | 77.5 parts by weight |
| n-butyl acrylate: | 22.5 parts by weight |
| Resin 7F | 0.25 part by weight |
| Low molecular weight polyethylene: (used as an offset preventing agent) | 1.5 part by weight |
| Electrostatic preventing agent: ("Aizensupiro black TRH" manufactured by Hodogaya Chemical Corp.) | 1 part by weight |
| Carbon black ("Printexl" manufactured by Degusa Co. Ltd.) | 7 parts by weight |
| 2,2'-Azo bis-isobutyronitrile | 1 part by weight |

8 Parts by weight of polyacrylate and 0.35 part by weight of divinylbenzen were dissolved in 180 parts by weight of ethanol. 600 Parts by weight of a distilled water was added to the mixture to prepare a dispersion medium. The polymerizable composition was added to the dispersion medium and dispersed at 15° C. for 10 minutes at a rate of 8,000 r.p.m in a TK homomixer ("M type" manufactured by Tokusyu Kika Kogyo Co., Ltd.). The resultant dispersion was put into a separable-one litter flask and reacted at 85° C. for 12 hrs. under a nitrogen flow with stirring at a rate of 100 r.p.m.

9 Parts by weight of aqueous emulsion C used in working example 7-2 was dripped to the suspension of the intermediate particles thus obtained and then seeding-polymerized. After cooling the reaction mixture, the dispersion medium was dissolved with a 1 N aqueous hydrochloride acid solution and the mixture was filtrated. The residue thus obtained was washed with water, air-dried, dried at 40° C. for 12 hrs. under a reduced pressure of 20 mmHg and classified by air classifier to obtain a capsulated toner having an average particle diameter of 7 $\mu$m.

The toner was treated with an additive in the same manner as that used in working example 7-1 to prepare the toner of comparative example 7-4.

In addition to a series of the reactions described above, the in situ polymerization was done in the same manner as that used in this working example except for that resin 7F was not used. A Tg. of the resultant thermoplastic resin was 55° C.

The thermoplastic resin obtained by the polymerization of aqueous emulsion C alone has a Tg of 100° C.

The toner was charged in LED Printer OKI MIKROLINE16n and used in printing. The toner has an insufficient fixation.

TABLE 7

| | Tg. of Core resin (° C.) | Resin | Tg. of shell resin (° C.) | Blocking percentage (%) | Fixation |
|---|---|---|---|---|---|
| Ex. 7-1 | 55 | 7A | 95 | 0 | ◎ |
| Ex. 7-2 | 55 | 7A | 100 | 0 | ◎ |

TABLE 7-continued

| | Tg. of Core resin (° C.) | Resin | Tg. of shell resin (° C.) | Blocking percentage (%) | Fixation |
|---|---|---|---|---|---|
| Ex. 7-3 | 35 | 7A | 95 | 0 | ⊙ |
| Ex. 7-4 | 35 | 7A | 100 | 0 | ⊙ |
| Com ex. 7-1 | 55 | — | 90 | 78 | ⊙ |
| Com ex. 7-2 | 35 | — | 100 | 0 | X |
| Com ex. 7-3 | 55 | 7A | 92.5 | 89 | ⊙ |
| Com ex. 7-4 | 55 | 7F | 100 | 0 | X |

*Ex. in the table means a working example.
*Com. ex. in the table means a comparative example.

Working Example 8-1

Working Examples 8-1 to 8-3 and comparative examples 8-1 to 8-3 mainly illustrate embodiment 8 of the present invention in detail.

100 Parts by weight of methyl methacrylate and 3 parts by weight of 2,2'-azo bis-isobutyronitrile were put into a two litter-four neck-glass flask which was equipped with a thermometer, a stainless steel stirring rod, a reflux condenser, and a nitrogen inlet tube. The flask was placed in a heating mantle and the mixture therein was reacted at 100° C. The polymerization product was occasionally sampled during the reaction to measure a Tg thereof. The reaction was ceased when the Tg of the polymerization product reached 60° C. The Tg was measured by differential scanning calorimeter (Type of "DSC220", manufactured by Seiko electronic industry Co., Ltd.). The resin thus obtained was designated as resin 8A. It was confirmed that the Tg of polymerization product was 100° C., when the reaction time of this polymerization was sufficiently extended.

The following mixture was put into an attritor ("MA-01SC" manufactured by Mitsui Miike Engineering Corp.) and dispersed at 15° C. for 10 hrs. to prepare a polymerizable composition.

| Component of mixture: | |
|---|---|
| Styrene: | 67.5 parts by weight |
| n-butyl acrylate: | 32.5 parts by weight |
| Resin 8A: | 0.25 part by weight |
| Low molecular weight polyethylene: (used as an offset preventing agent) | 1.5 part by weight |
| Electrostatic preventing agent: ("Aizensupiro black TRH" manufactured by Hodogaya Chemical Corp.) | 1 part by weight |
| Carbon black ("Printexl" manufactured by Degusa Co. Ltd.) | 7 parts by weight |
| 2,2'-Azo bis-isobutyronitrile | 1 part by weight |

8 Parts by weight of polyacrylate and 0.35 part by weight of divinylbenzen were dissolved in 180 parts by weight of ethanol. 600 Parts by weight of a distilled water was added to the mixture to prepare a dispersion medium. The polymerizable composition was added to the dispersion medium and dispersed at 15° C. for 10 minutes at a rate of 8,000 r.p.m in a TK homomixer ("M type" manufactured by Tokusyu Kika Kogyo Co., Ltd.). The resultant dispersion was put into a separable-one litter flask and reacted at 85° C. for 12 hrs. under a nitrogen flow with stirring at a rate of 100 r.p.m. The dispersoid obtained by polymerization of the polymerizable composition in these steps is referred to as "intermediate particle".

9.5 Parts by weight of methyl methacrylate, 0.5 part by weight of n-butyl acrylate, 0.5 part by weight of 2,2'-azo bis-isobutyronitrile, 0.1 part by weight of sodium laurylsulfate and 80 parts by weight of water were mixed and the mixture was treated by ultrasonic generator ("US-150", Nippon Seiki Industry Co., Ltd.) to prepare aqueous emulsion B. 9 Parts by weight of aqueous emulsion B was dripped to the aqueous suspension of the intermediate particles to enlarge the particles. Just after dripping, the aqueous suspension was observed by optical microscope to see no droplet of the emulsion. It was therefore confirmed that the enlargement had done for a very short time. The suspension was further reacted as the second polymerization at 85° C. for 10 hrs. under a nitrogen atmosphere with stirring. After cooling the reaction mixture, the dispersion medium was dissolved with a 0.5 N aqueous hydrochloride acid solution and the mixture was filtrated. The residue thus obtained was washed with water, air-dried, dried at 40° C. for 10 hrs. under a reduced pressure of 10 mmHg and classified by air classifier to obtain a capsulated toner having an average particle diameter of 7 $\mu$m.

0.35 Parts by weight of a fine powder of a hydrophobic silica "Aerosil R-972" (manufactured by Japan Aerosil Co., Lid.) was mixed with 50 parts by weight of the resultant capsulated toner to obtain the capsulated toner of the present invention.

In addition to a series of the reactions described above, the in situ polymerization was done in the same manner as that used in this working example except for that resin 8A was not used. A Tg. of the resultant thermoplastic resin was 35° C. It means that a core of the capsulated toner obtained in this working example has a Tg of 35° C.

The thermoplastic resin obtained by the polymerization of aqueous emulsion B alone has a Tg of 95° C. It means that a shell resin of the capsulated toner obtained in this working example has a Tg of 95° C.

The toner was charged in LED Printer OKI MIKROLINE16n and used in printing. A fixation percentage thereof was measured. A temperature of a fixation device (a heat-roller) was set at 130° C.

A fixation percentage is defined by the following equation.

Fixation percentage (%)=(image density after rubbing/image density before rubbing)×100

The term "image density before rubbing" means an image density of a solid color of print which is measured by Macbeth densitometer. The term "image density after rubbing" means an image density which is retained on a print after Scotch-tape is overlaid on a solid color of the print, applied a load of 50 g/cm$^2$ to a given area by reciprocation action and removed from the print at a rate of 3 cm/sec.

The fixation percentage thus measured is classified in the following manner and summarized in Table 8.

Fixation percentage 90 to 100% ⊙: 50 to 90% ○: 0 to 50% X

The capsulated toner of this working example indicates a good fixation.

A blocking resistance of the toner was determined by the following method. A cylindrical container having a bottom of 20 cm$^2$ was charged with 20 grams of the toner sample, capped and given a pressure of 500 g/cm$^2$ by weight. The toner was kept at 50° C. in this condition for a month. All of the sample toner (20 g) was transferred onto a sieve of 45 $\mu$m mesh, vibrated at a rate of 1 KHz for 30 seconds and then the toner retained on the sieve was weighed.

A blocking percentage (%) is defined by the following equation.

Blocking percentage (%)=Weight of toner retained on sieve (g)/Weight of sample toner (g)×100

The capsulated toner of this working example caused no blocking and indicated a very good stability in preservation.

As a result of the test mentioned above, it is confirmed that the capsulated toner of this working example has a good fixation and a very good stability in preservation, can be clearly applicable to a non-contacting development, which does not tend to apply a mechanical pressure thereto, and further sufficiently applicable to a contacting development which tends to apply a comparatively high pressure thereto.

Working Example 8-2

90 Parts by weight of methyl methacrylate, 10 parts by weight of n-butyl acrylate and 3 parts by weight of 2,2'-azo bis-isobutyronitrile were put into a two litter-four neck-glass flask which was equipped with a thermometer, a stainless steel stirring rod, a reflux condenser, and a nitrogen inlet tube. The flask was placed in a heating mantle and the mixture therein was reacted at 100° C. The polymerization product was occasionally sampled during the reaction to measure a Tg thereof. The reaction was ceased when the Tg of the polymerization product reached 60° C. The Tg was measured by differential scanning calorimeter (Type of "DSC220", manufactured by Seiko electronic industry Co., Ltd.). The resin thus obtained was designated as resin 8C. It was confirmed that the Tg of polymerization product was 90° C., when the reaction time of this polymerization was sufficiently extended.

The following mixture was put into an attritor ("MA-01SC" manufactured by Mitsui Miike Engineering Corp.) and dispersed at 15° C. for 10 hrs. to prepare a polymerizable composition.

| Component of mixture: | |
|---|---|
| Styrene: | 72.5 parts by weight |
| n-butyl acrylate: | 27.5 parts by weight |
| Resin B(8C)★: | 0.25 part by weight |
| Low molecular weight polyethylene: (used as an offset preventing agent) | 1.5 part by weight |
| Electrostatic preventing agent: ("Aizensupiro black TRH" manufactured by Hodogaya Chemical Corp.) | 1 part by weight |
| Carbon black ("Printexl" manufactured by Degusa Co. Ltd.) | 7 parts by weight |
| 2,2'-Azo bis-isobutyronitrile | 1 part by weight |

8 Parts by weight of polyacrylate and 0.35 part by weight of divinylbenzen were dissolved in 180 parts by weight of ethanol. 600 Parts by weight of a distilled water was added to the mixture to prepare a dispersion medium. The polymerizable composition was added to the dispersion medium and dispersed at 15° C. for 10 minutes at a rate of 8,000 r.p.m in a TK homomixer ("M type" manufactured by Tokusyu Kika Kogyo Co., Ltd.). The resultant dispersion was put into a separable-one litter flask and reacted at 85° C. for 12 hrs. under a nitrogen flow with stirring at a rate of 100 r.p.m. The dispersoid obtained by polymerization of the polymerizable composition in these steps is referred to as "intermediate particle".

9 Parts by weight of methyl methacrylate, 1 part by weight of n-butyl acrylate, 0.5 part by weight of 2,2'-azo bis-isobutyronitrile, 0.1 part by weight of sodium laurylsulfate and 80 parts by weight of water were mixed and the mixture was treated by ultrasonic generator ("US-150", Nippon Seiki Industry Co., Ltd.) to prepare aqueous emulsion D. 9 Parts by weight of aqueous emulsion D was dripped to the aqueous suspension of the intermediate particles to enlarge the particles. Just after dripping, the aqueous suspension was observed by optical microscope to see no droplet of the emulsion. It was therefore confirmed that the enlargement had done for a very short time.

The suspension was further reacted as the second polymerization at 85° C. for 10 hrs. under a nitrogen atmosphere with stirring. After cooling the reaction mixture, the dispersion medium was dissolved with a 0.5 N aqueous hydrochloride acid solution and the mixture was filtrated. The residue thus obtained was washed with water, air-dried, dried at 40° C. for 10 hrs. under a reduced pressure of 10 mmHg and classified by air classifier to obtain a capsulated toner having an average particle diameter of 7 $\mu$m.

The toner was treated with an additive in the same manner as that of working example 8-1 to prepare the capsulated toner of the present invention.

In addition to a series of the reactions described above, the in situ polymerization was done in the same manner as that used in this working example except for that resin 8C was not used. A Tg. of the resultant thermoplastic resin was 45° C. It means that a core of the capsulated toner obtained in this working example has a Tg of 45° C.

The thermoplastic resin obtained by the polymerization of aqueous emulsion D alone has a Tg of 80° C. It means that a shell resin of the capsulated toner obtained in this working example has a Tg of 80° C.

The toner was charged in LED Printer OKI MIKROLINE16n and used in printing. A fixation percentage thereof was measured. A temperature of a fixation device (a heat-roller) was set at 130° C. which was the same temperature as that of working example 8-1. The result is shown in Table 8. The capsulated toner of this working example indicates a good fixation.

A blocking resistance was determined in the same manner as that used in working example 8-1. As shown in working example 8-1, the capsulated toner of this working example caused no blocking and indicated a very good blocking resistance.

As a result of the test mentioned above, it is confirmed that the capsulated toner of this working example has a good fixation and a very good stability in preservation, can be clearly applicable to a non-contacting development, which does not tend to apply a mechanical pressure thereto, and further sufficiently applicable to a contacting development which tends to apply a comparatively high pressure thereto.

Working Example 8-3

80 Parts by weight of methyl methacrylate, 20 parts by weight of n-butyl acrylate and 3 parts by weight of 2,2'-azo bis-isobutyronitrile were put into a two litter-four neck-glass flask which was equipped with a thermometer, a stainless steel stirring rod, a reflux condenser, and a nitrogen inlet tube. The flask was placed in a heating mantle and the mixture therein was reacted at 100° C. The polymerization product was occasionally sampled during the reaction to measure a Tg thereof. The reaction was ceased when the Tg of the polymerization product reached 60° C. The Tg was measured by differential scanning calorimeter (Type of "DSC220", manufactured by Seiko electronic industry Co., Ltd.). The resin thus obtained was designated as resin 8E. It was confirmed that the Tg of polymerization product was 80° C., when the reaction time of this polymerization was sufficiently extended.

The following mixture was put into an attritor ("MA-01SC" manufactured by Mitsui Miike Engineering Corp.) and dispersed at 15° C. for 10 hrs. to prepare a polymerizable composition.

| Component of mixture: | |
|---|---|
| Styrene: | 77.5 parts by weight |
| n-butyl acrylate: | 22.5 parts by weight |
| Resin 8E: (produced in this working example) | 0.25 part by weight |
| Low molecular weight polyethylene: (used as an offset preventing agent) | 1.5 part by weight |
| Electrostatic preventing agent: ("Aizensupiro black TRH" manufactured by Hodogaya Chemical Corp.) | 1 part by weight |
| Carbon black ("Printexl" manufactured by Degusa Co. Ltd.) | 7 parts by weight |
| 2,2'-Azo bis-isobutyronitrile | 1 part by weight |

8 Parts by weight of polyacrylate and 0.35 part by weight of divinylbenzen were dissolved in 180 parts by weight of ethanol. 600 Parts by weight of a distilled water was added to the mixture to prepare a dispersion medium. The polymerizable composition was added to the dispersion medium and dispersed at 15° C. for 10 minutes at a rate of 8,000 r.p.m in a TK homomixer ("M type" manufactured by Tokusyu Kika Kogyo Co., Ltd.). The resultant dispersion was put into a separable-one litter flask and reacted at 85° C. for 12 hrs. under a nitrogen flow with stirring at a rate of 100 r.p.m. The dispersoid obtained by polymerization of the polymerizable composition in these steps is referred to as "intermediate particle".

8.5 Parts by weight of methyl methacrylate, 1.5 part by weight of n-butyl acrylate, 0.5 part by weight of 2,2'-azo bis-isobutyronitrile, 0.1 part by weight of sodium laurylsulfate and 80 parts by weight of water were mixed and the mixture was treated by ultrasonic generator ("US-150", Nippon Seiki Industry Co., Ltd.) to prepare aqueous emulsion F. 9 Parts by weight of aqueous emulsion F was dripped to the aqueous suspension of the intermediate particles to enlarge the particles. Just after dripping, the aqueous suspension was observed by optical microscope to see no droplet of the emulsion. It was therefore confirmed that the enlargement had done for a very short time.

The suspension was further reacted as the second polymerization at 85° C. for 10 hrs. under a nitrogen atmosphere with stirring. After cooling the reaction mixture, the dispersion medium was dissolved with a 0.5 N aqueous hydrochloride acid solution and the mixture was filtrated. The residue thus obtained was washed with water, air-dried, dried at 40° C. for 10 hrs. under a reduced pressure of 10 mmHg and classified by air classifier to obtain a capsulated toner having an average particle diameter of 7 $\mu$m.

The toner was treated with an additive in the same manner in working example 8-1 to prepare the capsulated toner of the present invention.

In addition to a series of the reactions described above, the in situ polymerization was done in the same manner as that used in this working example except for that resin 8E was not used. A Tg. of the resultant thermoplastic resin was 55° C. It means that a core of the capsulated toner obtained in this working example has a Tg of 55° C.

The thermoplastic resin obtained by the polymerization of aqueous emulsion F alone has a Tg of 70° C. It means that a shell resin of the capsulated toner obtained in this working example has a Tg of 70° C.

The toner was charged in LED Printer OKI MIKROLINE16n and used in printing. A fixation percentage thereof was measured. A temperature of a fixation device (a heat-roller) was set at 130° C. which was the same temperature as that of working example 8-1. The result is shown in Table 8. The capsulated toner of this working example indicates a good fixation.

A blocking resistance was determined in the same manner as that used in working example 8-1. As shown in working example 8-1, the capsulated toner of this working example caused no blocking and indicated a very good blocking resistance.

As a result of the test mentioned above, it is confirmed that the capsulated toner of this working example has a good fixation and a very good stability in preservation, can be clearly applicable to a non-contacting development, which does not tend to apply a mechanical pressure thereto, and further sufficiently applicable to a contacting development which tends to apply a comparatively high pressure thereto.

Comparative Example 8-1

The following mixture was put into an attritor ("MA-01SC" manufactured by Mitsui Miike Engineering Corp.) and dispersed at 15° C. for 10 hrs. to prepare a polymerizable composition.

| Component of mixture: | |
|---|---|
| Styrene: | 67.5 parts by weight |
| n-butyl acrylate: | 32.5 parts by weight |
| Resin 8C (Resin 8C is the same as that used in working example 8-2.) | 0.25 part by weight |
| Low molecular weight polyethylene: (used as an offset preventing agent) | 1.5 part by weight |
| Electrostatic preventing agent: ("Aizensupiro black TRH" manufactured by Hodogaya Chemical Corp.) | 1 part by weight |
| Carbon black ("Printexl" manufactured by Degusa Co Ltd.) | 7 parts by weight |
| 2,2'-Azo bis-isobutyronitrile | 1 part by weight |

8 Parts by weight of polyacrylate and 0.35 part by weight of divinylbenzen were dissolved in 180 parts by weight of ethanol. 600 Parts by weight of a distilled water was added to the mixture to prepare a dispersion medium. The polymerizable composition was added to the dispersion medium and dispersed at 15° C. for 10 minutes at a rate of 8,000 r.p.m in a TK homomixer ("M type" manufactured by Tokusyu Kika Kogyo Co., Ltd.). The resultant dispersion was put into a separable-one litter flask and reacted at 85° C. for 12 hrs. under a nitrogen flow with stirring at a rate of 100 r.p.m. The dispersoid obtained by polymerization of the polymerizable composition in these steps is referred to as "intermediate particle".

10 Parts by weight of methyl methacrylate, 0.5 part by weight of 2,2'-azo bis-isobutyronitrile, 0.1 part by weight of sodium laurylsulfate and 80 parts by weight of water were mixed to prepare aqueous emulsion G. 9 Parts by weight of aqueous emulsion G was dripped to the aqueous suspension of the intermediate particles to enlarge the particles. Just after dripping, the aqueous suspension was observed by optical microscope to see no droplet of the emulsion. It was therefore confirmed that the enlargement had done for a very short time.

The suspension was further reacted as the second polymerization at 85° C. for 10 hrs. under a nitrogen atmosphere with stirring. After cooling the reaction mixture, the dispersion medium was dissolved with a 0.5 N aqueous hydrochloride acid solution and the mixture was filtrated. The residue thus obtained was washed with water, air-dried, dried at 40° C. for 10 hrs. under a reduced pressure of 10 mmHg and classified by air classifier to obtain a capsulated toner having an average particle diameter of 7 $\mu$m.

The toner was treated with an additive in the same manner in working example 8-1 to prepare the capsulated toner of the present invention.

In addition to a series of the reactions described above, the in situ polymerization was done in the same manner as that used in this working example except for that resin 8C was not used. A Tg of the resultant thermoplastic resin was 55° C., which was the same temperature of the resin particle prepared in working example 8-1. It means that a core of the capsulated toner obtained in this working example has a Tg of 55° C.

The thermoplastic resin obtained by polymerization of aqueous emulsion G alone has a Tg of 100° C. It means that the shell resin of the capsulated toner obtained in this example has a Tg of 100° C.

The toner was charged in LED Printer OKI MIKROLINE16n and used in printing. A fixation percentage thereof was measured. A temperature of a fixation device (a heat-roller) was set at 130° C. which was the same temperature as that of working example 8-1. The result is shown in Table 8. The capsulated toner of this example indicates a good fixation.

A blocking resistance was determined in the same manner as that used in working example 8-1. The toner of this example caused a blocking completely and it appeared that the toner was not practically useful.

Comparative Example 8-2

The following mixture was put into an attritor ("MA-01SC" manufactured by Mitsui Miike Engineering Corp.) and dispersed at 15° C. for 10 hrs. to prepare a polymerizable composition.

| Component of mixture: | |
|---|---|
| Styrene: | 72.5 parts by weight |
| n-butyl acrylate: | 27.5 parts by weight |
| Resin 8E (Resin E8 was the same as that used in working example 8-3.) | 0.25 part by weight |
| Low molecular weight polyethylene: (used as an offset preventing agent) | 1.5 part by weight |
| Electrostatic preventing agent: ("Aizensupiro black TRH" manufactured by Hodogaya Chemical Corp.) | 1 part by weight |
| Carbon black ("Printexl" manufactured by Degusa Co. Ltd.) | 7 parts by weight |
| 2,2'-Azo bis-isobutyronitrile | 1 part by weight |

8 Parts by weight of polyacrylate and 0.35 part by weight of divinylbenzen were dissolved in 180 parts by weight of ethanol. 600 Parts by weight of a distilled water was added to the mixture to prepare a dispersion medium. The polymerizable composition was added to the dispersion medium and dispersed at 15° C. for 10 minutes at a rate of 8,000 r.p.m in a TK homomixer ("M type" manufactured by Tokusyu Kika Kogyo Co., Ltd.). The resultant dispersion was put into a separable-one litter flask and reacted at 85° C. for 12 hrs. under a nitrogen flow with stirring at a rate of 100 r.p.m.

A seeding polymerization was conducted with the aqueous emulsion B used in working example 8-1 in the same conditions as those used in working example 8-1 to prepare a capsulated toner.

The toner was treated with an additive in the same manner in working example 8-1 to prepare the capsulated toner of the present invention.

The toner was charged in LED Printer OKI MIKROLINE16n and used in printing. A fixation percentage thereof was measured. A temperature of a fixation device (a heat-roller) was set at 130° C. which was the same temperature as that of working example 8-1. The result is shown in Table 8. The capsulated toner of this working example indicated a good fixation.

A blocking resistance was determined in the same manner as that used in working example 8-1. The toner of this working example caused a blocking completely and it appeared that the toner was not practically useful.

Comparative Example 8-3

85 Parts by weight of methyl methacrylate, 15 parts by weight of n-butyl acrylate and 3 parts by weight of 2,2'-azo bis-isobutyronitrile were put into a two litter-four neck-glass flask which was equipped with a thermometer, a stainless steel stirring rod, a reflux condenser, and a nitrogen inlet tube. The flask was placed in a heating mantle and the mixture therein was reacted at 100° C. The polymerization product was occasionally sampled during the reaction to measure a Tg thereof. The reaction was ceased when the Tg of the polymerization product reached 60° C. The Tg was measured by differential scanning calorimeter (Type of "DSC220", manufactured by Seiko electronic industry Co., Ltd.). The resin thus obtained was designated as resin 8H. It was confirmed that the Tg of polymerization product was 70° C., when the reaction time of this polymerization was sufficiently extended.

The following mixture was put into an attritor ("MA-01SC" manufactured by Mitsui Miike Engineering Corp.) and dispersed at 15° C. for 10 hrs. to prepare a polymerizable composition.

| Component of mixture: | |
|---|---|
| Styrene: | 77.5 parts by weight |
| n-butyl acrylate: | 22.5 parts by weight |
| Resin 8H | 0.25 part by weight |
| Low molecular weight polyethylene: (used as an offset preventing agent) | 1.5 part by weight |
| Electrostatic preventing agent: ("Aizensupiro black TRH" manufactured by Hodogaya Chemicai Corp.) | 1 part by weight |
| Carbon black ("Printexl" manufactured by Degusa Co. Ltd.) | 7 parts by weight |
| 2,2'-Azo bis-isobutyronitrile | 1 part by weight |

8 Parts by weight of polyacrylate and 0.35 part by weight of divinylbenzen were dissolved in 180 parts by weight of ethanol. 600 Parts by weight of a distilled water was added to the mixture to prepare a dispersion medium. The polymerizable composition was added to the dispersion medium and dispersed at 15° C. for 10 minutes at a rate of 8,000 r.p.m in a TK homomixer ("M type" manufactured by Tokusyu Kika Kogyo Co., Ltd.). The resultant dispersion was put into a separable-one litter flask and reacted at 85° C. for 12 hrs. under a nitrogen flow with stirring at a rate of 100 r.p.m.

A seeding polymerization was conducted with the aqueous emulsion D used in working example 8-2 in the same conditions as those used in working example 8-2 to prepare a capsulated toner.

The toner was treated with an additive in the same manner in working example 8-1 to prepare the capsulated toner of the present invention.

The toner was charged in LED Printer OKI MIKROLINE16n and used in printing. A fixation percentage thereof was measured. A temperature of a fixation device (a heat-roller) was set at 130° C. which was the same temperature as that of working example 8-1. The result is shown in Table 8. The capsulated toner of this working example indicated a good fixation.

A blocking resistance was determined in the same manner as that used in working example 8-1. The toner of this working example caused a blocking completely and it appeared that the toner was not practically useful.

TABLE 8

| | Tg. of Core resin (° C.) | Resin | Rg. of shell resin (° C.) | Blocking percentage (%) | Fixation |
|---|---|---|---|---|---|
| Ex. 8-1 | 35 | 8A | 90 | 0 | ⊙ |
| Ex. 8-2 | 45 | 8C | 80 | 0 | ⊙ |
| Ex. 8-3 | 55 | 8E | 70 | 0 | ⊙ |
| Com ex.8- 1 | 35 | 8C | 100 | 70 | ⊙ |
| Com ex.8-2 | 45 | 8E | 90 | 68 | ⊙ |
| Com ex.8- 3 | 55 | 8H | 80 | 50 | ⊙ |

*Ex. in the table means a working example.
*Com. ex. in the table means a comparative example.

What is claimed is:

1. A toner comprising:

a core that includes a core material as a main component;

a shell that includes a shell material as a main component;

a component-changing portion between the core and shell and that includes both the core material and the shell material, wherein the amount of core material in the component changing portion gradually decreases in the direction from the core to the shell, and the amount of shell material in the component-changing portion gradually decreases in the direction from the shell to the core;

an outer shell that covers the shell, including an outer shell material as a main component; and a shell component changing portion between the shell and the outer shell, the shell component changing portion including the shell material and the outer shell material, wherein the amount of shell material in the shell component-changing portion gradually decreases in the direction from the shell to the outer shell, the amount of outer shell material in the shell component-changing portion gradually decreases in the direction from the outer shell to the shell.

2. A toner according to claim 1, wherein the core material of the core is a core material subjected to a first polymerization;

the shell material of the shell is a shell material subjected to a second polymerization;

the component-changing portion is produced through commencement of the second polymerization prior to completion of the first polymerization.

3. A toner comprising:

a core that includes as a main component a core material subjected to a first polymerization;

a shell that includes as a main component a shell material subjected to a second polymerization;

a component changing portion between the core and shell and that includes both the core material and the shell material, the component changing portion being produced through commencement of the second polymerization prior to completion of the first polymerization, wherein the amount of core material in the component changing portion gradually decreases in the direction from the core to the shell, and the amount of shell material in the component-changing portion gradually decreases in the direction from the shell to the core;

an outer shell that covers the shell, produced through third polymerization of an outer shell material, the outer shell including the outer shell material as a main component; and a shell component changing portion between the shell and the outer shell, the shell component changing portion including the shell material and the outer shell material, the shell component changing portion produced through commencement of the third polymerization prior to the completion of the second polymerization, wherein the amount of shell material in the shell component-changing portion gradually decreases in the direction from the shell to the outer shell, the amount of outer shell material in the shell component-changing portion gradually decreases in the direction from the outer shell to the shell.

4. A toner, comprising;

a core that includes a thermoplastic core material as a main component;

a shell that includes a thermoplastic shell material as a main component;

an intermediate layer between a core and a shell, the intermediate layer including a thermoplastic intermediate material as a main component, wherein the intermediate layer and the shell are produced by seeded polymerization, and wherein a glass-transition temperature Tg of thermoplastic resin of the intermediate layer is higher than that of thermoplastic resin of the core and is higher than that of thermoplastic resin of the shell;

a first component changing portion between the core and the intermediate layer, the first component changing portion including both the core material and the intermediate material, wherein the amount core material in the first component changing portion gradually decreases in the direction from the core to the intermediate layer, and the amount of intermediate material in the first component changing portion gradually decreases in the direction from the intermediate layer to the core; and a second component changing portion between the intermediate layer and the shell, the second component changing portion including both the intermediate material and the shell material, wherein the amount of intermediate material in the second component changing portion gradually decreases in the direction from the intermediate layer to the shell, and the amount of shell material in the second component-changing portion gradually decreases in the direction from the shell to the intermediate layer.

5. The toner according to claim 4 wherein the shell material comprises resin in an amount of from 0.1 to 4 parts by weight based on a total amount of the core material and the shell material.

6. A toner cartridge, storing the toner according to claim 4.

* * * * *